US012215494B2

(12) United States Patent
Buran et al.

(10) Patent No.: US 12,215,494 B2
(45) Date of Patent: Feb. 4, 2025

(54) CHASSIS GUIDANCE SYSTEM AND METHOD FOR MODULAR BUILDINGS

(71) Applicant: ASSEMBLY OSM, INC., New York, NY (US)

(72) Inventors: Cristian Buran, Sacile (IT); Andrea Vittadini, Brookyn, NY (US); Leon Parkhouse, Ventura, CA (US); John Cerone, Brooklyn, NY (US); Lorenzo Panero, Fontanafredda (IT); Ennio Picco, Budoia (IT)

(73) Assignee: Assembly OSM, Inc., New York, NY (US)

( * ) Notice: Subject to any disclaimer, the term of this patent is extended or adjusted under 35 U.S.C. 154(b) by 0 days.

(21) Appl. No.: 18/252,209

(22) PCT Filed: Nov. 11, 2021

(86) PCT No.: PCT/US2021/072346

§ 371 (c)(1),
(2) Date: May 9, 2023

(87) PCT Pub. No.: WO2022/104350

PCT Pub. Date: May 19, 2022

(65) Prior Publication Data

US 2023/0392368 A1 Dec. 7, 2023

Related U.S. Application Data

(60) Provisional application No. 63/112,391, filed on Nov. 11, 2020.

(51) Int. Cl.
*E04B 1/348* (2006.01)
*E04B 1/38* (2006.01)

(52) U.S. Cl.
CPC ..... *E04B 1/3483* (2013.01); *E04B 1/388* (2023.08)

(58) Field of Classification Search
CPC ..... E04B 1/3483; E04B 1/388
(Continued)

(56) References Cited

U.S. PATENT DOCUMENTS 11,230,838 B1 * 1/2022 Mendez-Vazquez ... E04B 1/388
2005/0210762 A1 9/2005 Broberg
(Continued)

OTHER PUBLICATIONS

International Search Report and Written Opinion, US Patent and Trademark Office, Application No. PCT/US2021/072346, Mar. 23, 2022.

*Primary Examiner* — James J Buckle, Jr.
(74) *Attorney, Agent, or Firm* — Gottlieb, Rackman & Reisman, PC

(57) ABSTRACT

Systems and methods for use in automatic alignment of prefabricated building modules. Mating alignment structures on a new module and one more placed modules or mounted pilots interact as the new module is lowered to align edges of the new module relative to the placed components. Different alignment structure types are used to provide different degrees of positional alignment for different edges of a module during installation. When two edges of a module are simultaneously constrained, a horizontal position of one edge is constrained to a greater degree than the second edge. Alignment structures also can be configured so the degree of position constraint on a particular edge varies and to change which module edges are constrained as a module is lowered into position. The system and methods are suitable for use with prefabricated building modules having preinstalled interlocking façade panels.

19 Claims, 42 Drawing Sheets

(58) Field of Classification Search
USPC ..... 52/79.13
See application file for complete search history.

(56) References Cited

U.S. PATENT DOCUMENTS

| | | | | |
|---|---|---|---|---|
| 2007/0271857 | A1* | 11/2007 | Heather | B65D 88/022 52/79.9 |
| 2015/0337527 | A1 | 11/2015 | Wallance | |
| 2016/0160515 | A1* | 6/2016 | Wallance | E04F 10/10 52/745.02 |
| 2017/0044753 | A1 | 2/2017 | Bowron | |
| 2021/0372115 | A1* | 12/2021 | Poh | E04B 1/3483 |
| 2023/0304278 | A1* | 9/2023 | DiCristofaro | E04H 3/08 |

* cited by examiner

CHASSIS GUIDANCE SYSTEM AND METHOD FOR MODULAR BUILDINGS

CROSS-REFERENCE TO RELATED APPLICATIONS

This application claims priority to U.S. Provisional Application Ser. No. 63/112,391, filed on Nov. 11, 2020, the entire contents of which is expressly incorporated by reference.

FIELD

The present disclosure relates to systems and methods for aligning prefabricated building modules as they are combined to form a modular building.

BACKGROUND

Historically, buildings have been constructed almost entirely on-site, starting with a framework of girders, and then adding floors, walls, outer cladding, and the various internal electrical, plumbing, and electrical connections. Recently, there has been a shift to constructing high-rise buildings using pre-fabricated modules that are shipped to the building site where they are stacked and joined together. Each module is a generally box shaped unit with a primary chassis or framework comprising vertical support posts and horizontal cross members joined together at corner nodes. A prefabricated module may also be at least partially finished with internal walls, flooring, and hookups for electricity and water.

During construction, an initial tier of modules is installed starting with a first module affixed to a building foundation or platform. Horizontally adjacent modules are then installed in sequence and fixed in place. Subsequent tiers of modules can be installed over installed lower tiers. A significant issue during such a process is the need to align the various modules as they are lowered in place. Where components on one module are designed to interlock with corresponding components on another module, the initial alignment of a module being placed must be within the narrow range of tolerance for such interaction. For safety reasons, construction personnel should stand off some distance from the module as it is being lowered into place. This increases the difficulty of accurate manual module alignment during the building process.

A particular situation where accurate installation tolerance must be met is where a builder wants a to use modules with façade panels pre-installed on the module. Façade panels on adjacent modules can be configured to interlock as one module is lowered into place next to an already positioned module. For adjacent panels to interlock and seal during module installation, an alignment tolerance for panel interlock, and therefore alignment tolerance for the module, of less than or equal to 10 mm can be required.

In view of this, many users of prefabricated modules opt to use modules without the outward facing façade panels pre-installed. Instead, the panels are installed after the modules have been assembled and fixed in place. This additional exterior work decreases the efficiency of the building process and can increase the overall cost of the building. The building process may also be slowed due to difficulties in installing large exterior building panels in inclement weather.

Accordingly, it would be advantageous to have an improved system and method for aligning with a high degree of accuracy a module being installed relative to one or more modules already in place. It would be a further advantage if such a system provided very accurate alignment in a largely automatic manner as the module is being lowered into place. It would be a yet a further advantage if such a system could be incorporated in significant part in the structure of a prefabricated module.

SUMMARY

These and other needs are met by the system and methods disclosed herein in which building modules are is provided with alignment structures comprising various female guides and male guides mounted on the edges of one or more of the interior facing sides of the module chassis. Alignment structures on a new module to be installed interact with alignment structures on an adjacent previously installed module to automatically align the new module relative to the position of the prior module as the new module is lowered into position. The methods and systems provide for alignment of module edges within a range of tolerances sufficiently narrow that prefabricated modules with pre-installed façade panels designed to interlock with adjacent panels can be used.

Initial engagement of the alignment structures can be achieved when the new module is positioned over an adjacent prior installed module with only a moderate degree of accuracy. The alignment structures are configured to most tightly constrain horizontal motion of an outer edge of the new module relative to an adjacent outer edge of an installed module. Automatic alignment can be within several millimeters, such as +/4 mm from an ideal position. This is sufficiently accurate to be within the alignment tolerances required for interlocking façade panels to engage (and whereon final relevant adjustment of façade panel positions can be accomplished according to the panel design, and may be automatic in accordance with interlock hardware of the panels themselves.

The position of one or more additional edges of the new module are also constrained by the alignment structures as the new module is lowered into place but to a somewhat lesser degree along at least one horizontal axis to compensate for variations in the positions of alignment components on the new module relevant to each other and to mating components of a prior module within design tolerances and avoid binding or damage to components during the installation process.

The alignment structures can be configured and positioned so that they automatically engage and disengage at different heights as a new module is lowered into place. In an particular embodiment, the alignment structures are configured to entirely disengage so that the present structures and methods can be used in conjunction with conventional hardware for providing final object alignment, such as tapered alignment pins mounted on and extending upwards from the substrate and that engage alignment holes in the underside of a module when the module is very close to the substrate on which it is being placed, such as within a few centimeters. Accordingly, the present systems and methods operate to accurately and automatically align a new module to the degree required for engagement of the alignment pins. At that point, the present alignment structures automatically disengage and the alignment pins operate to finalize the placement of the module as it is lowered into its final position.

In a further embodiment, the degree to which a module edge is constrained during installation can vary as the module is lowered and as alignment structures that constrain other edges of the module are automatically engaged or disengaged. In one example alignment hardware operates to tightly constrain a first edge of a new module as it is initially lowered through a first installation zone while a second edge is constrained more loosely. As the module is lowered into a lower second installation zone, the alignment structures constraining the first edge transition from tight constraint to a looser constraint, the alignment structures constraining the second edge disengage and alignment structures to constrain the position of a third edge automatically engage and operate to tightly constrain the position of the third edge. As such, during the installation, only two edges of the module are constrained by the alignment structures with one edge tightly constrained and the other edge more loosely constrained.

A limited set of alignment structure types is provided and which are combined to provide the alignment structures for placement of new modules in a variety of situations, including placement of a first module, of a standard module along a row of modules, of a module at the start of a second row of modules, and of a final module in the second row of modules. The alignment structures comprise first, second, and third types of male guides and first, second, and third types of female guides.

First type male and first type female guides are compatible and configured so that when a first type male guide is engaged in a first type female guide and can slide along the guide axis, motion of the male guide is narrowly constrained both along a lateral axis running across the channel of the female guide perpendicular to the guide axis and along a normal axis that is perpendicular to the guide axis and the lateral axis and so extends outwards away from the channel of the female guide. In an embodiment motion along the lateral axis and along the normal axis is constrained to a first constraint amount, although amount of constraint need not be the same for both axes. The first constraint amount reflects the maximum horizontal displacement permitted for the edge of a module being installed that has the most stringent position requirements, such as the outer edge of a new module that will be adjacent an outer edge of a placed module, and where, for example, façade panels are pre-installed and very close alignment of adjacent façade edges is required during module installation.

The first male and female guide types are configured so that when type one male and female guides are engaged, the male guide cannot be disengaged from the female guide except by motion of the male guide relative to the female guide along the guide axis. In an embodiment the first male and female guide types are in a dovetail configuration with side angle of between 40 and 50 degrees, such as 45 degrees and the first constraint amount is between about 3 mm and 5 mm, such as about 4 mm.

Second type male and second type female guides are compatible with each other and configured so that when a second type male guide is engaged within a second type female guide, motion of the male guide along the lateral axis is constrained to a second constraint amount that is larger than the first constraint amount. I.e., the permitted range of motion of the male guide along the lateral axis is larger for a second type male guide in a second type female guide than the lateral axis range of motion permitted for a first type male guide type in a first type female guide. The constraint amount in the lateral axis for engaged male and female guides of the second type can be the same or larger than the amount provided by engaged male and female guides of the first type. In an embodiment the lateral axis constraint amount is substantially the same for first type and second type guides. The second male and female guide types are configured so that when second type male and female guides are engaged, the male guide cannot be disengaged from the female guide except by motion along the guide axis. In an embodiment the second male and female guide types are in a dovetail configuration with side angle of between 20 and 40 degrees, such as 30 degrees and the second constraint amount on the lateral axis is between about 8 mm and 12 mm, such as about 10 mm while the second constraint amount along the normal axis is substantially the same as the first constraint amount.

Third type male and third type female guides are compatible with each other and configured so that when a third type male guide is engaged within a third type female guide, motion of the male guide along the lateral axis is constrained to a third constraint amount that is larger than the first constraint amount and, for example, may equal the second lateral axis constraint amount. Unlike the first and second guide types, the third guide types are configured so that when a third type male guide is engaged within a third type female guide, the male guide can be disengaged from the female guide by moving the male guide away from the female guide channel along the normal axis. Motion of the male guide along the normal axis and into the female guide is constrained by the physical components themselves. Since the male guide can be disengaged from the female guide by moving it outward along the normal axis, there is no actual constraint provided. A third constraint along the normal axis can be defined as a range of motion along the normal axis within which the male guide will remain at least partially within and constrained in the lateral axis by the female guide. In an embodiment the third type male guide has a rectangular cross-section and the third type female guide has a rectangular cross-section channel and the third constraint amount on both the lateral axis and the normal axis is substantially equal to the second lateral axis constraint amount, such as between about 8 mm and 12 mm, such as about 10 mm.

Various configurations of first, second, and third male and female guides are positioned on the exterior of a module and with consideration of corresponding female and male guides present on an adjacent wall of a similar or different module design depending on the place module in the installation process (e.g., a first module, typical row module, second row start module, or second row end module).

Depending on the placement position of a new module relevant to one or more already placed modules, or no modules, various pilot components physically separate from the modules and having male or female guides thereon are used can be used to provide guidance when a module edge to be guided is not adjacent alignment structure present on an already installed module. In one scenario, pilots are mounted on the top of an installed module and placed to interact with alignment structure on a new module. As the new module is lowered, the pilot captures the alignment structure on the new module and positions the new module relative to alignment structure on the placed module before the bottom of the new module is lower than the top of the placed module, and after which the alignment structures on the new and placed module engage. In another scenario, a pilot can be mounted directly to the substrate to provide alignment of a new module edge where there is no adjacent edge of an installed module to reference. After installation of a new module, any pilots used in the process can be removed for reuse in installation of another module.

A set of pilots can be provided with different types of male and female guides mounted vertically thereon for use in conjunction with compatible male and female guides. In an embodiment, the set of pilots include first and second type male pilots having mounted thereon a respective first type or second type male guide, and first, second, and third type female pilots have mounted thereon, respectively, a first, second, or third type female guide. Female pilots can be further configured so the female guide therein extends fully to the bottom of a pilot or stop shorts, where the appropriate stopping point is dependent on the relative location between a module and the respective pilot at which a male guide engaged with the female guide on the pilot is to disengage from the female guide on the pilot. The top of the female pilots can include a funnel structure that will help capture the end of male guide and direct it into the female guide on the pilot as the male guide is lowered. Likewise, the tops of male guides on male pilots can be tapered so they can more easily slot within female guide.

In a particular embodiment, a typical row module comprises a framework with a top, bottom, front, back, and first and second sides defined by respective front and back first and second supports. The front side of the module is the outward facing side when the module is installed. When a new first row module is to be installed adjacent a prior module that is already installed the first side of the prior module and the second side of the new module will be adjacent.

The first side of the typical row module has a forward male guide extending along the first front support from a first height on the module upwards towards the top of the module. A rear male guide runs along the first rear support from the first height upwards towards the top of the building module. The second side of the typical row module has a forward upper female guide section positioned along the second front support at a second height which is lower than the first height and a forward lower female guide section on the second front support at a third height that is lower than the second height. Likewise rear upper and lower female guide sections are positioned along the second rear support and the second and third heights, respectively. The forward male guide and forward upper and lower female guide sections are of type one configurations. The rear male guide and rear upper and lower female guide sections are of type two configurations. In an embodiment, the respective upper and lower female guide sections are separate from each other. In an alternative embodiment the respective upper and lower female guide sections can be a top section and a bottom section of a single elongated female guide.

When a new typical row module is to be installed next to a prior place typical row module (or a different type of module having the same alignment structures on its first side as a typical row module), the new module can be positioned a first position relative to the prior module wherein the forward and rear male guides on the prior module are engaged in the forward and rear lower female guides, respectively, on the new module but the forward and rear upper female guides on the new module are above the tops forward and rear male guides on the prior module and so not engaged to these male guides.

The new module can then be lowered from the first position to the second position in which the forward and rear male guides on the prior module are engaged in the forward and rear upper female guides, respectively, on the new module but the forward and rear lower female guides on the new module are now below the bottoms the forward and rear male guides on the prior module and so all of the female guides are disengaged.

While one or both of the forward female guides on the new module are engaged with the forward male guide on the prior module, these guides operate to align the front edge of the new module relative to the adjacent edge of the prior module and constrain horizontal motion of the new module's front edge to a first constraint amount along the normal and lateral axes relative to the female guides. Likewise, while one or both of the rear female guides on the new module are engaged with the rear male guide on the prior module, these guides operate to align the rear edge of the new module relative to the adjacent rear edge of the prior module and constrain horizontal motion of the new module's rear edge to a second constraint amount along the normal and lateral axes relative to the female guides that is a lesser amount of constraint than the first constraint amount.

The new module can then be lowered from the second position to a third position in which the forward and rear upper female guides are each below the first height and so are disengaged from the respective forward and rear guides on the prior module.

In further embodiment, a first pilot with a first type male guide can be temporarily mounted to the top of the prior module so the male guide of the first pilot is in alignment with and extends vertically the forward male guide on the prior module. A second pilot with a second type male guide can be temporarily mounted to the top of the prior module so the male guide of the second pilot is in alignment with and extends vertically the rear male guide the prior module. At the start of installation, the new module can be positioned so that its bottom is over the top of the first and second pilots. The new module can then be generally aligned with the pilots and lowered towards the first position and wherein the lower front and rear female guides on the new module will be engaged by the male guides on the first and second pilots and the new module aligned with the prior module before the new module is lowered to the first position.

In a particular embodiment, a first row start module comprises a framework with a top, bottom, front, back, and first and second sides defined by respective front and back first and second supports. The front side and second side of the module are outward facing when the module is installed.

A forward male guide block projects outwards from a lower front corner of the first side of the building module adjacent the first front support. The top of the forward male block is a first male block distance above the base of the module. A rear male guide block projects outwards from a lower corner of the rear side of the module adjacent the second side. The top of the rear male block is a second male block distance above the base of the module.

In installation of the first row start module on a substrate, a forward female pilot with a female guide compatible with the forward male guide block is removably mounted to the substrate adjacent the desired placement point of the module corner where the front, first and bottom sides meet and with the channel of the female guide on the pilot open towards the first side of the module. A rear female pilot with a female guide compatible with the rear male guide block is removably mounted to the substrate adjacent the desired placement point of the module corner where the rear, second and bottom sides meet and with the channel of the female guide on the pilot open towards the rear side of the module.

The first row start module is lowered to a first position in which the forward male guide block is captured by and engaged within the female guide on the forward pilot and the rear male guide block is captured by and engaged within the female guide on the rear pilot. In this position, the interaction of the forward male guide block and forward female pilot constrain horizontal motion of the associated edge of the module to within a first constraint amount and the interaction of the rear male guide block and rear female pilot constrain horizontal motion of the associated edge of the module to within a second constraint amount that is a lesser amount of constraint than the first constraint amount.

In a particular embodiment, the forward male guide block is of the first male guide type, the forward female pilot has a first type female guide, the rear male guide block is of the third male guide type and the rear female pilot has a third type female guide.

In a further embodiment, the bottom end of the female channel on the forward pilot is at a forward channel height that is higher, relative to the substrate when the pilot is installed, than the first male block distance of the top of the forward male guide block from the bottom of the module. Likewise, the bottom end of the female channel on the rear pilot is at a rear channel height that is higher, relative to the substrate when the pilot is installed, than the second male block distance of the top of the rear male guide block from the bottom of the module. Accordingly, the module is lowered from the first position to a second position where the tops of the front and rear male guide blocks are lower than the bottoms of the front and rear pilot female channels, the front and rear male guide blocks automatically disengage from the respective female channels in the pilots.

Upward facing alignment pins can be placed on the substrate in positions to receive corresponding alignment holes in the bottom of the module. The geometry and placement of the male guide blocks and female guides in the pilots can be selected so that male guide blocks disengage from the respective pilots before the module is fully seated on the substrate but after the alignment pins engage the respective alignment holes.

In a particular embodiment, a system for installation of a second row start module comprises the second row start module (new module) and three pilot modules. The new module comprises a framework with a top, bottom, front, back, and first and second sides defined by respective front and back first and second supports. The front side and second side of the second row start module are to be outward facing from the building when the second row start module is installed. The new module is to be placed on a substrate as the start of the second row of modules with the new module back adjacent the back of a previously placed module (such as the end of the first row) and where the first side of the placed module is in alignment with the second side of the new module.

The three pilots comprise a first female pilot with a first type female channel, a second female pilot with a second type female channel, and a third female pilot with a first type female channel.

A first male guide is on the back of the new module and extends along the second back support from substantially the bottom to substantially the top of the new module. The first male guide has a lower portion which is configured as a first male guide type that extend from the bottom of the first male guide to a transition height an upper portion which is of the third male guide type and extends from the transition height to the top of the first male guide. A second male guide is on the back of the new module and extends along the first back support from substantially the bottom of the new module to a second guide height. The second male guide is of a second male guide type. A male guide block of the first type is on the first side of the new module at the bottom of the first front support.

During installation of the new module, the first pilot is removably mounted on the top of the placed module in the corner adjacent the back and first side of the placed module. The second pilot is removably mounted on the top of the placed module in the corner adjacent the back and second side of the placed module. The third pilot is removably mounted to the substrate adjacent the desired placement point of the corner of the new module where its front, first, and bottom sides meet.

The new module is positionable in a first position relative to the placed module where the bottom of the new module is above the top of the placed module, and in which the lower portion of the first male guide engages the first female channel in the first pilot component and the second male guide engages the second female channel in the second pilot component, and wherein interaction of the engaged lower portion of the first male guide and first female channel in the first pilot constrains the associated edge of the new module a first constraint amount and the interaction of the second male guide and the second female channel engages the associated edge of the new module a second constraint amount that is a lesser amount of constraint than the first constraint amount.

The new module is movable from the first position to a second lower position wherein the top of the new module is above the top of the placed module, the transition point of the first male guide is below the first channel start, and in which the upper portion of the first male guide engages the first female channel in the first pilot component, the top of the second male guide is below the second channel start, and the male guide block engages the third female channel in the third pilot component, and wherein interaction of the engaged male guide block and the third female channel in the third pilot constrains the associated edge of the new module substantially the first constraint amount and the interaction of upper portion of the first male guide and the first female channel in the first pilot constrains the associated edge of the new module by a third constraint amount that is a lesser amount of constraint than the first constraint amount.

In an embodiment, the female channel in the third pilot starts at a third guide height above the substrate when the third pilot is mounted on the substrate and the top of the male guide block is at a height above the bottom of the module that is less than the third guide height. The new module is movable from the second position to a third lower position wherein the top of the male guide block is lower than the third guide height above the substrate and the male guide block is disengaged from the female channel in the third pilot. The bottom of the female channel in the first pilot can be at a start distance above the bottom of the first pilot so that when the new module is in the third position, the top of the first male guide is below the bottom of the female channel in the first pilot.

In a particular embodiment, a system for installation of a second row end module (new module) adjacent a prior installed first row start module and adjacent a prior installed typical row module is provided.

The new module comprises a framework with a top, bottom, front, back, and first and second sides defined by respective front and back first and second supports. The front side and first side of the new module are to be outward facing from the building when the new module is installed. The new module is to be placed on a substrate with the back of the new module adjacent the back of the first row start module and the second side of the new module adjacent the first side of the prior typical row module.

The second side of the new module has a forward upper female guide positioned along the second front support at an upper female guide height. A forward lower female guide is on the second front support in alignment with the first female guide and at lower female guide height. The upper and lower female guides are configured to engage a forward male guide on the prior typical row module and extending along its first front support from a first height on the module upwards towards the top of the module, and where the first height is higher than the upper female guide height.

A male guide block is positioned on the back of the new module at the bottom of the first back support. The male guide block is configured to engage a female guide positioned on the back of the first row start module and that runs along the second back support upwards from a first distance above the substrate to substantially the top of the first row start module.

The upper and lower female guides can be of the first female guide type and the forward male guide is of the compatible first male guide type. The male guide block can be of the third male guide type and the female guide on the first row start module of the third female guide type.

A first male pilot is provided and that can be removably installed on the prior typical row module to extend the forward male guide on the prior typical row module above the module top. A first female pilot is provided that can be removably installed on the prior first row start module to extend the female guide on the first row start module above the module top.

The new module can be placed in a first position where the lower female guide engages the male guide on the first pilot and the make guide block engages the female guide on the second pilot. As the new module is lowered to a second position the lower and then upper female guides engage the male guide on the prior typical row module such that the horizontal position of the associated edge of the new module is constrained by a first constraint amount. The male guide block engaged the female guide on the prior first row start module such that the horizontal position of the associated edge of the new module is constrained by a second constraint amount that is a lesser amount of constraint than the first constraint amount.

The new module can be lowered from the second position to a third position above the substrate and wherein the top female guide is below the bottom end of the male guide on the prior typical row module and the male guide block is below the bottom end of female guide on the prior first row module.

DESCRIPTION OF THE DRAWINGS

Further features and advantages of the invention, as well as structure and operation of various implementations of the invention, are disclosed in detail below with references to the accompanying drawings in which.

DETAILED DESCRIPTION

Set forth below are various systems and methods for modular chassis guidance which operate to align the chassis of a building module as it is lowered into place immediately adjacent to the chassis of zero, one, or two previously installed modules. It should be understood that while various aspects of the present systems and methods may provide particular benefit for building modules with pre-installed façade panels, particularly where adjacent panels are designed to interlock during installation, the systems and methods are also suitable for use in alignment of building module chassis that do not have façade panels. Unless otherwise stated, the terms module, building module, and chasses are used interchangeably.

Figure 1:
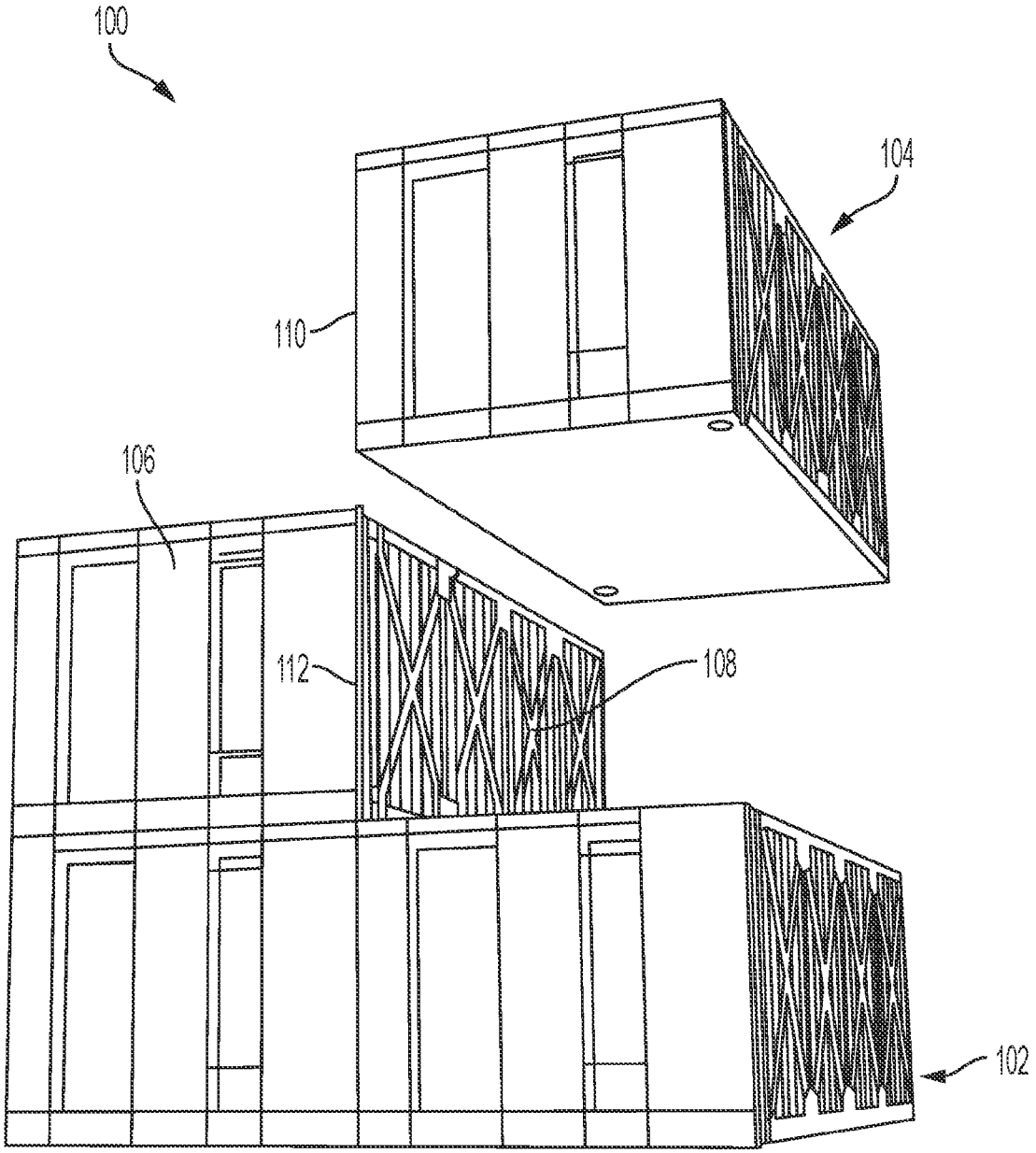
FIG. 1 shows a partially assembled multi-level modular building.

FIG. 1 shows a partially assembled multi-level modular building 100 with several prefabricated modules 102 already positioned and a new module 104 being lowered into place in the second level. Each module has an outward facing side 106 with a façade panel pre-mounted thereon and interior sides 108 which will not be visible from the exterior of the building. The edge 110 of the façade on the new module 104 and the adjacent edge 112 of the façade on the installed module is a critical alignment area where tight alignment tolerances must be met.

FIGS. 2A-2D show a sequence in which a tier of modules can be installed on a substrate of a modular building. Where the tier is the first level of the building, the substrate can be a building foundation, platform, or similar structure. For higher level tiers, the substrate will typically be the top surfaces of the modules on which the new tier is placed. FIGS. 2A-2D also show the schematic locations of alignment structures used in positioning a given module during installation. The various alignment structures are addressed in detail below. It is noted that they are all positioned on interior walls.

Figure 2A:
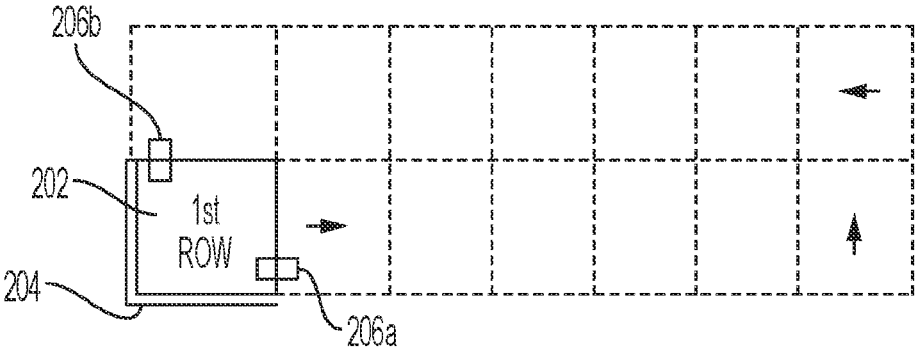
FIGS. 2A-2D show a sequence in which a tier of modules can be installed on a substrate of a modular building.

FIG. 2A shows placement position of first module 202 of a given tier. The outward facing exterior walls 204 of the module 202 are also illustrated. The module 202 is aligned during installation with alignment structures at diagonally opposite outside edges 206*a*, 206*b*.

Figure 2B:
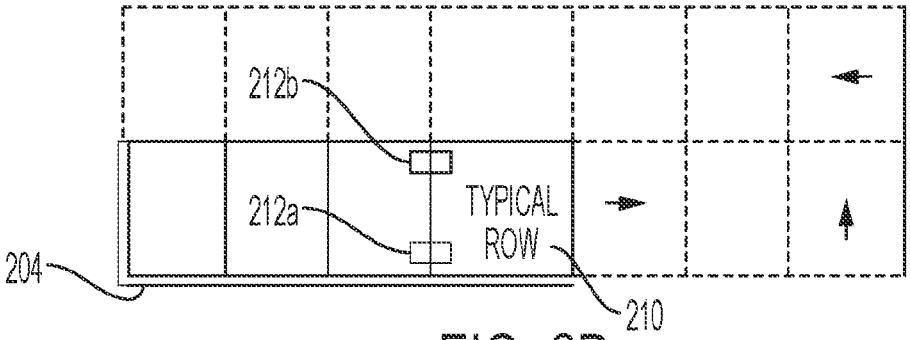

Most of the modules in an installation will be in the middle of a row and have only one exterior wall. Such typical row modules are installed sequentially along the row from the first module. FIG. 2B illustrates a typical first row module 210 with alignment structures 212*a* and 212*b*. The last module in a row can also be aligned as a typical row module.

Figure 2C:
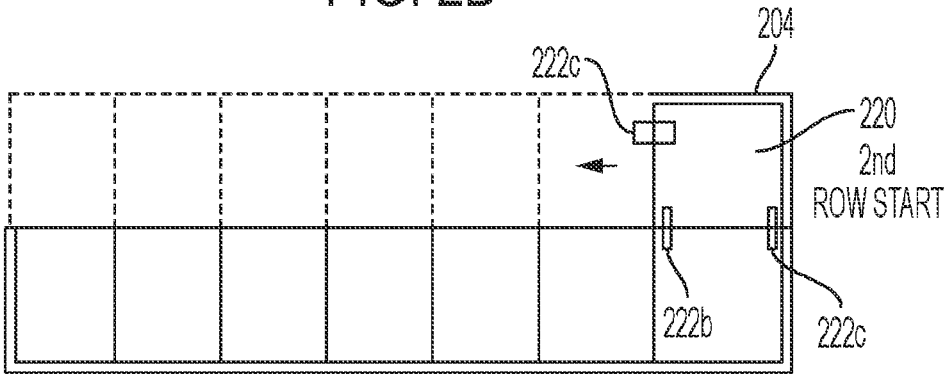
Figure 2D:
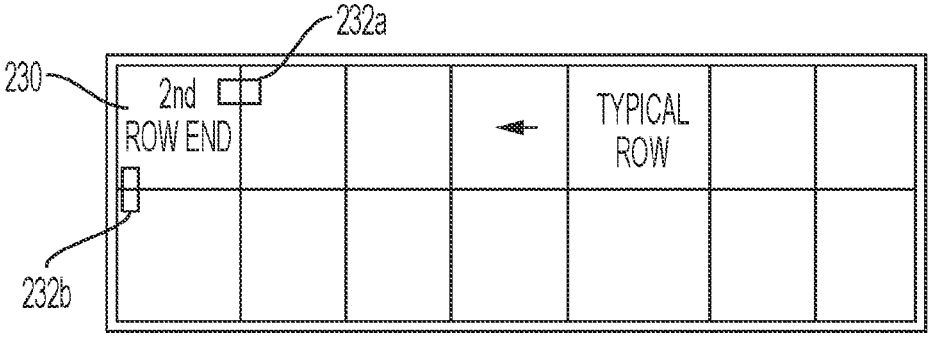

FIG. 2C shows a second row starting module 220 with alignment structures 222*a*, 222*b*, and 222*c*. The second row starting module placement will typically be placed adjacent the last module in the preceding row. Finally, FIG. 2D shows an end module 230 of the second row with alignment structures 232*a* and 232*b*.

While only two rows of modules are shown in FIGS. 2A-2D, a similar placement process can be used for placing more than two rows of chassis in a tier and for tier arrangements that are not solid rectangular, such as where the chassis form an open ring to define an inner atrium or air shaft, where the rows on a tier are different lengths or are offset, or where the chassis in a tier are arranged in other non-rectangular configurations.

Various modules as shown in FIGS. 2A-2D and in other tier configurations can be categorized according to placement characteristics:

(a) Module placed with no adjacent chassis (E.g., a first module on a tier);

(b) Module placed adjacent a long side of an already placed chassis (such as typical module);

(c) Module placed in a corner condition adjacent a short side of an already placed chassis (such as second row start); and (d) Module placed at a corner condition adjacent the long side of one already placed chassis and the short side of another already placed chassis (such as second row end).

As discussed further below, the same basic principles are used for alignment of each of these modules during placement with variations in the particular alignment structure configuration and installation methods based on the specific placement characteristics. In general, building modules are provided with a series of female guides and/or male guides on the edges of one or more of the exterior sides of the module chassis. When a new module is lowered next to a module that is already in position on a substrate, the female and male alignment components on the adjacent module sides interact to automatically align edges of the new module relative to those of the placed.

Additionally, pilot components with male or female guides can be removably mounted on the top of an already placed module, such as to existing hardware in the upper corners of the module, and operate to interact with alignment structure on a new module to position the respective edge of the new module relative to alignment structure on the placed module before the bottom of the new module is lower than the top of the placed module. Pilots can also be mounted to the substrate to provide an alignment structure where alignment of an edge of a new module is desired but where there is no adjacent wall of a placed module to use as an alignment reference. One example of this is placement of the first module. After installation of a module, any pilots used in the process can be removed for reuse in installation of another module.

As will be appreciated when a given module is being installed its initial alignment must be accurately enough at least for the guide components to engage the pilots. In addition to overall horizontal position of the module, if the module is too far from horizontal as it is lowered the guides might not engage the pilots, if they engage, the forces applied to guide components may exceed design tolerances and façade components of the adjacent modules may end up positioned beyond the tolerance range for them to engage as designed. Accordingly, suitable module lifting equipment should be used to ensure that a module being placed is horizontally positioned within specified tolerance ranges along each axis.

The alignment guides on the module sides can also be used in conjunction with other alignment mechanisms. If both alignment mechanisms are engaged at the same time they should be configured so that during such dual-engagement, one mechanism does not operate to force an object into an alignment position outside the range of the other alignment mechanism, a situation that lead to binding. In a particular configuration, the alignment guides on the module sides are used in conjunction with tapered alignment pins mounted on and extending upwards from the substrate a short distance, such as about 20 mm, and that engage alignment holes in the underside of a new module and operate to finalize the accurate placement of the new module on the substrate as the module is lowered this small remaining distance to the substrate. Such alignment pins can take various forms, such as cones, pyramids, tapered cylinders, etc. and various suitable structures are known in the art.

When alignment pins are in use, the alignment structures on the sides of the modules interact to accurately align the module to the degree required for engagement of the alignment pin within the alignment hole. The guides can be configured to release from engagement when new module has been lowered enough for at least the top of the alignment pin to engage the corresponding alignment holes in the new module. Thereafter, final alignment of the new module is provided by the upward alignment pins interacting with the corresponding alignment holes on the bottom of the new module as the new module is lowered into its final position.

Figure 3A:
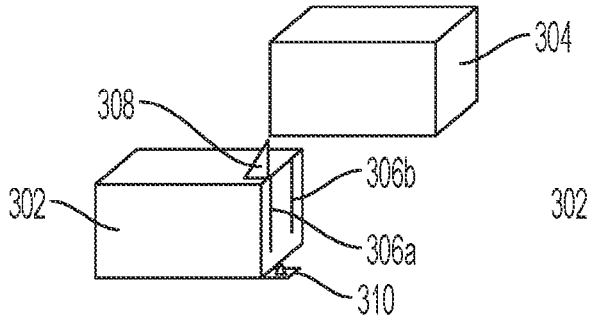
FIGS. 3A-3E are schematic illustrations of various stages and types of alignment interactions for a new module being lowered into position next to a previously installed module.

FIGS. 3A-3E are schematic illustrations of various stages and types of alignment interaction as a new module is lowered into position next to a prior module. Turning to FIG. 3A, there is shown a prior placed module 302 and a new module 304 about to be installed. Male alignment rods 306*a*, 306*b* are shown on the face of module 302 that will be adjacent the new module 304. Corresponding and compatible female alignment structures (not shown) are located on the face of module 304 that will be adjacent to module 302. (Alternatively, one or both of the alignment rods 306*a*, 306*b* can be female alignment structures and the corresponding male structures placed on the new module 304.) A pilot 308 is mounted on the top of module 302 and serves to extend the alignment structure 306*a* above the top of the module 302. Also illustrated is an alignment cone 310 mounted on the substrate and which will engage a corresponding aperture on the bottom of the new module 304 (not shown).

Figure 3B:
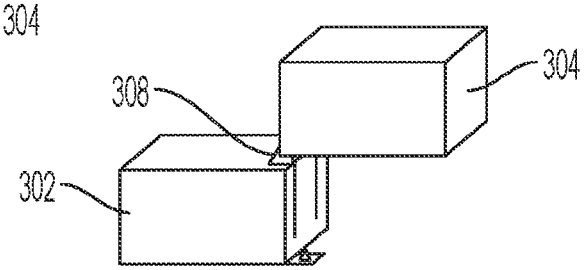

FIG. 3B shows the new module 304 in an initial position where the bottom of the new module 304 is above the top of the placed module 302. In this initial position, alignment structure on the pilot 308 engages alignment structure on the module 304 to perform an initial alignment of the module 304. The alignment structure on the pilot can be tapered (for a male guide) or funneled (for a female guide) so that accuracy of the module 304 placement at this position is less than required for the corresponding alignment structures on the placed module 302 and new module 304 to engage.

Figure 3C:
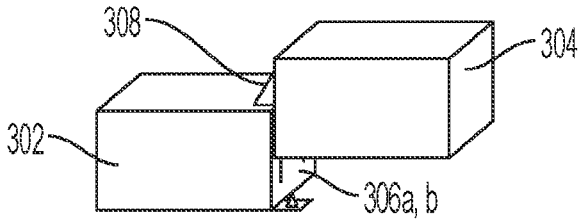

FIG. 3C shows the new module 304 lowered to an intermediate position or placement zone where the bottom of the new module 304 is lower than the top of the placed module 302. Alignment structures on the new module 304 and the placed module 302 interact to constrain the horizontal position of the edges of the new module 304 relative to adjacent edges of the placed module 302 to within a predefined range.

Figure 3D:
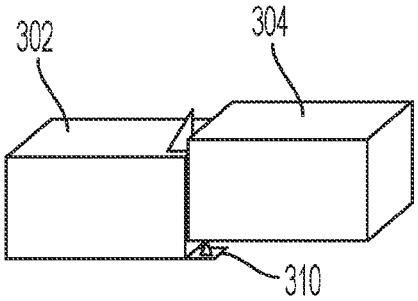

FIG. 3D shows the new module 304 lowered further to a position in which the bottom of the new module 304 is at or slightly below the top of the alignment pin 310 and where the alignment pin 310 begins to engage the corresponding alignment hold on the bottom of the new module 304. The alignment structures on the new and placed modules 304, 302 can be configured so that when the new module 304 reaches this position, the alignment structures on the modules 302, 304 disengage. Alternatively, at least some of the alignment structures on the modules 302, 304 can remain engaged.

The alignment structures on the new module 304 and placed module 302 can be configured so that the degree of alignment provided by engaged alignment structures varies as the module 304 is moved from the position of FIG. 3C to the position of FIG. 3D. Alternatively, or in addition, the alignment structures can be configured so that some alignment structures on the modules 302, 304 disengage as the module 304 is lowered while other alignment structures then engage in generally the same position.

Figure 3E:
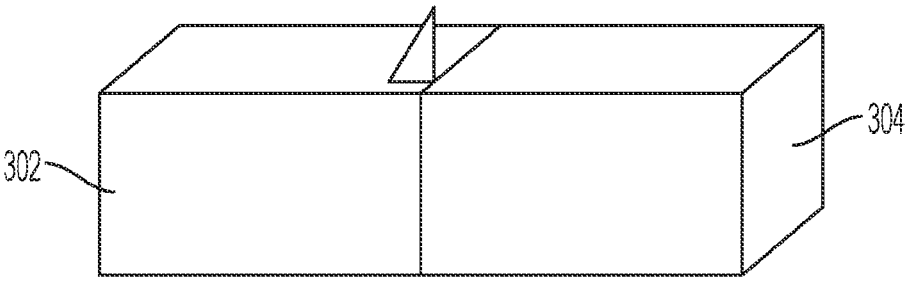

As the module 304 is further lowered from the position of FIG. 3D onto the substrate, as shown in FIG. 3E, final alignment of the module 304 is provided by the interaction of the alignment pin 310 with the alignment hole on the underside of the module 304.

While only a single alignment pin is shown, in practice two or more pins can be provided. While final alignment by alignment pins are shown, alternative types of final alignment mechanisms could be used instead. Alternatively, if the alignment position tolerance provided by the interacting alignment structure is deemed sufficient, other more accurate alignment mechanisms, such as alignment pins, may not be required. In such a case, at least some of the alignment structures on the modules 302, 304 can remain engaged so that the horizontal position of the module 304 continues to be kept in the desired alignment position until the module 304 is placed on the substrate.

Various combinations and designs of male and female alignment structures are used to provide alignment of a new module in the placement scenarios discussed with respect to FIGS. 2A-2D, above. In the embodiments as disclosed herein, three different male guide types and three different compatible female guide types can be used. Each combination of a male guide type with a female guide type can provide a different predefined range of motion along axes perpendicular to the guide axis, i.e., along a lateral one axis perpendicular to the guide axis and through the channel of the female guide, and along a normal axis that is perpendicular to the guide axis and the lateral axis. A particular guide axis, lateral axis, and normal axis is defined with respect to the specific male and female guides at issue. Accordingly differently placed and oriented guides will not necessary have lateral or normal axes that are parallel. (All of the guides discussed herein are oriented vertically so the guide axes will be generally parallel.) Appropriate combination of guides of different types are used to provide the most stringent alignment in critical areas while allowing for enough horizontal motion in other areas to compensate for variations in component position with manufacturing tolerance ranges so as to avoid potential binding and/or damage of alignment components as the module is lowered.

The various alignment guides are introduced below with respect to FIGS. 4A-4B, 5A-5C, and 6A-6B which show various embodiments of pilots each with a male or a female guide connected to a supporting structure that can be removably mounted to a substrate. The configuration of each pilot is then further addressed in detail. The various male and female guide type configurations used on the pilots are also used in the male and female guides mounted to sides of a module as further addressed herein. The supporting structure used in the pilots on which the each respective male guide is mounted can be the same. Likewise the supporting structure used in the pilots on which the respective female guides are mounted can be the same. In an embodiment, the pilots are each configured to be removably mountable to a common mounting structure on a substrate. Minor differences in dimensions of a given supporting structure in a plot may be required to ensure that an attached male or female guide is positioned properly relative to the location where the pilot is to be mounted on the substrate.

Figure 4B:
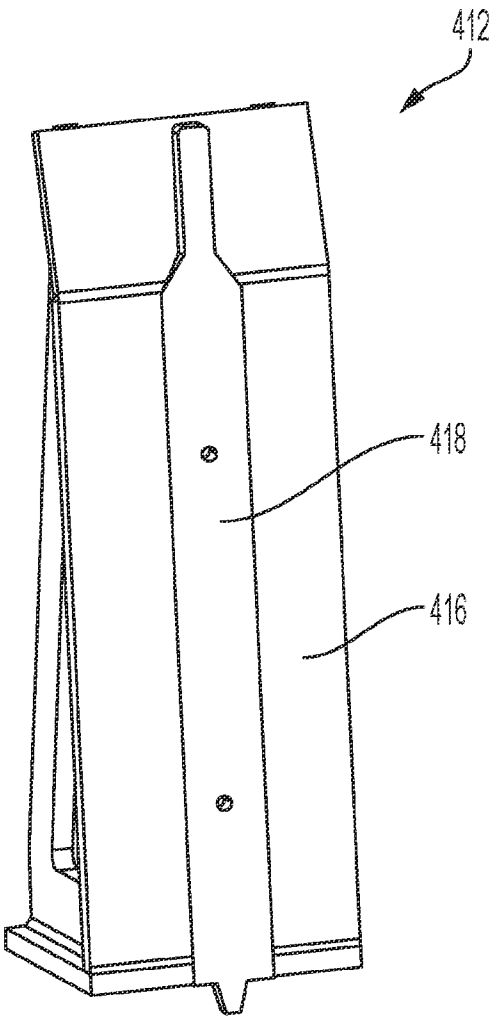
FIGS. 4A-4B show embodiments of type one and type two male pilots for use in module installation.
Figure 4A:
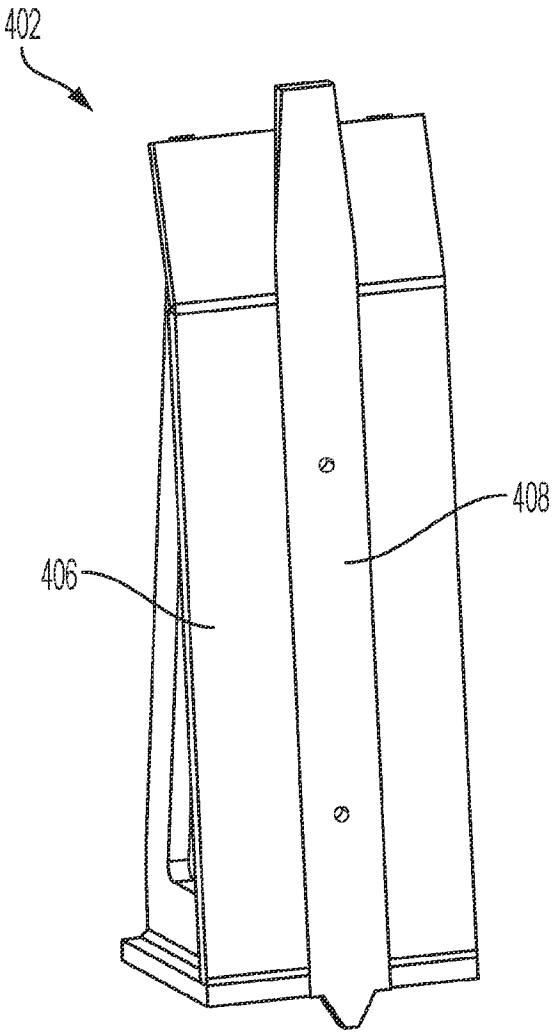

FIG. 4A and FIG. 4B illustrate two different types of male alignment guides mounted on a supporting structure. FIG. 4A shows a first pilot configuration 402 having a supporting structure 406 to which a male guide 408 of a first male guide type is affixed. In an embodiment, the male guide 408 is a generally dovetail type configuration with inward angled sides at a first angle, such as such as between 40 and 50 degrees or at substantially 45 degrees. FIG. 4B shows a second pilot configuration 412 having a supporting structure 418, which may the same or different from the supporting structure 408 and to which a male guide 418 of a second male guide type is affixed. In an embodiment, the male guide 418 is a generally dovetail type configuration with inward angled sides at a second angle, which is less than the first angle, such as such as between 25 and 35 degrees or substantially 30 degrees.

Figure 5C:
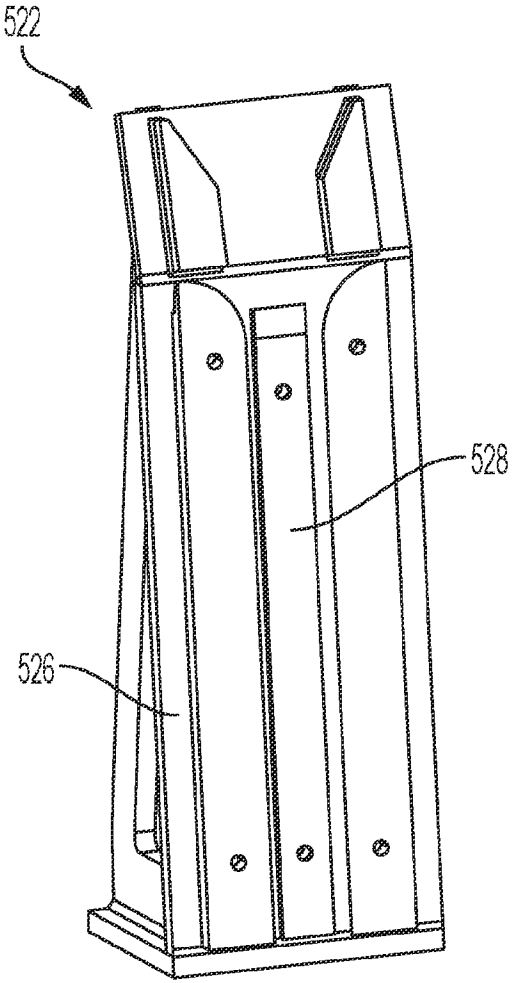
FIGS. 5A-5C show embodiments of type one and type two female pilots for use in module installation.
Figure 5B:
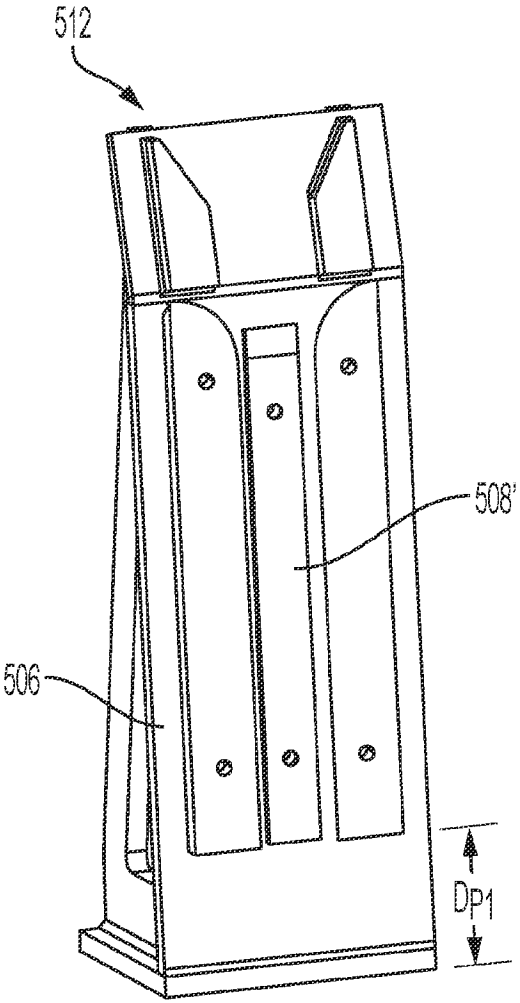
Figure 5A:
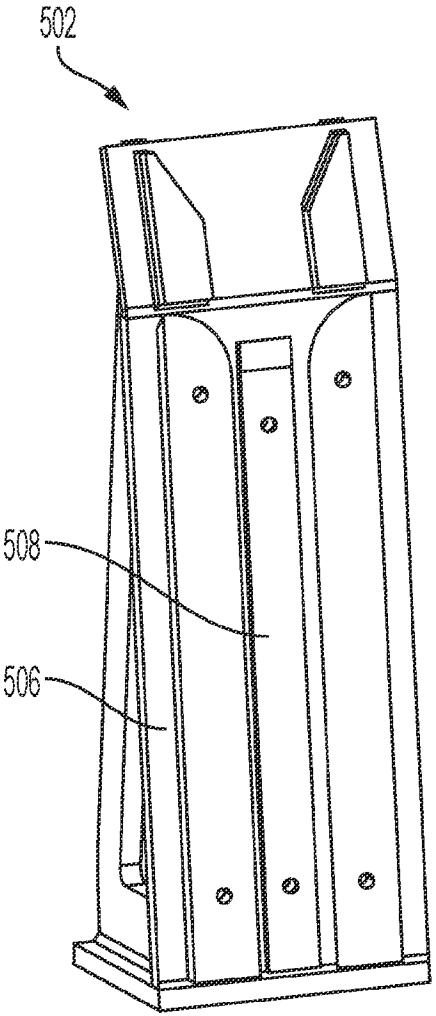

FIGS. 5A-5C illustrate three different types of female guides mounted on respective supporting structure that itself can be mounted to a substrate. FIG. 5A shows a first pilot configuration 502 having a supporting structure 506 to which a first type of female guide 508 is affixed. The first type of female guide is configured to receive the first type of male guide. In an embodiment guide 508 has a generally dovetail shaped channel configuration with inward angled sides and a channel width that is generally compatible with the male guide 408 on pilot 402 of FIG. 4A. In one embodiment the channel walls have the same first angle as that of male guide 408. FIG. 5B shows a second pilot configuration 512. Pilot 512 is the same as pilot 502 except that the female guide 508', which is a first type female guide, stops a predefined distance $D_{P1}$ from the bottom of the supporting structure 506.

FIG. 5C shows a third pilot configuration 522 having a supporting structure 526 to which a second type of female guide 528 is attached. The second type of female guide is configured to receive the second type of male guide. In an embodiment guide 528 has a generally dovetail shaped channel configuration with inward angled sides and a channel width that is generally compatible with the male guide 418 on pilot 402 of FIG. 4B. In one embodiment the channel walls have the same second angle as that of male guide 418. The supporting structure 526 can be the same as supporting structure 506 of FIG. 5A.

The first female and male guide types are configured so that when a first type male guide is engaged in a first type female guide, the male guide can engage and disengage along the guide axis but once engaged cannot be disengaged by lifting the guide from the channel of the female channel along the normal axis. The same feature is present for second female and male guide types.

Figure 6B:
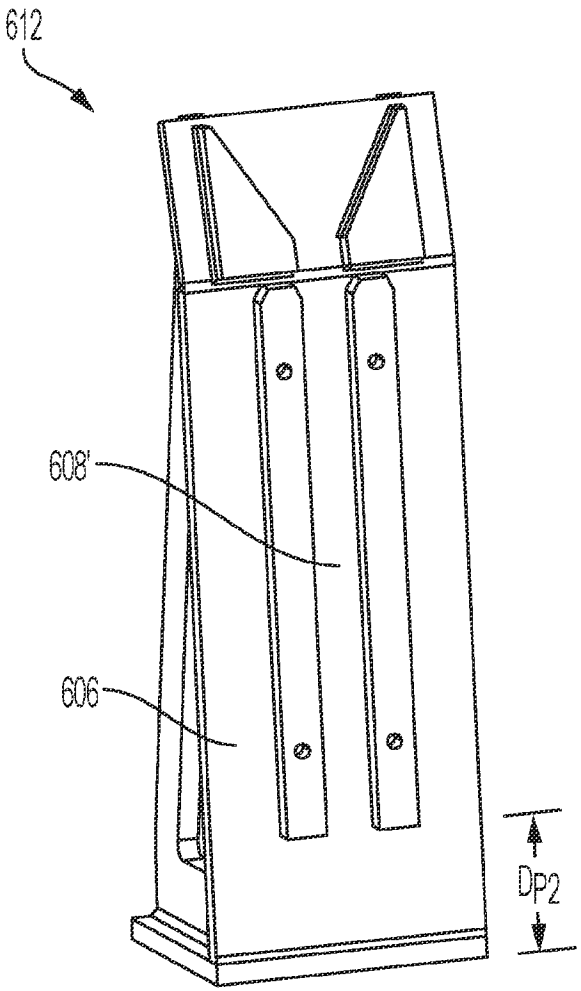
FIGS. 6A and 6B show embodiments of type one female pilots for use in module installation.
Figure 6A:
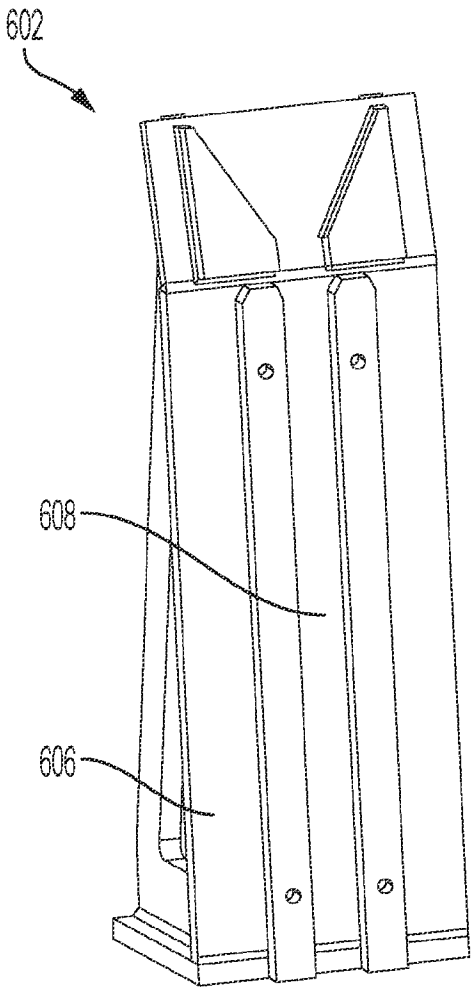

FIGS. 6A and 6B show two different types of rectangular female guides mounted on respective supporting structure that itself can be mounted to a substrate. FIG. 6A shows a pilot configuration 602 having a supporting structure 606 to which a third type of female guide 608 is affixed. In an embodiment, the third type of female guide has a generally rectangular channel. A third type of male guide has a rectangular cross-section configured to slot into the third type of female guide. A guide of this type is not used in the illustrated pilots and is discussed with respect to FIG. 12C and elsewhere below. FIG. 6B shows a second pilot configuration 612. Pilot 612 is the same as pilot 602 except that the female guide 608', which is a third type female guide, stops a first predefined distance $D_{P2}$ from the bottom of the supporting structure 506. In an embodiment, $D_{P1}$ is substantially the same as $D_{P2}$. The supporting structure 606 can be the same as supporting structure 506 of FIG. 5A.

FIGS. 7A-7D show pilot 402 of FIG. 4A in a perspective view, front view, side view, and top cross-section view respectively. The pilot supporting structure 406 has a substantially flat vertical front face 702 to which the male guide 408 is mounted. The male guide 408 can be attached using conventional techniques, such as by bolts, welding, or other means. Male guide 408 has an upper portion 704 which is tapered so that it can more easily engage a (type one) female guide. The taper angle and length can be selected in view of the maximum expected horizontal offset along between male guide 408 and a corresponding first type of female guide into which the male guide is to engage along the lateral axis (here an axis parallel to the front face 702). In one embodiment the taper angle is between 3 and 5 degrees or about 4 degrees. An upper face 706 is angled away from the major axis upper portion 704 of the male guide. The angle between upper face 706 and the major axis of male guide 408 can be selected in view of the maximum expected horizontal offset along the normal axis (here an axis normal to the front face 702) between male guide 408 and a corresponding first type of female guide into which the male guide is to engage. In one embodiment the angle is between 10 and 20 degrees or about 15 degrees.

Figure 7B:
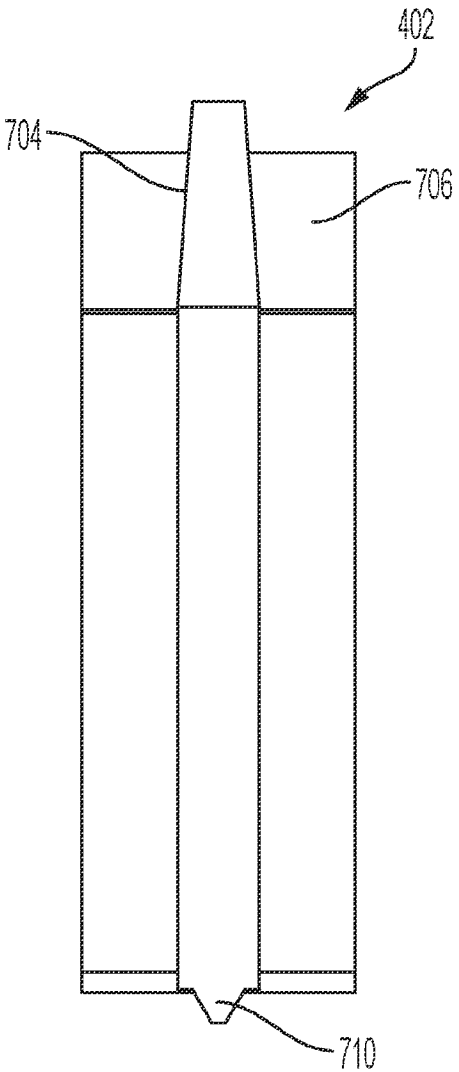
FIGS. 7A-7D are detail views of the male pilot of FIG. 4A.
Figure 7A:
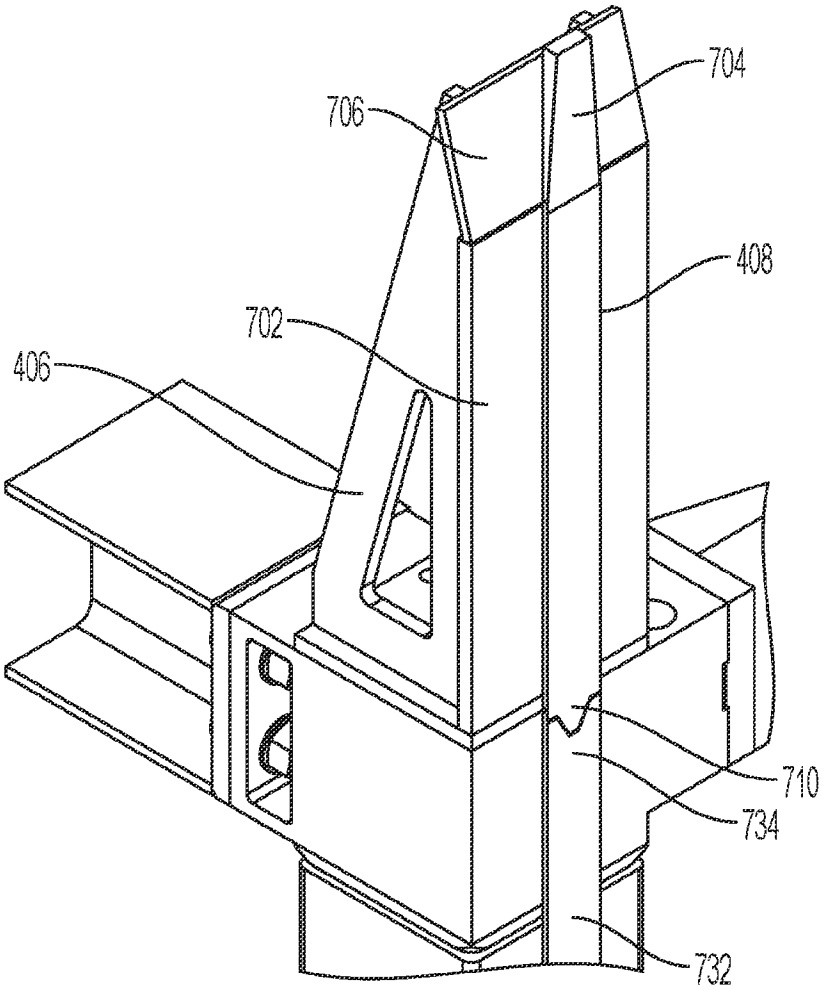

With specific reference to FIG. 7A, pilot 402 shown mounted to a substrate 730, which in this case is an upper corner of a building module. A first type male guide 732 is mounted on and extends to substantially the top of the building module. In an embodiment, an extension 710 at the bottom of male guide 408 on the pilot 402 extends slightly below the bottom of the support structure 406 and is configured to mate with a corresponding notch 734 formed at the top of male guide 732. The interaction of the extension 710 with the notch 732 helps align the male guides 408, 732 when the pilot is attached to the substrate.

Figure 7D:
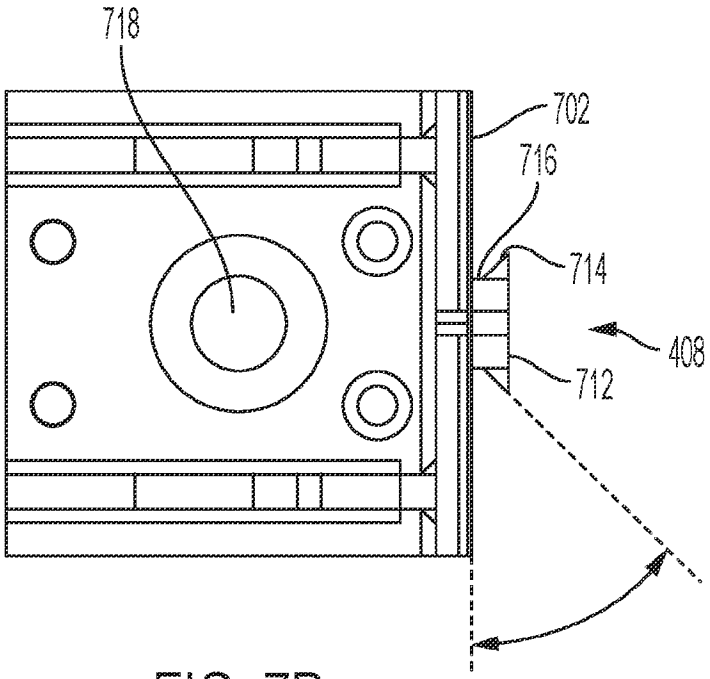
Figure 7C:
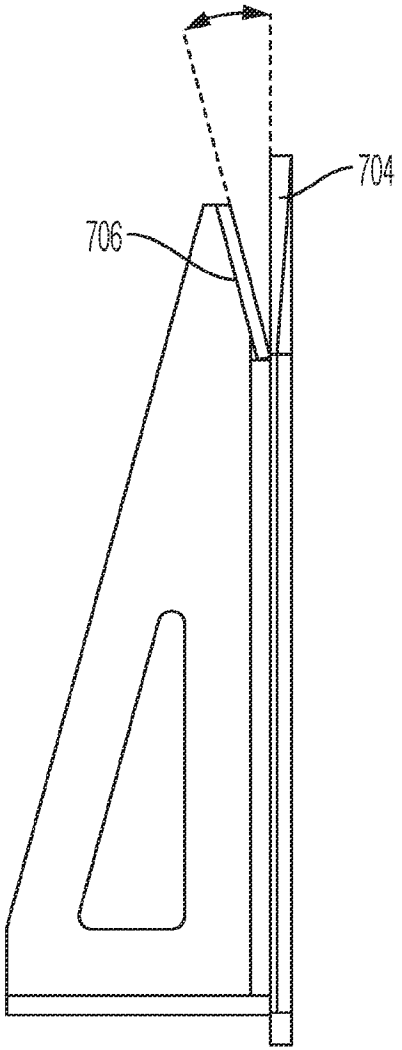

With specific reference to FIG. 7D, the cross-section structure of the first type of male guide is shown. In this embodiment the male guide 408 has a generally trapezoidal cross-section with an outer face 712 respective sides 714 angled inward at the first angle relative to the front face 702 of support structure 406 (which is also the same angle as measured with respect to the outer face 712 of the guide 408). An extension region 716 can be provided to offset the angled sides 714 of male guide 408 outwards from the front face 702. Various mounting holes 718 are also shown and which are used to when bolting the pilot to mounting structure on a substrate.

FIGS. 8A-8D show pilot 412 of FIG. 4B in a perspective view, front view, side view, and top cross-section view respectively. The pilot supporting structure 416 has a substantially flat vertical front face 802 to which the male guide 418 is mounted. Male guide 418 has an upper portion 804 which has a generally tapered shape so that it can more easily engage a (type two) female guide. The shape of the upper portion 804 be selected in view of the maximum expected horizontal offset along the lateral axis and a corresponding second type of female guide into which the male guide is to engage. In the illustrated embodiment, upper portion 804 has a different overall geometry than upper portion 704 on pilot 402 discussed above. An upper face 806 is angled away from the major axis of the male guide. The angle between upper face 706 and the major axis of male guide 408 can be selected in view of the maximum expected horizontal offset along the normal axis between male guide 408 and a corresponding second type of female guide into which the male guide is to engage. In one embodiment the angle is between 10 and 20 degrees or about 15 degrees. In a specific embodiment supporting structure 416 has the same design and dimensions as supporting structure 406 for pilot 402.

Figure 8B:
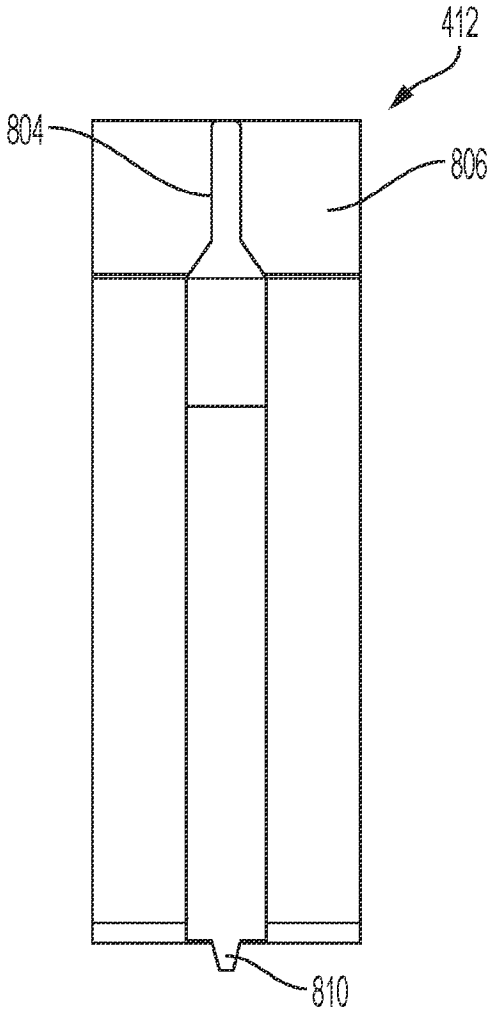
FIGS. 8A-8D are detail views of the male pilot of FIG. 4B.
Figure 8A:
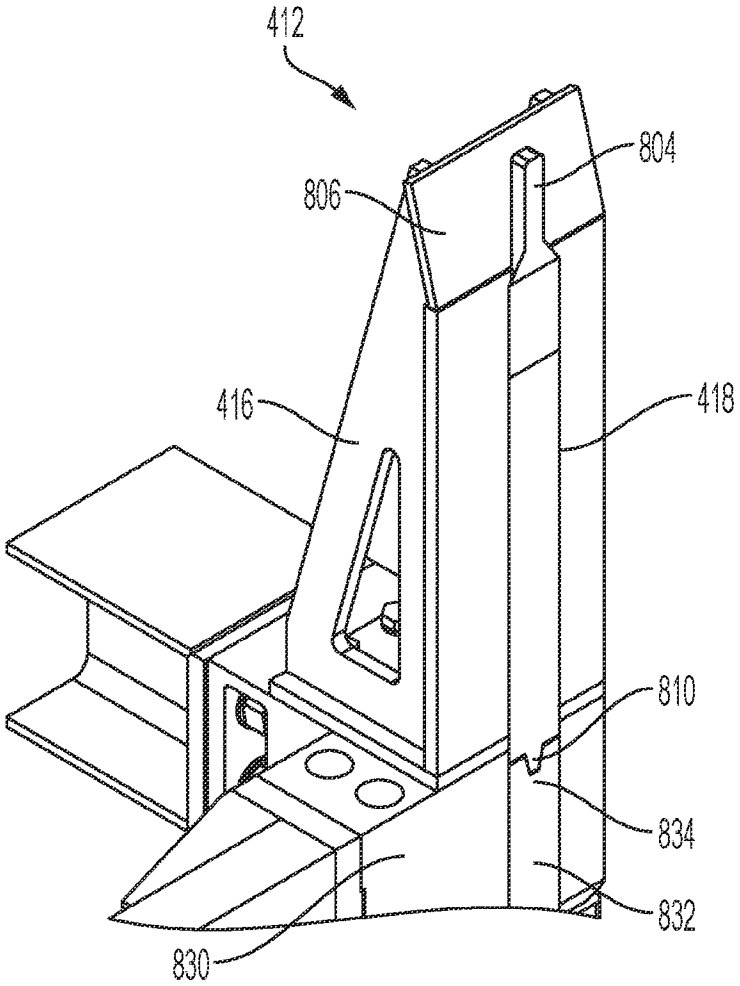

With specific reference to FIG. 8A, pilot 412 shown mounted to a substrate 830, which in this case is an upper corner of a building module. A second type male guide 832 is mounted on and extends to substantially the top of the building module. In an embodiment, an extension 810 at the bottom of male guide 418 on the pilot 412 extends slightly below the bottom of the support structure 416 and is configured to mate with a corresponding notch 834 formed at the top of male guide 832. The interaction of the extension 810 with the notch 832 helps align the male guides 418, 832 when the pilot is attached to the substrate.

In an embodiment, the configuration of extension 810 and notch 834 can be different from the configuration of extension 710 and notch 734. Providing different configurations for these mating components may reduce the likelihood an installation error providing a male guide type mismatch when the pilot is used as extension of another male guide, such as shown in FIGS. 7A and 8A. In a further embodiment, the configuration of extension 810 and notch 834 can be the same as configuration of extension 710 and notch 734. This can simplify manufacturing of the parts.

Figure 8D:
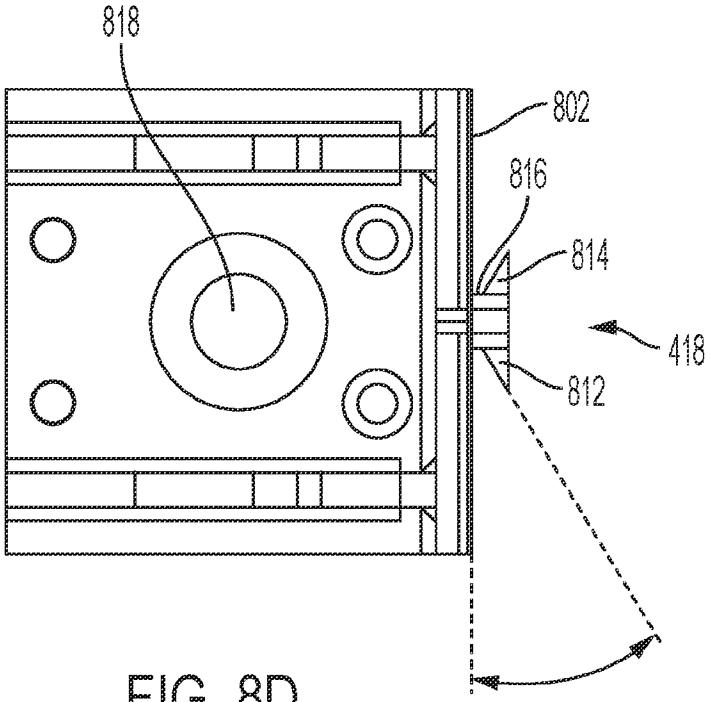
Figure 8C:
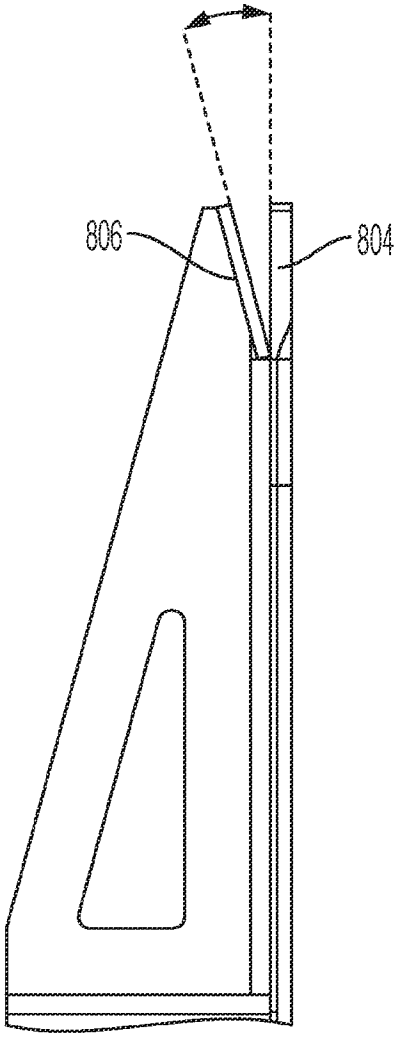
Figure 9B:
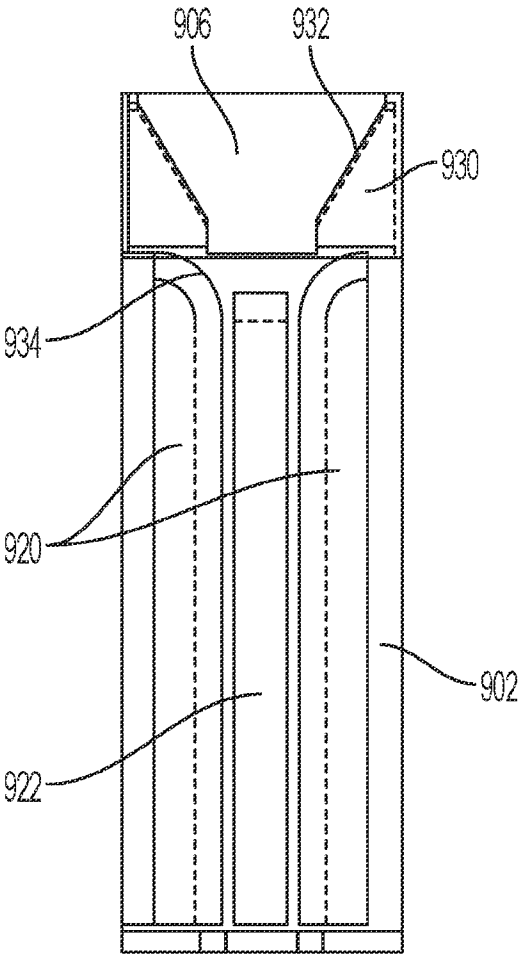
FIGS. 9A-9D are detail views of the female pilot of FIG. 5A.
Figure 9A:
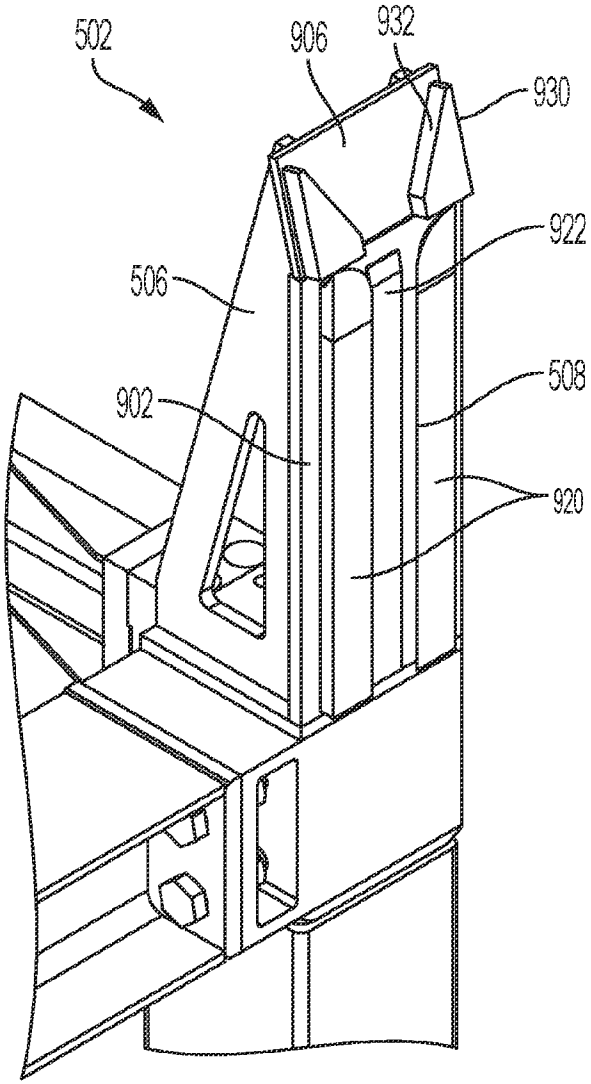
Figure 9D:
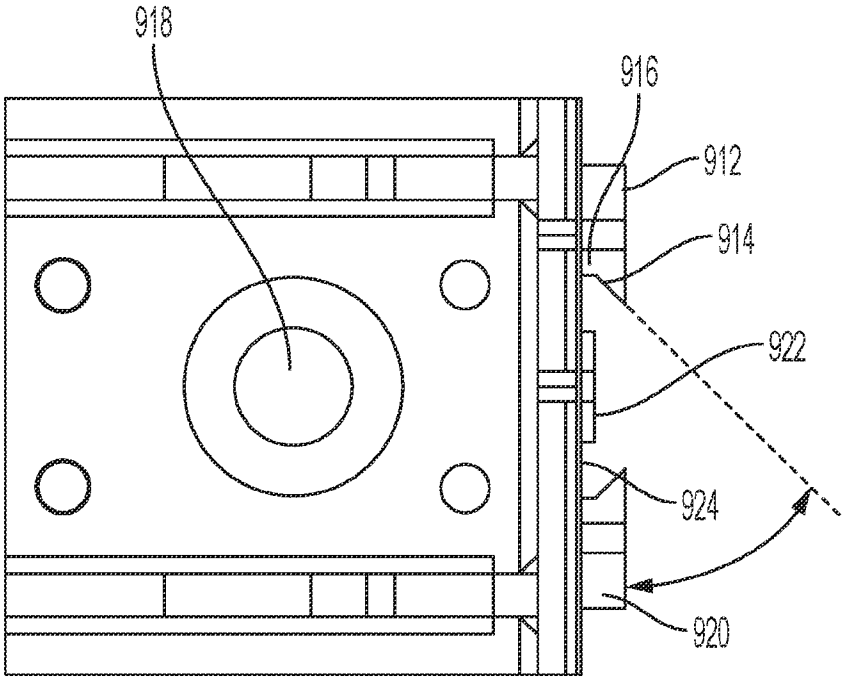
Figure 9C:
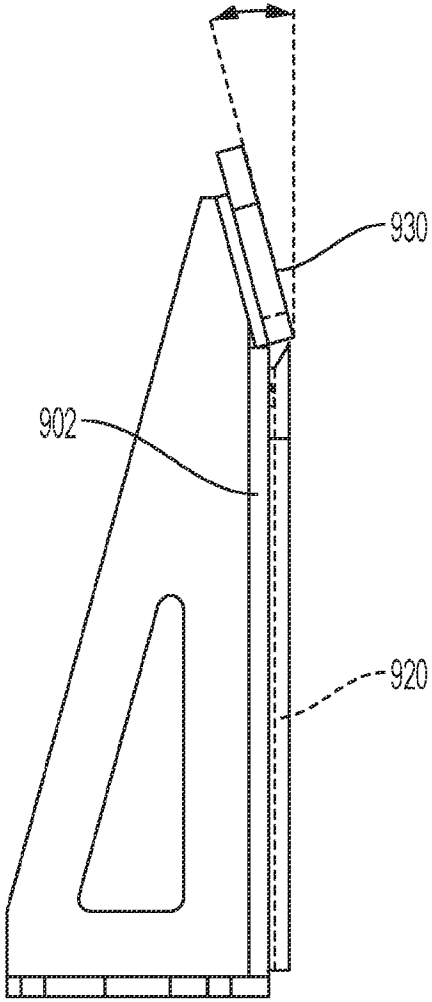
Figure 10B:
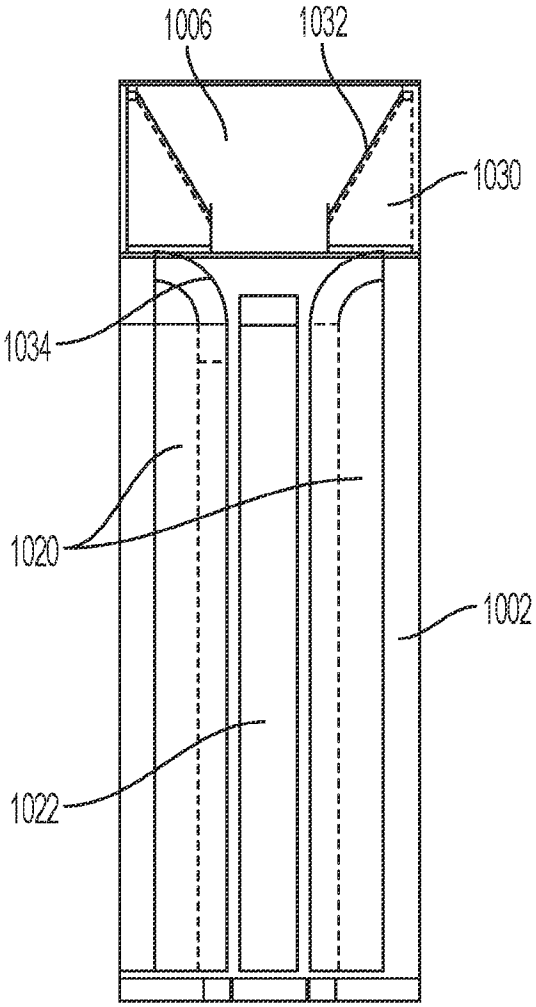
FIGS. 10A-10D are detail views of the female pilot of FIG. 5C.
Figure 10A:
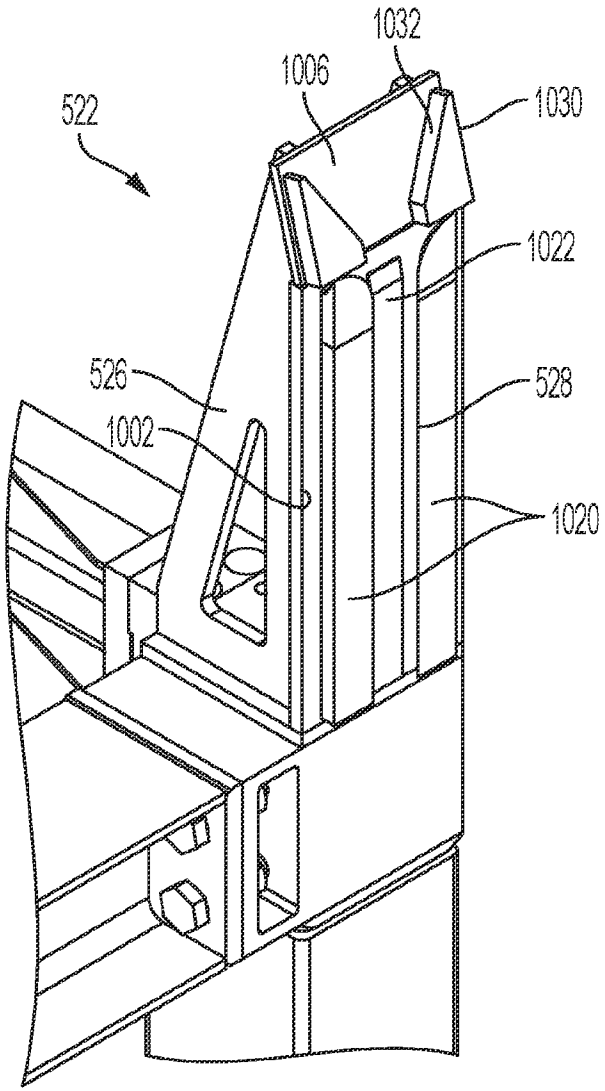
Figure 10D:
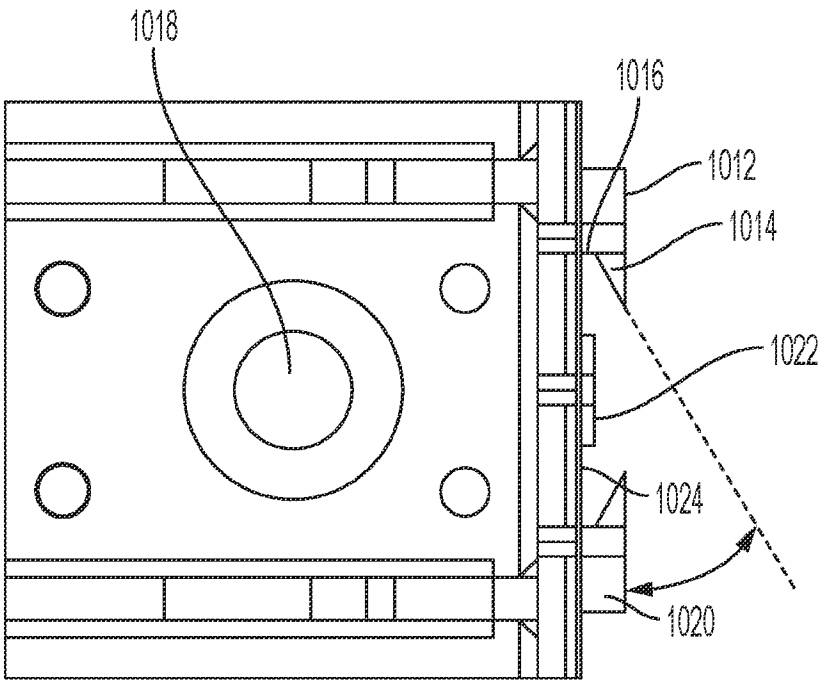
Figure 10C:
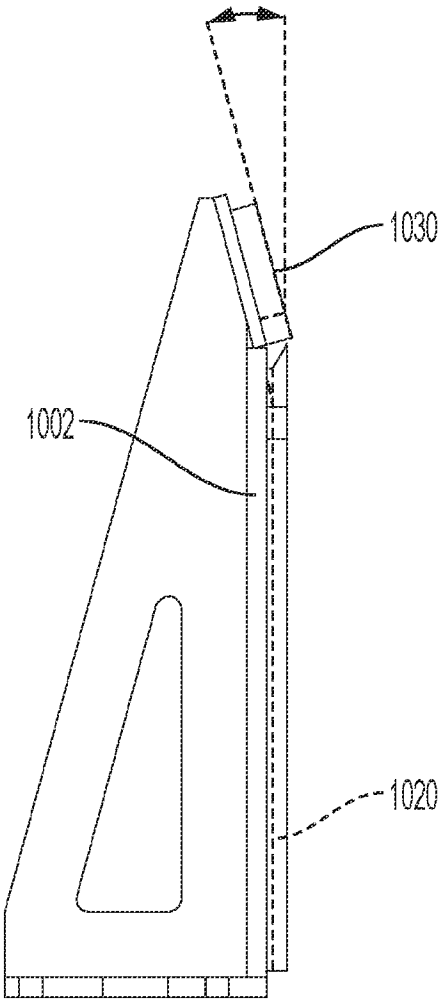

With specific reference to FIG. 8D, the structure of the second type of male guide is shown. In this embodiment the male guide 418 has a generally trapezoidal cross-section with an outer face 812 and respective sides 814 angled inward at the second angle relative to the front face 802 of support structure 406 (which is also the same angle as measured with respect to the outer face 812 of the guide 418). An extension region 816 can be provided to offset the angled sides 814 of male guide 418 outwards from the front face 802. Various mounting holes 818 can be used when mounting the pilot to mounting structure on a substrate.

FIGS. 9A-9D show pilot 502 of FIG. 5A in a perspective view, front view, side view, and top cross-section view respectively. The pilot supporting structure 506 has a substantially flat vertical front face 902 on which the female guide 508 (of the first female guide type) is formed. In the illustrated embodiment, the female guide is formed of two separate elongated members 920 which are installed parallel to each other and have a mirrored configuration. Elongated members 920 can be attached by known techniques, such as by bolts, welding, or other means. Elongated members 920 define a channel opening outwards away from the front face 902. Opposed sides 914 of the elongated members are angled inwards to give the channel of the female guide a generally trapezoidal dove tail cross-section (See FIG. 9D). An extension region 916 can be provided on each elongated member 920 to offset the angled sides 914 outwards from the front face 902 a small amount. In an embodiment, angled sides 914 are angled inward at the first angle relative to the front face 902 (which is also the same angle as measured with respect to the outer face 912 of the elongated members 920).

An elongated pad 922 can be placed on the bottom of the channel 924 to adjust the depth of the female channel thereby the range of motion of a male guide relative to the female guide inward along the normal axis into the channel. The thickness of the pad can be varied. In one embodiment, the pad thickness substantially corresponds to the height of the extension region over the front face 902.

The supporting structure 506 has an upper face 906 that is angled away from the major axis of the channel. The angle and length of upper face 906 can be selected in view of the maximum expected horizontal offset along the normal axis between the female guide 508 and a corresponding male guide with which it is to engage. In one embodiment the angle is between 10 and 20 degrees or about 15 degrees.

A pair of opposed pads 930 are positioned on the upper face and have angled inner sides 932 configured to create a funnel that can direct an engaging male guide into the channel of the female guide. The geometry and placement of the pads 930 can be selected in view of the maximum expected horizontal offset between the female guide and a male guide along the lateral axis when the male guide is to be moved into and engage the channel of the female guide. In one embodiment the taper angle of the pads forms a funnel with an angle of between about 50 and about 70 degrees or about 60 degrees. The width of the funnel neck can be selected to ensure that the male guide will be funneled into the top of the female guide channel. In an embodiment the neck of the funnel formed by the pads has a width that is at least the maximum width of the male guide within the range of design tolerances. Upper portions 934 of the elongated members 920 can also be curved to create a funnel at the mouth of the channel as illustrated to provide for a smooth transition of the male guide between the funnel of the pads 930 and the channel of the female guide. Various mounting holes 918 (FIG. 9D) are also shown and which are used to when mounting the pilot to a substrate.

FIGS. 10A-10D show pilot 522 of FIG. 5C in a perspective view, front view, side view, and top cross-section view respectively. The pilot supporting structure 526 can be the same as 502. It has a substantially flat vertical front face 1002 on which the female guide 528 (of the second female guide type) is formed. The female guide 528 can be formed in a manner analogous to female guide 508, discussed above, such as by using separate elongated members 1020 to define a channel 1024 opening outwards away from the front face 1002 of the supporting structure 526. Opposed sides 1014 of the elongated members are angled inwards to give the channel of the female guide a generally trapezoidal dove tail cross-section and where the angled sides 914 are angled inward at the second angle relative to the front face 1002/outer face 1012. An extension region 1016 can be provided on each elongated member 1020 to offset the angled sides 1014 outwards from the front face 1002 a small amount. An elongated pad 1022 can be placed on the bottom of the channel 1024 to adjust the depth of the female channel thereby the range of inward motion inward of a male guide relative to the female guide along the normal axis. The thickness of the pad can be varied. In one embodiment, the pad thickness substantially corresponds to the height of the extension region over the front face 1002.

The supporting structure 526 has an upper face 1006 that is angled away from the guide axis of the channel. The angle and length of upper face 1006 can be selected in view of the maximum expected horizontal offset along the normal axis between the female guide 528 and a corresponding male guide with which it is to engage. In one embodiment the angle is between 10 and 20 degrees or about 15 degrees.

A pair of opposed pads 1030 are positioned on the upper face and have angled inner sides 1032 configured to create a funnel that can direct an engaging male guide into the channel of the female guide. The geometry and placement of the pads 1030 can be selected in view of the maximum expected offset along the lateral axis between the female guide and a male guide when the male guide is to be moved into and engage the channel of the female guide. In one embodiment the taper angle of the pads forms a funnel with an angle of between 50 and 70 degrees or about 60 degrees. In an embodiment the neck of the funnel formed by the pads can have a width between the minimum width of the outward facing opening of the channel and the maximum width along the base of the channel. Upper portions 1034 of the elongated members 1020 can also be curved to create a funnel at the mouth of the channel as illustrated to provide for a smooth transition of the male guide between the funnel of the pads 1030 and the channel of the female guide. Various mounting holes 1018 (FIG. 9D) are also shown and which are used to when bolting the pilot to a substrate.

Figure 11B:
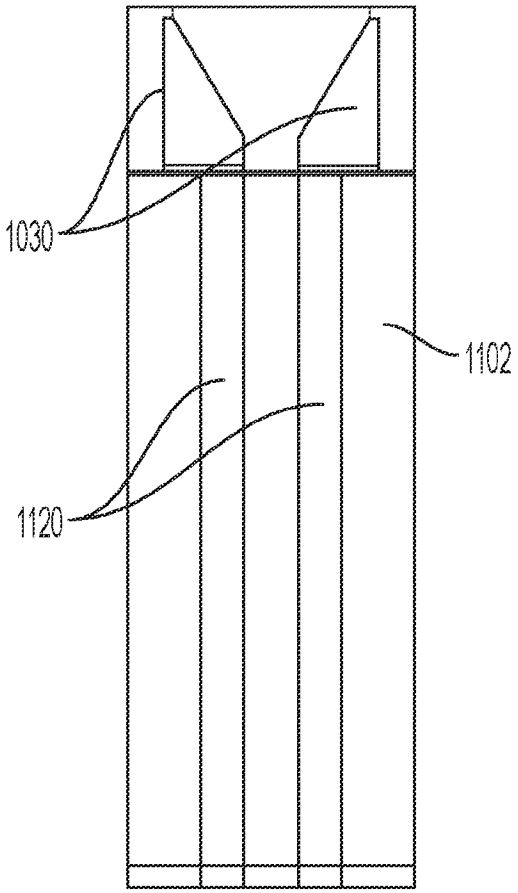
FIGS. 11A-11D are detailed views of the female pilot of FIG. 6A.
Figure 11A:
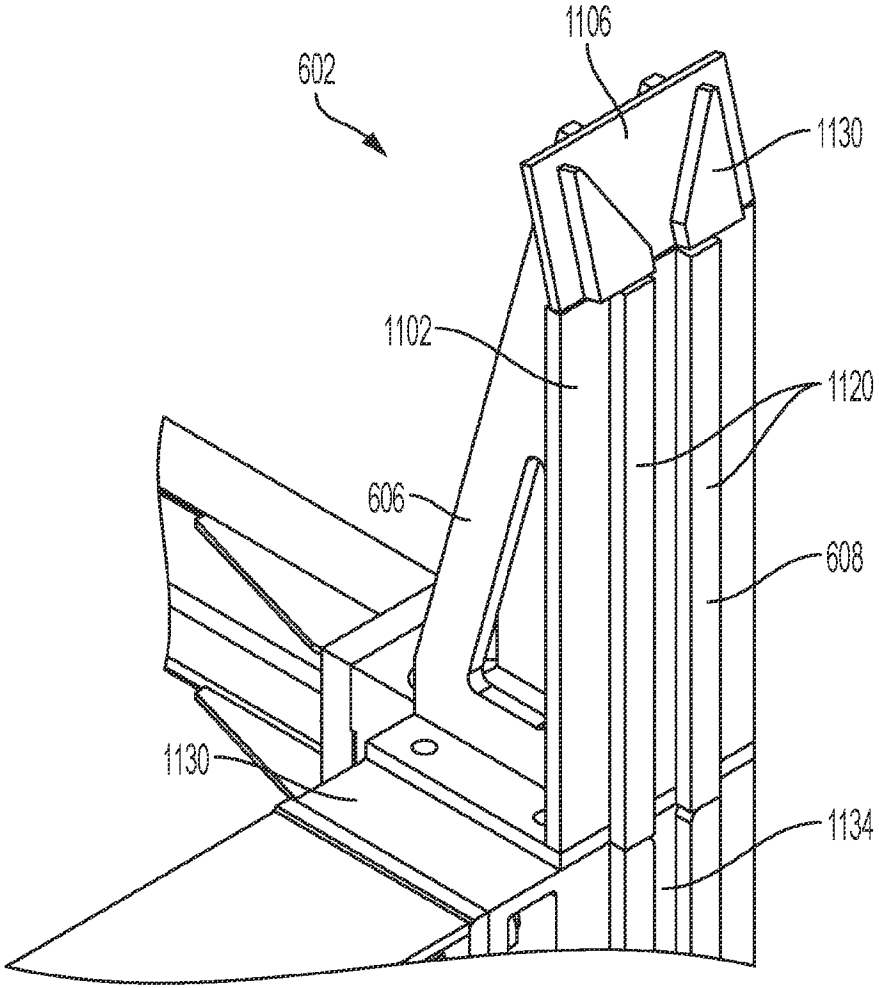
Figure 11D:
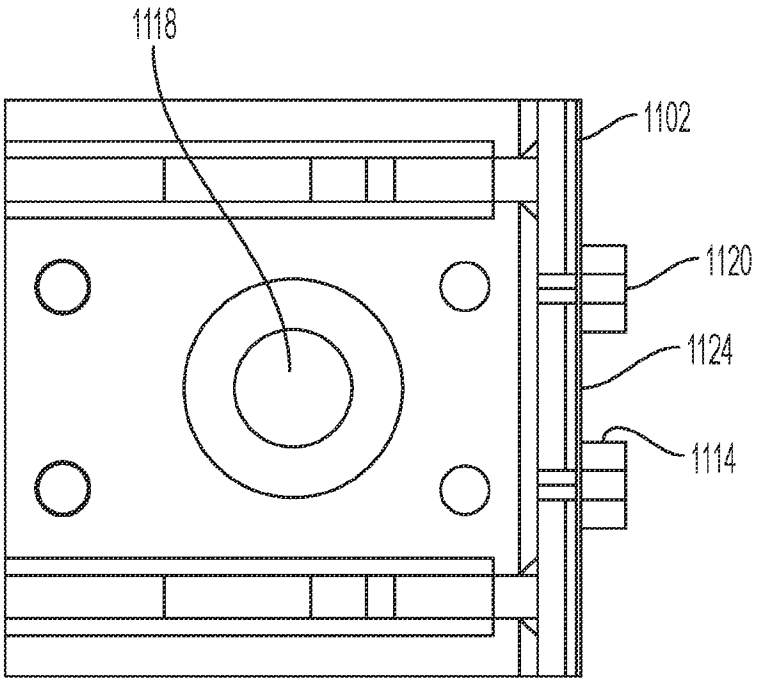
Figure 11C:
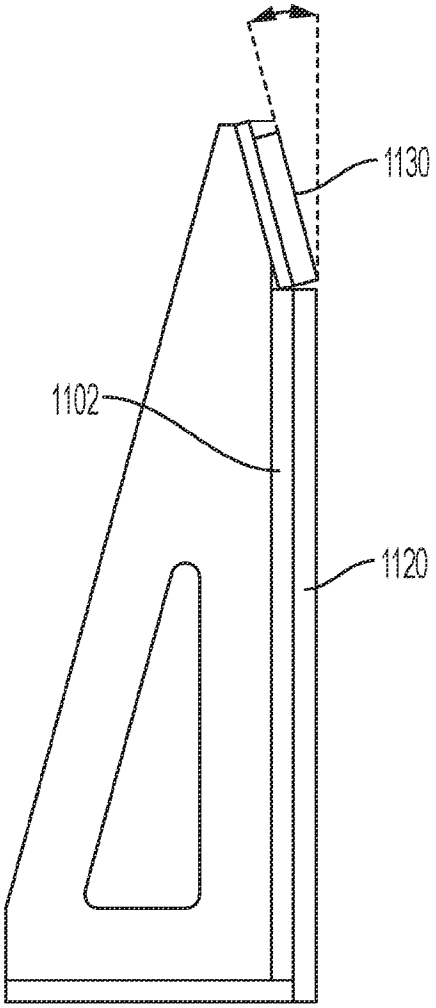

FIGS. 11A-11D show pilot 602 of FIG. 6A in a perspective view, front view, side view, and top cross-section view respectively. The pilot supporting structure 606 can be the same as pilot supporting structure with corresponding front face 1102, angled upper face 1106 and pads 1130. Unlike the female guides of pilots 502 and 622, the female guide 608 of pilot 602 has a rectangular cross section. The female guide (of the third type) can be formed in this embodiment by elongated members 1120 which are spaced apart to form a channel 1024 opening outwards away from the front face 1102 and where the opposed sides 1114 of the elongated members 1120 are substantially perpendicular to the front face 1102. FIG. 11A shows pilot 602 mounted on a substrate 1130 and forming an extension of a type three female guide 1134. Opposed pads 1130 are positioned on the upper face 1102 and have angled inner sides 1132 forming a funnel that can direct an engaging male guide into the channel of the female guide as discussed above. Various mounting holes 1018 (FIG. 9D) are also shown and which are used to when mounting the pilot to a substrate.

Figure 12B:
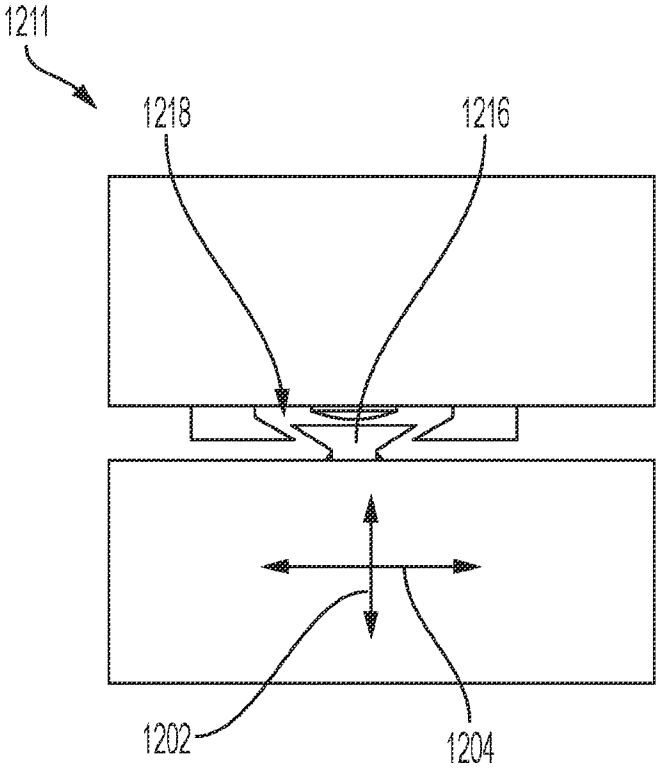
FIGS. 12A-12D illustrate engagement of various type male guides with corresponding type female guides and the motion constraints provided during engagement.
Figure 12A:
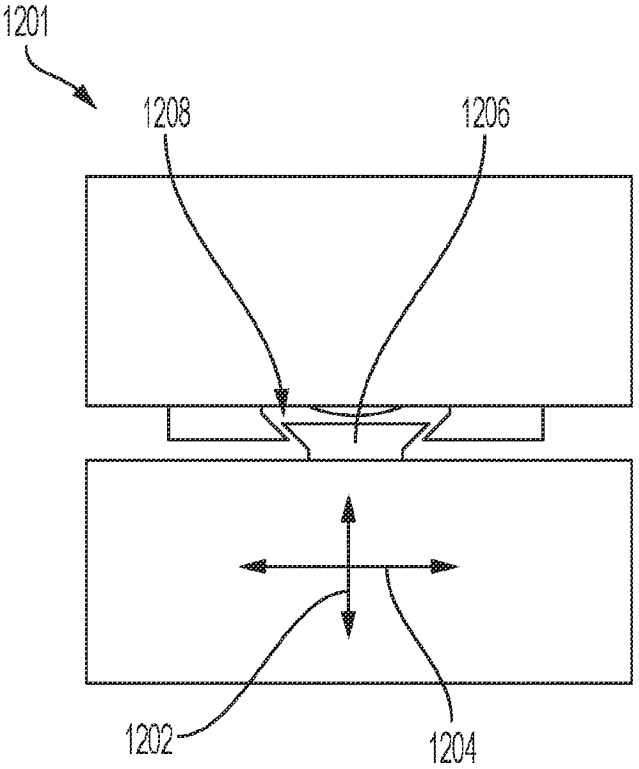

FIG. 12A is a schematic cross-sectional view 1201 showing a first type male guide 1206 engaged within a first type female guide 1208. The geometry of the first type male guide 1206 and female guide 1208 is selected to constrain the motion of the male guide 1206 relative to the female guide 1208 along the normal axis 1202 within a predefined first normal range and to constrain the motion along the lateral axis 1204 within a predefined first lateral range. The predefined first normal and lateral ranges can correspond to the maximum acceptable offset along either axis from the nominal design position of the components when manufacturing and placement tolerances are considered. Ranges can be defined based on the requirement of capturing the module's expected tolerance build-up along front and rear columns and the allowable position variance of the new module the new module relative to an installed module in an area of critical alignment, an example of which is a façade interlock point that may require tight alignment such as within a 10 mm range from nominal. In an embodiment, the first normal and first lateral ranges are each relatively small, such as on the order of a few millimeters, such as between a total of 3 mm and 5 mm or about 4 mm in each direction from the nominal desired position of the parts.

FIG. 12*b* is a schematic cross-sectional view 1211 showing a second type male guide 1216 engaged within a second type female guide 1218. The geometry of the first type male guide 1216 and female guide 1218 is selected to constrain the motion of the male guide 1216 relative to the female guide 1218 along the normal axis 1202 within a predefined second normal range and to constrain the motion along the lateral axis 1204 within a predefined second lateral range. At least one of the predefined second normal range and second lateral range is greater than the predefined first normal and first lateral ranges. The differences between the first and second normal ranges and/or first and second lateral ranges allows a module to be guided simultaneously by a first alignment structure as in 1201 in which horizontal motion is comparatively tightly constrained and a second alignment structure as in 1211 and where a greater range of horizontal motion is permitted by alignment structure 1201. This compensates for positional mismatches in the alignment structures and their relative placement to each other that are within the range of expected manufacturing tolerances. In an embodiment, the second normal range can be substantially to equal the first normal range while the second lateral range is substantially greater than the first normal range. For example, the second normal range can be order of a few millimeters, such as between a total of 3 mm and 5 mm or about 4 mm in each direction from the nominal desired position along the normal axis while the second lateral range can be on the order of a total of between about 8 mm and 12 mm or about 10 mm from the nominal desired position of the parts in each direction on the lateral axis.

Figure 12D:
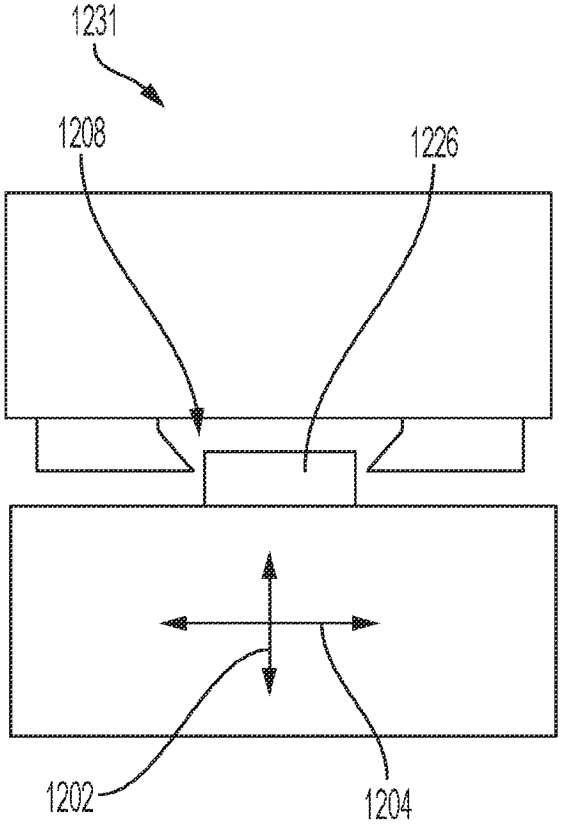
Figure 12C:
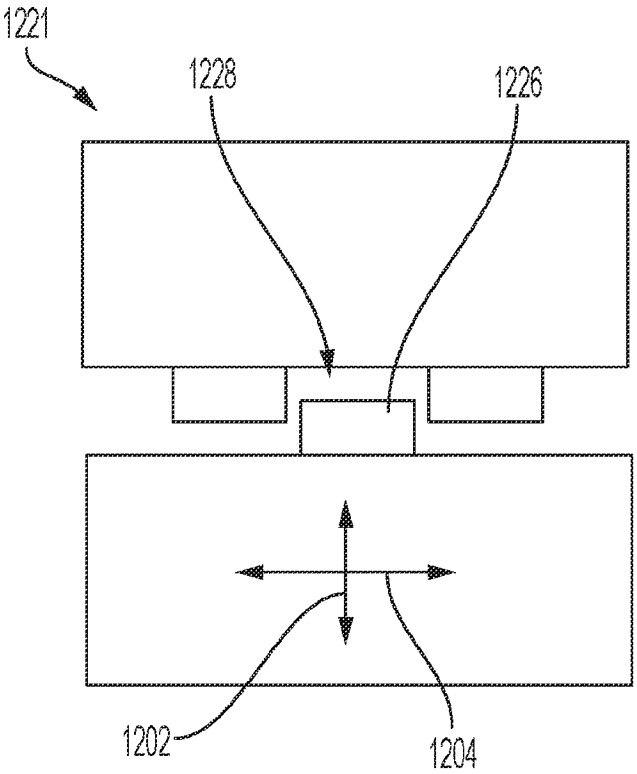

FIG. 12C is a schematic cross-sectional view 1221 showing a third type male guide 1226 engaged within a third type female guide 1218. Because the third type of male and female guides are rectangular, inward motion of the male guide is constrained but outward motion of the male guide is not constrained. The geometry of the third type male guide 1226 and female guide 1228 (e.g., height of the male guide, depth of the female channel) can be selected to allow a range of motion of along the normal axis from the nominal desired position of the male guide in the female channel inward along normal axis and outward along the normal axis over a range in which the male guide is still within the female channel and so constrained laterally. The third normal range can be, for example the same as the second lateral range, such as on the order of a total of between about 8 mm and 12 mm or about 10 mm in each direction along the normal axis. The geometry of the third type male guide 1226 and female guide 1228 is selected to constrain the motion of the male guide 1216 relative to the female guide 1218 along the lateral axis 1204 within a predefined third lateral range. The third lateral range can be substantially to equal the first lateral range. For example, the third lateral range can be order of a few millimeters, such as between a total of 3 mm and 5 mm or about 4 mm in each lateral direction from a nominal position.

FIG. 12D is a schematic cross-sectional view 1231 showing the third type male guide 1226 engaged within a first type female guide 1218. Because the male guide is rectangular, the angled walls of the female guide do not provide a constraint on motion and the male guide is constrained in the same way as in FIG. 12D. In an embodiment, the lateral and normal range of constraint of the male guide 1226 of FIG. 12D is the same as the constraints provided in the arrangement of FIG. 12C.

The illustrated embodiments for male and female guides have dovetail and rectangular cross-sections. Advantageously, male dovetail extensions and female dovetail channels are easy to fabricate and affix to a structure. In different embodiments, other alternative structures for male guides and compatible female channels can be used as long as they can be configured to provide the desired ranges of constraints along the normal and lateral axes. For example, instead of a dovetail configuration, male guides with a T configuration can be used and interact with female guides having a compatible T channel.

FIGS. 13A-13I illustrate the configuration and placement of a first row start module 202 on the substrate according to aspects of the guidance system disclosed herein.

A building module, such as the first row start module 202, is comprised of a framework 1300 defining a top 1302 and a bottom 1304 of the building module. First front support 1308 and second front support 1310 define a front side 1312 of the building module. A first rear support 1314 and second rear support 1316 define a rear side 1318 of the building module. The first front supports 1308 and the first rear supports 1314 define a first side 1320 the module and the second front support 1310 and the second rear support 1316 define a second side of the module 1322. Each of the first supports and the second supports 1308, 1310, 1314, 1316 have a respective top and a bottom end. The module has a module height $H_M$. In the illustrated arrangement, and with reference to FIG. 2A, the front side 1312 and second side 1322 are outward facing sides that will be visible from the exterior of the modular building and to which façade panels may be pre-attached. The first side 1320 and rear side 1318 are interior sides.

Figure 13A:
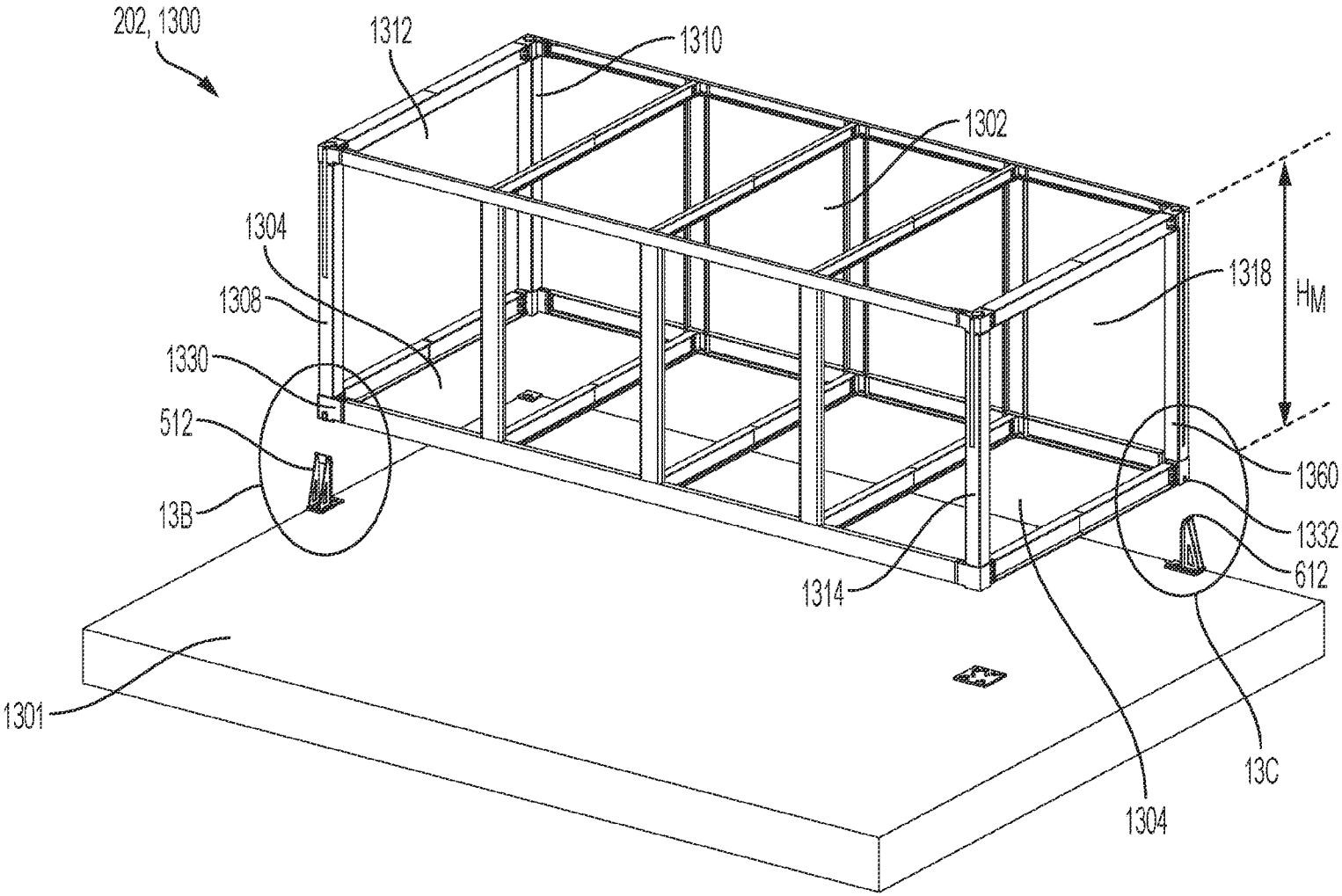
FIGS. 13A-13I show an embodiment of alignment structures on a first row start module and use of those structures in module installation.
Figure 13C:
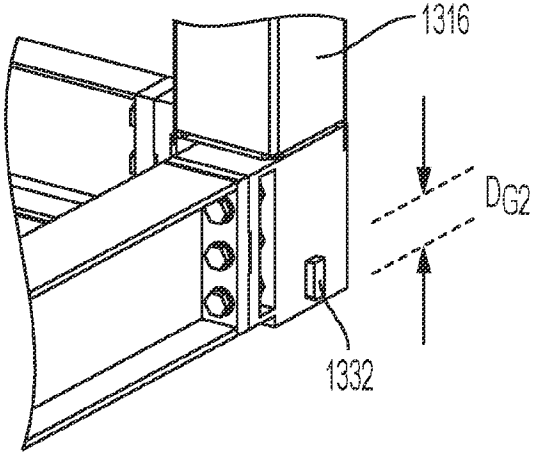
Figure 13C:
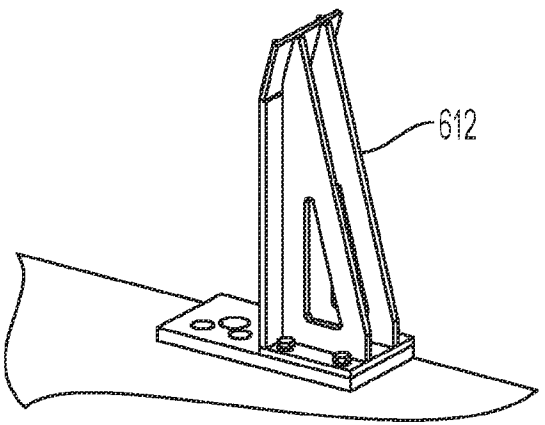
Figure 13B:
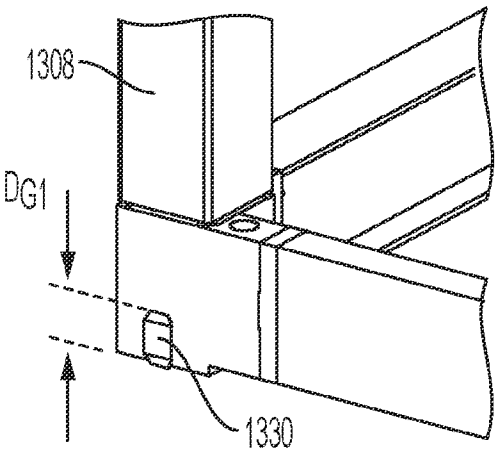
Figure 13B:
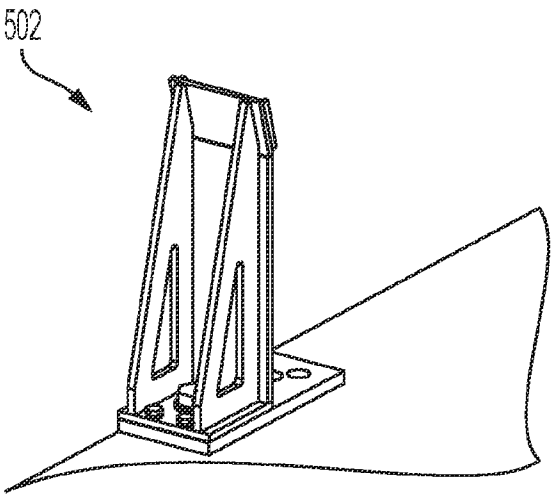

A first type female pilot 512 (FIG. 5B) is mounted to the substrate 1301 and is positioned to interact with a first type male guide block 1330 extending from the bottom of the first front support 1308 on the first side 1320. A third type female pilot 612 (FIG. 6B) is mounted to the substrate and positioned to interact with a third type male guide block 1332 extending from the bottom of the second rear support 1316 on the rear side 1318. These structures are shown in FIGS. 13B and 13C which are detail views of areas 13B and 13C of FIG. 13A. With reference to FIGS. 13B and 13C, male guide block 1330 extends upward along the first front support to a height of $D_{G1}$ above the base of the building module. Male guide block 1332 extends upward along the second rear support to a height $D_{G2}$ above the base of the module.

Also shown is a type three female guide 1360 which extends upward on the second rear support on the back side of the module. Guide 1360 will be discussed in more detail below in connection with the installation of the second row end module and FIGS. 18A-C and 19A-C.

Figure 13D:
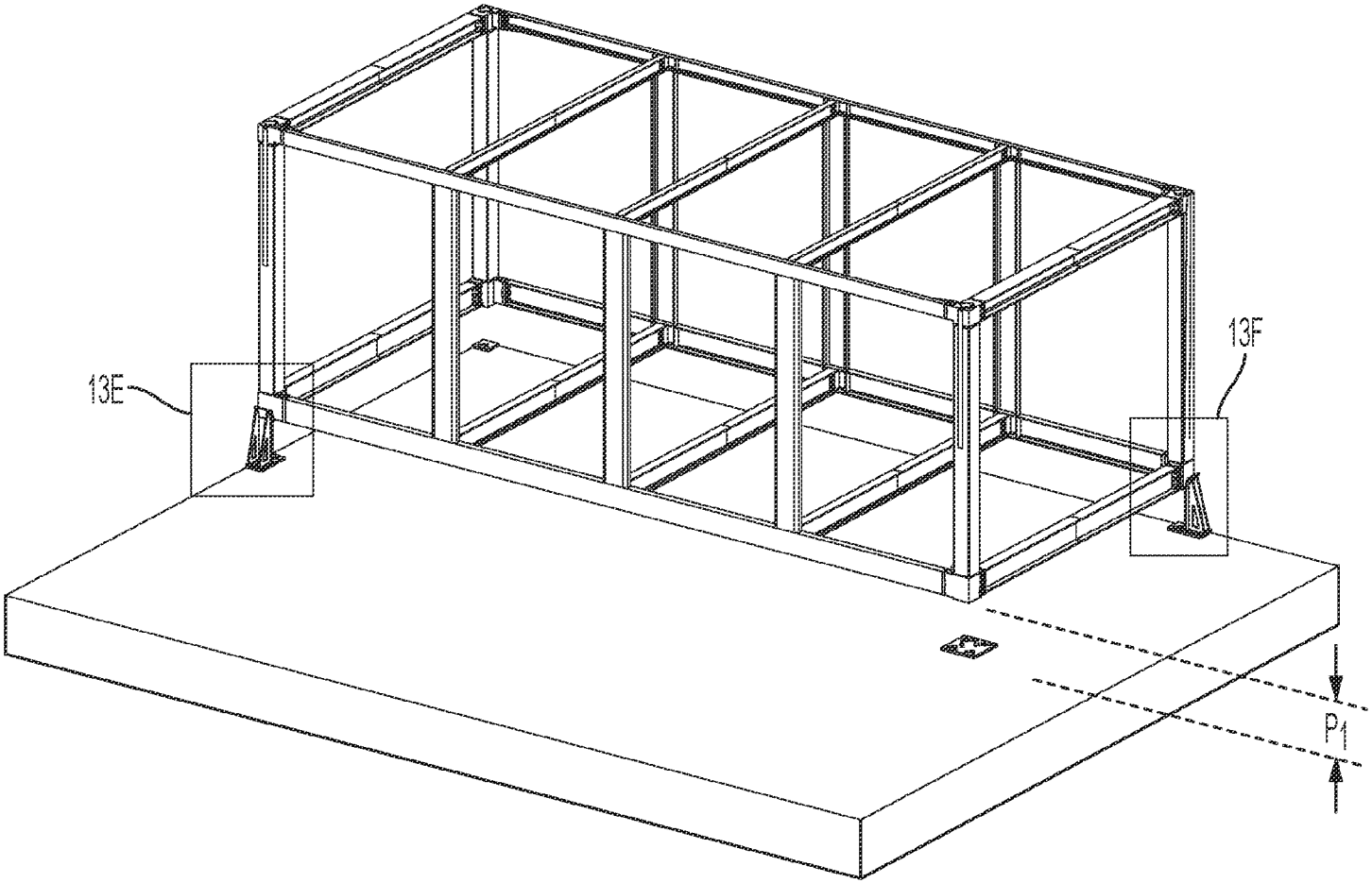
Figure 13F:
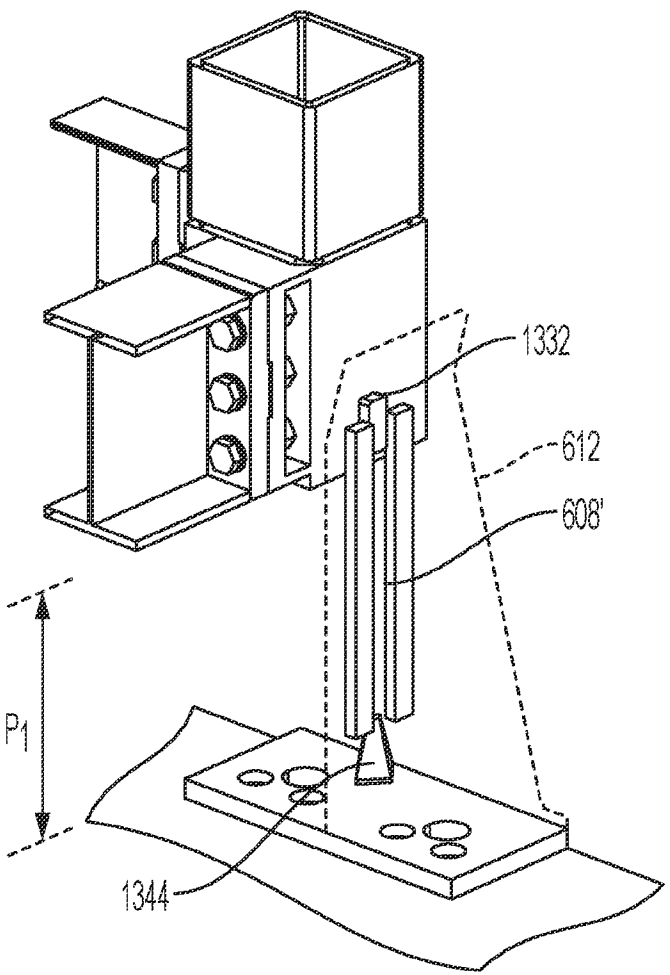
Figure 13E:
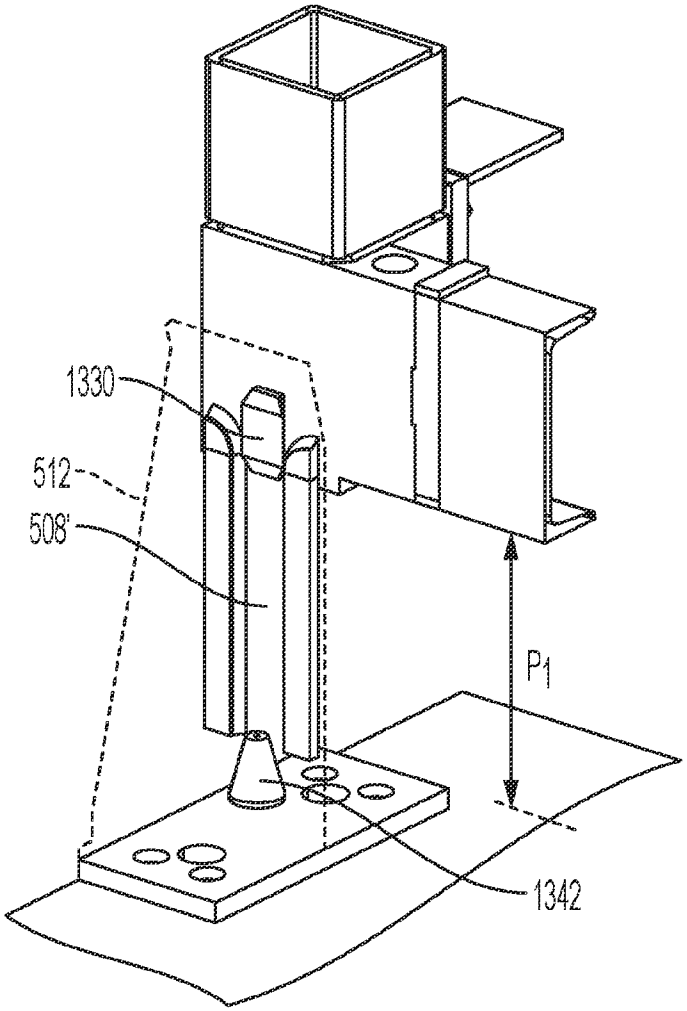

FIG. 13D illustrates the first row start module 202, 1300 when it has been lowered so the base of the module is in a first position at a distance P1 over the substrate. At this position, the male guide block 1330 starts to engage the female channel 508' in the guide block 512 and male guide block 1332 starts to engage the female channel 608' in the guide block 612. FIGS. 13E and 13F are detailed views of areas 13E and 13F of FIG. 13D, respectively. Distance P1 is a minimum distance, such as about 400-500 mm or 450 mm above the substrate at which the pilots function to capture the male guide blocks. The specific distance P1 is dependent on the overall height of the pilots and the position of the male guide blocks on the vertical supports. The interaction of the male guide block 1330, 1332 with the female channels 508', 608' constrains the motion of module to align the respective sides with a high degree of accuracy. Also shown in FIGS. 13E and 13F are upward extending alignment pins 1342 and 1344 which have been mounted on the substrate in the locations where the corresponding alignment holes of the modules should rest when the module has been fully lowered into position on the substrate. An alignment pin can be provided on a substrate by bolting or otherwise affixing a plate with the alignment pin thereon to the substrate. A pilot can then be subsequently affixed on top of that plate in a position adjacent to the alignment pin so that the pilot and alignment pin are properly registered with each other as shown, e.g., in FIG. 13E.

Figure 13G:
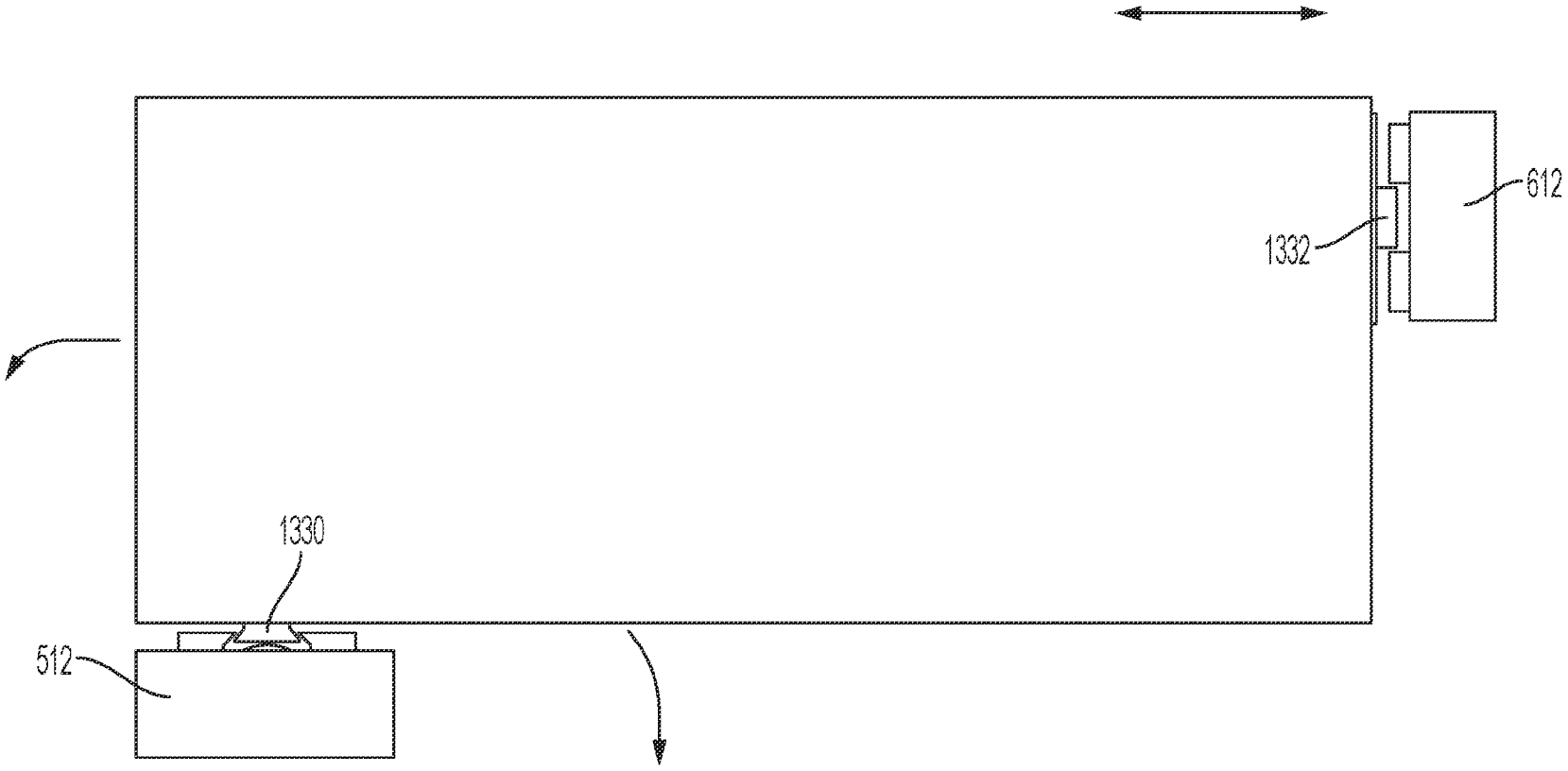

FIG. 13G is schematic representation of the module of FIG. 13D showing the engagement of the male guide blocks 1330, 1332 with the female pilots 512, 612. The relative interaction of the first type male guide block 1330 with the first type female guide of pilot 512 constrains the motion of that corner of the module in both the normal and lateral axes. Although horizontal translation motion along these axes is constrained, there could still be some degree of pivoting of the module with the engaged pilot 512/male guide 1330 acting as a hinge point. The square sided slot in the female guide 608' in pilot 612 restricts the movement of that engaged male guide in a lateral axis and so operates to constrain rotation of the module about the pivot point at the other pilot 512. However, the interaction of the type three male guide 1332 in the type three female guide 608' of pilot 612 constrains motion along the normal axis far less. If motion along the normal axis were highly constrained, a tolerance mismatch of the constraints provided by the two pilots could cause binding and prevent the module from sliding into its final position.

Figure 13I:
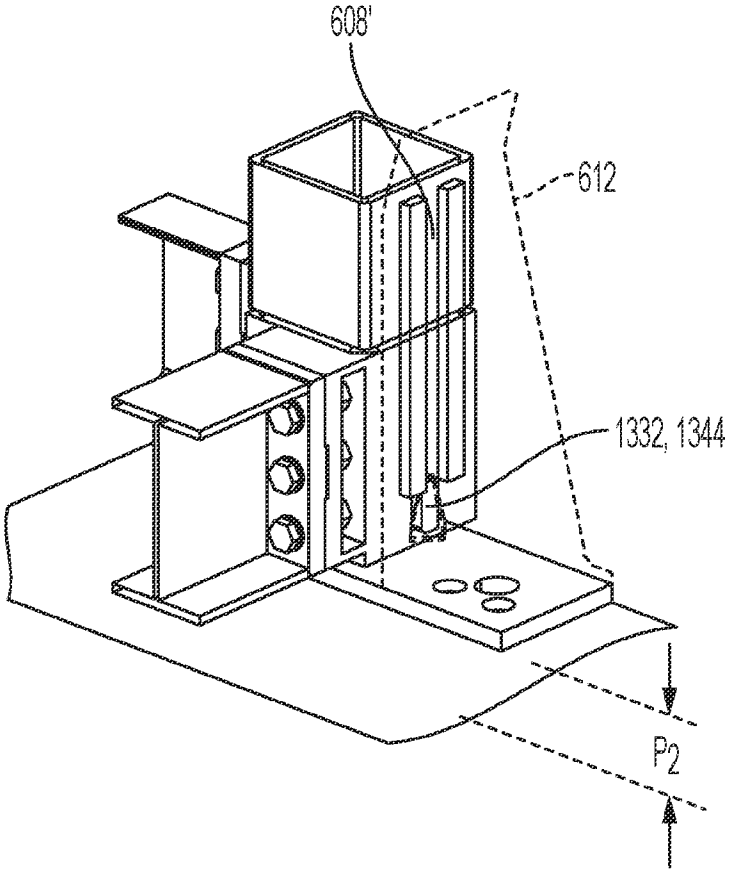
Figure 13H:
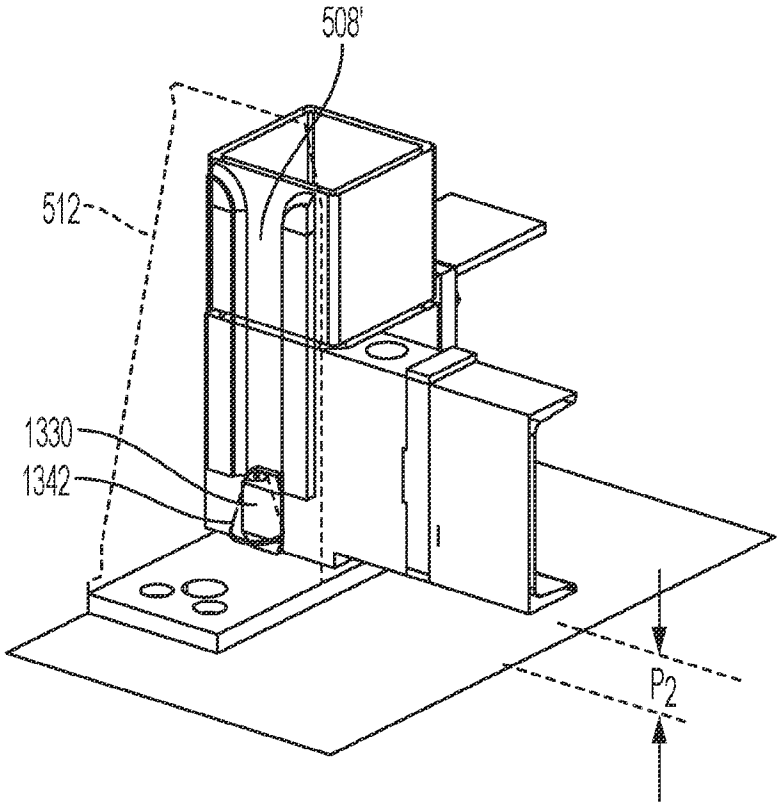

FIG. 13H is a detailed view showing the position of the male guide 1330 relative to the female guide 508' of pilot 512 when the first module has been lowered further to a second distance P2 over the substrate. In this position the top of the male guide 1330 is lower than the bottom of the female guide 508' so that male guide 1330 is functionally disengaged from and no longer tightly positionally constrained by female guide 508'. In the second position, the top of the male guide 1330 is at or below the distance $D_{P1}$ (FIG. 5B) from the substrate. Similarly, as shown in FIG. 13I, the top of male guide 1332 is below the bottom of female channel 608' of pilot 612 and is at or below the distance $D_{P2}$ (FIG. 6B) from the substrate. In this position, as the male guides 1330, 1332 disengage from the respective female guides 508', 608', the alignment pins 1332 and 1344 engage respective alignment apertures in the underside of the module (not shown) and function to place the module to its final design position as the module is lowered the remaining distance to the substrate. In an embodiment, distance P2 over the substrate where the male and female guides disengage in favor of alignment pins is about 15 mm to 25 mm or about 20 mm.

FIGS. 14A-14D show various views of alignment structure mounted to the framework 1400 of a typical row module 210. Module framework 1400 has a top 1402 and a bottom 1404. First front support 1408 and second front support 1410 define a front side 1412, shown in the front perspective view of FIG. 14A, and which is visible on the building exterior and to which a façade panel can be attached. A first rear support 1414 and second rear support 1416 define a rear side 1418 of the building module, shown in a rear perspective view of FIG. 14C. The first front supports 1408 and the first rear supports 1414 define a first side 1420 shown in FIG. 14B. The second front support 1410 and the second rear support 1416 define a second side of the module 1422 shown in FIG. 14D. Each of the first supports and the second supports 1408, 1410, 1414, 1416 have a respective top and a bottom end. The module has a module height $H_M$.

Figure 14A:
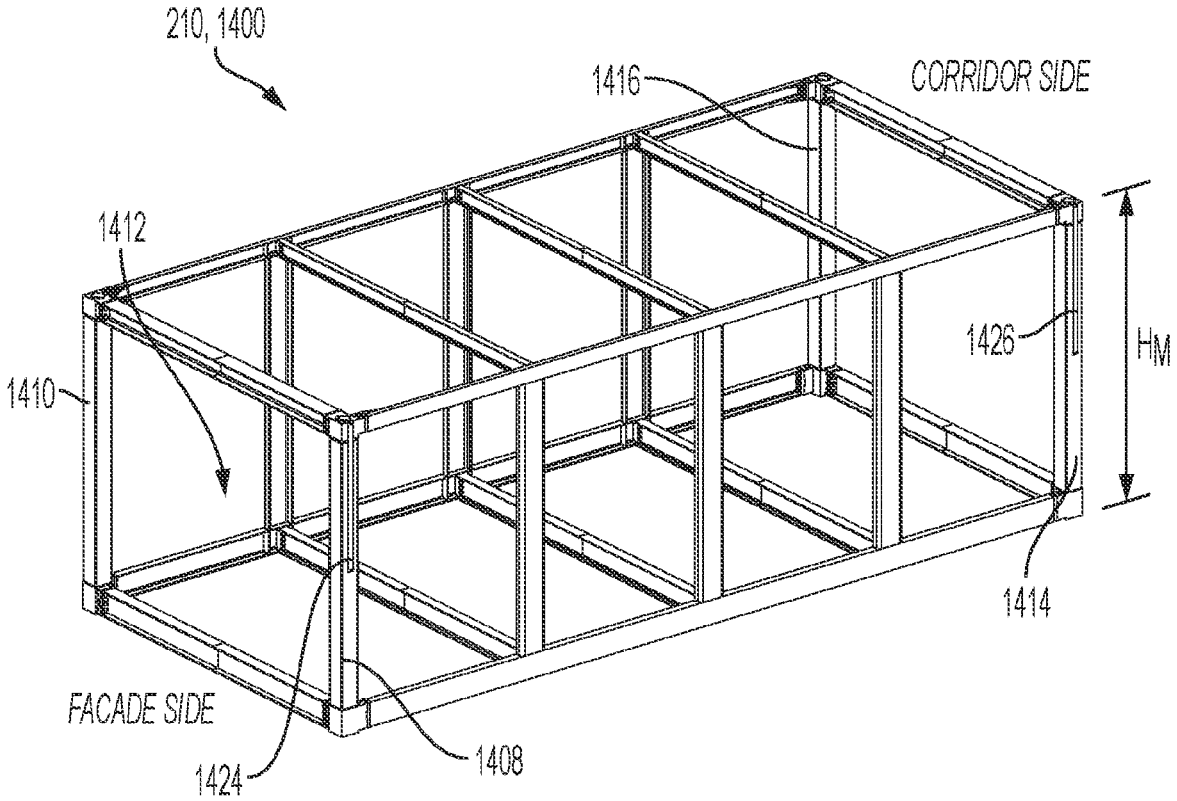
FIGS. 14A-14D show a typical row module with an embodiment of alignment structures mounted thereon.
Figure 14B:
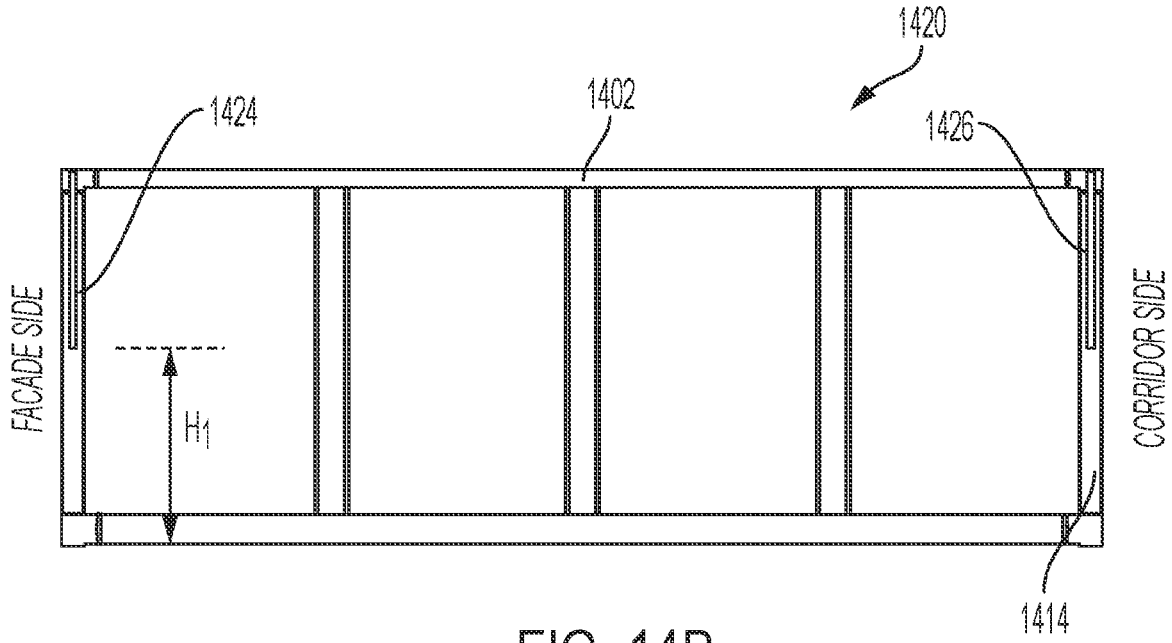

With reference to FIGS. 14A and 14B, a first type forward male guide 1424 projects outwards on the first side 1418 and extends along the first front support starting at a first height H1 above the bottom of the building module continuing upwards to substantially the top of the building module. A second type rear male guide 1426 projects outwards on the first side 1418 and extends along the first rear support 1414 starting from substantially H1 above the bottom of the building module and continuing upwards to substantially the top building module.

Figure 14C:
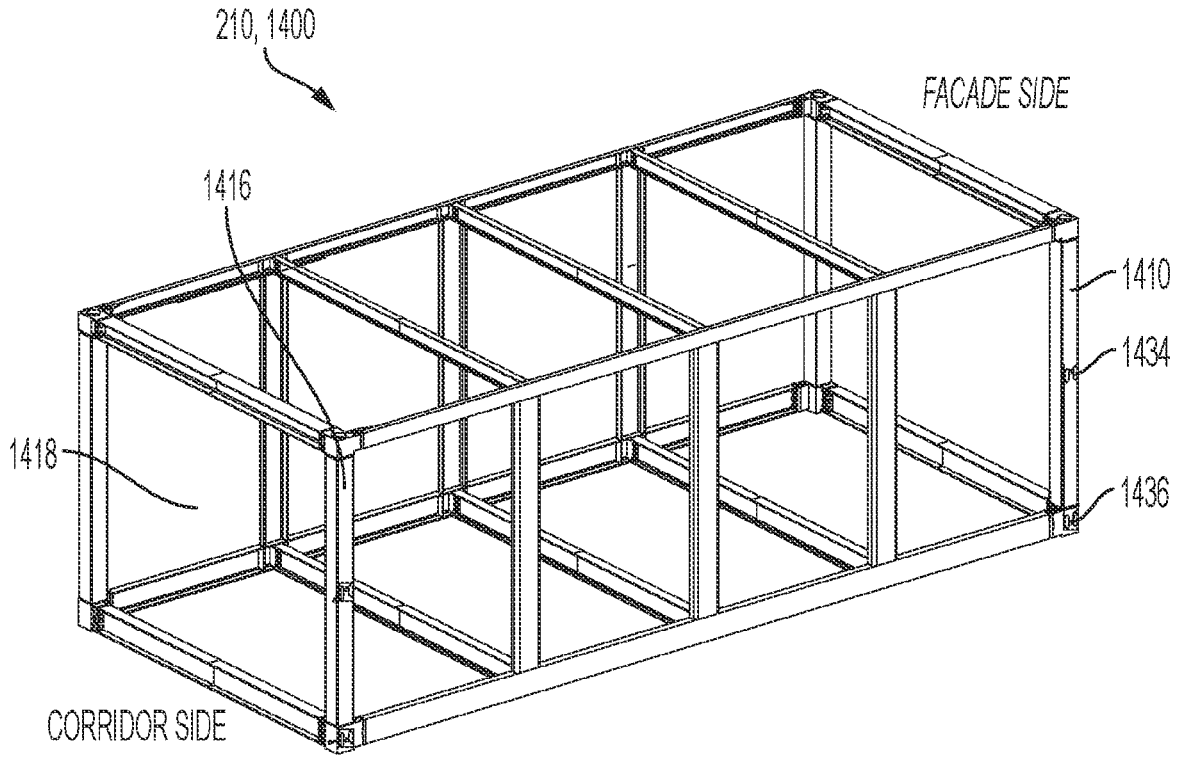
Figure 14D:
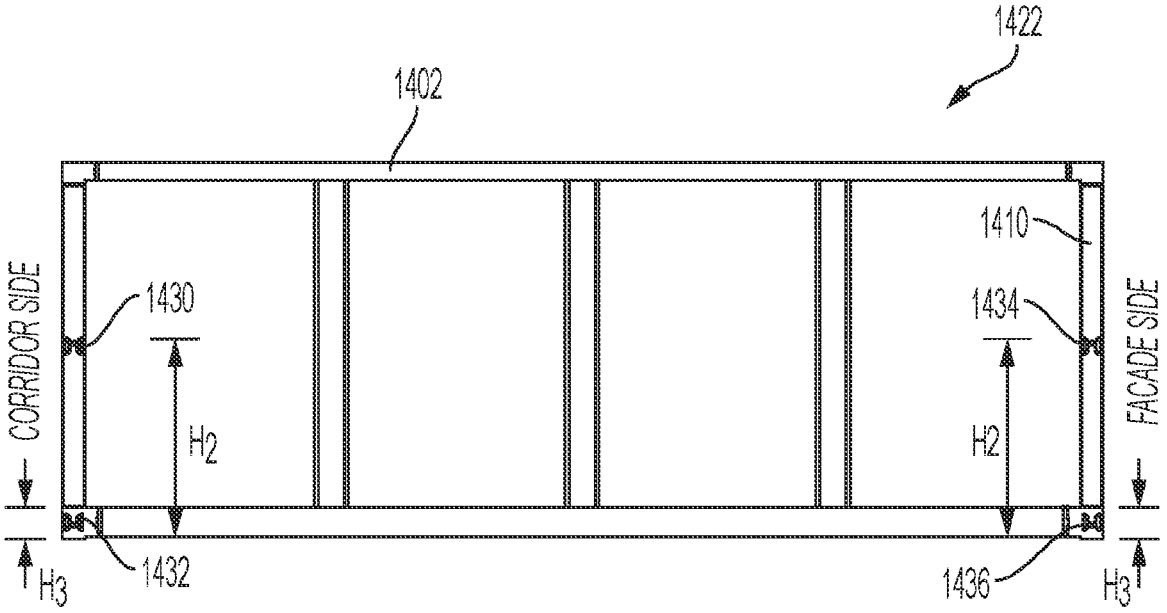

With reference to FIGS. 14C and 14D, type two upper and lower front female guides 1434, 1436 of are mounted on the second side 1422 at the second front support 1410 with the channels opening outwards away from the second side 1422. Upper and lower type one rear female guides 1430, 1432 are mounted on the second side 1422 at the second rear support 1416 with the channels opening outwards from the second side. The upper front and upper rear female guides 1434, 1430 are mounted a second height H2 above the bottom of the building module which is slightly lower than height H1. The lower front and lower rear female guides 1436, 1432 are mounted at a third height H3 above the bottom of the module and which can be substantially at the bottom of the respective supports.

FIGS. 15A-15H show perspective and detail views of a new typical row module in various stages of installation adjacent to a placed typical row module.

Figure 15A:
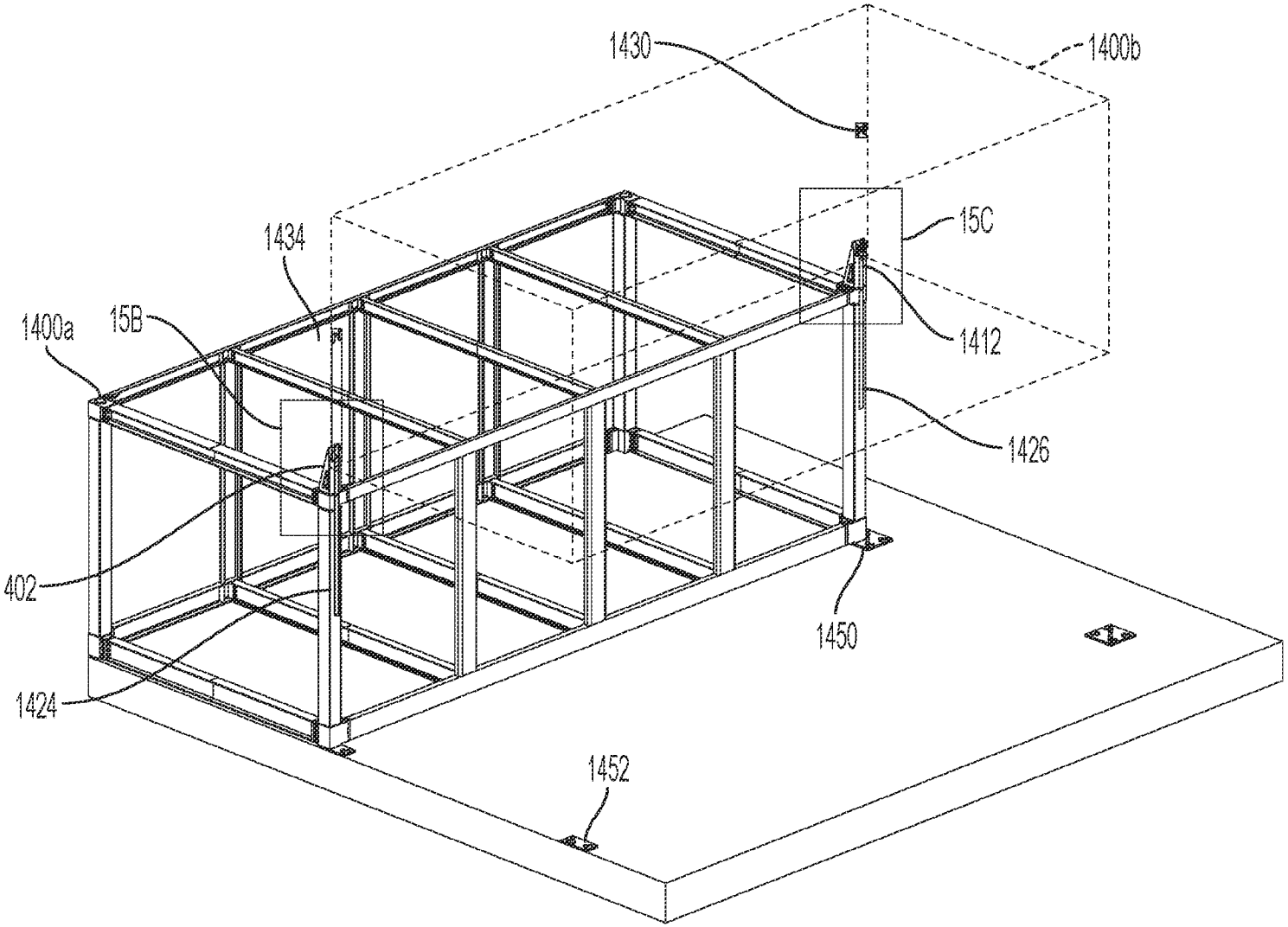
FIGS. 15A-15H show perspective and detail views of a new typical row module as in FIGS. 14A-4D in various stages of installation.

FIG. 15A shows a placed module typical row module 1400*a* on the substrate. Module 1400*a* has a type one male pilot 402 mounted on the top of the first front support 1408 and which serves as an extension of first type male guide 1424. A type two male pilot 412 is mounted on the top of the first rear support 1414 and which serves as an extension of the type two male guide 1426. Also shown in FIG. 15A is a new typical row module 1400*b* adjacent the placed module 1400*a* so that the first side 1420*a* of placed module 1400*a* and second side 1422*b* of module 1400*b* are facing each other. New module 1400*b* is shown in phantom except for the upper and lower front and rear female guides 1430*b*, 1432*b*, 1434*b*, 1436*b*.

Figure 15C:
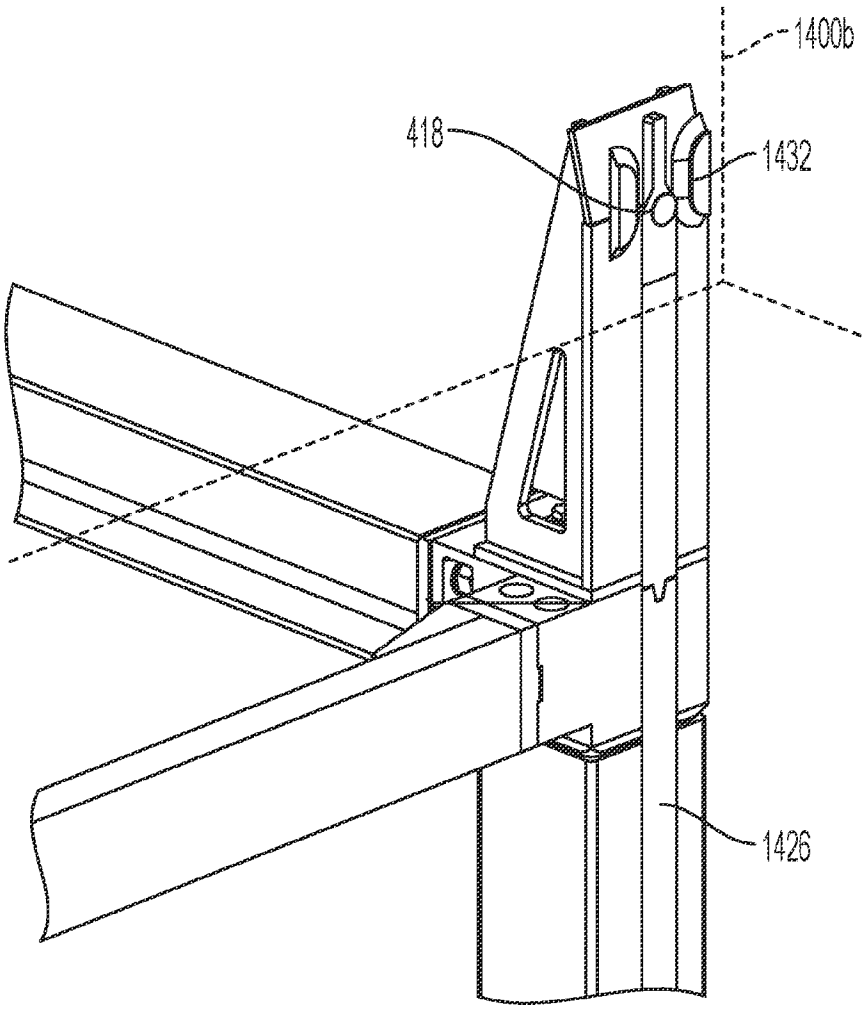
Figure 15B:
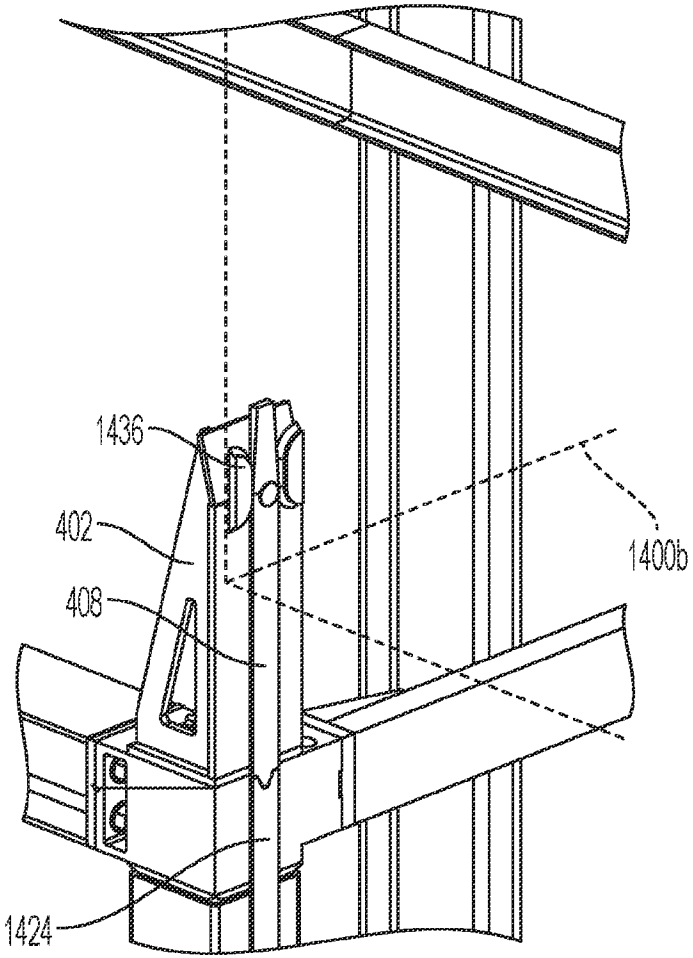

New module 1400*b* is shown in the initial position as schematically shown in FIG. 3B discussed above. In this position, and as shown in FIGS. 15B and 15C which are detailed views of areas 15B and 15C of FIG. 15A, the lower female guide 1436 is engaging the male guide 408 of pilot 402 and the lower female guide 1432 is engaging the male guide 418 of pilot 412. The positions at height H3 of the lower female guides 1432, 1436 on the respective support columns and the height of the pilots 402, 408 can be selected so that the female guides 1432, 1436 engage the respective male guides 418, 408 of the pilots when the bottom of the new module 1400*b* is at a predefined height above the placed module 1400*a*, such as between 400 mm and 500 mm or 450 mm.

Figure 15E:
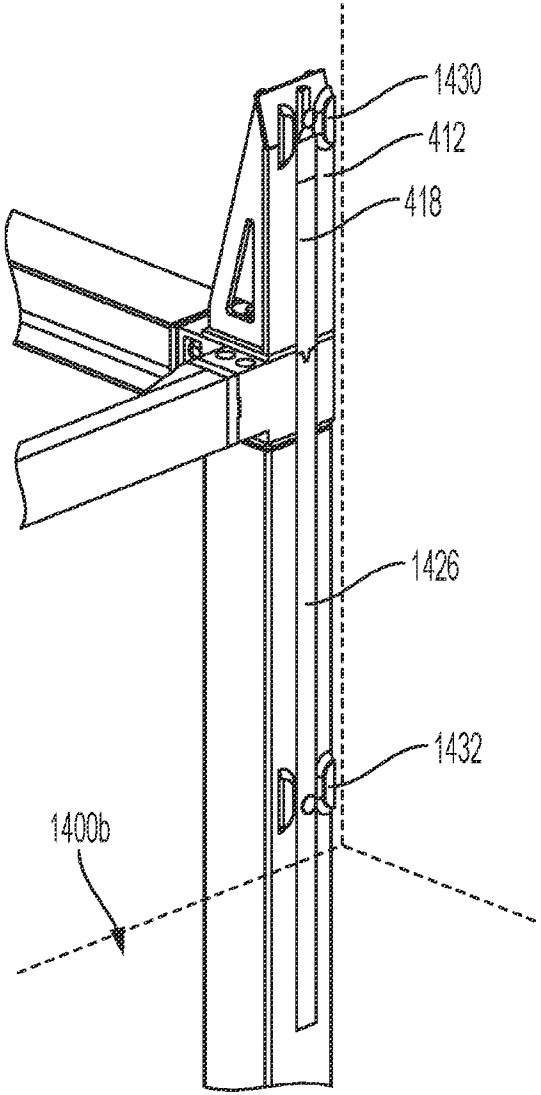
Figure 15D:
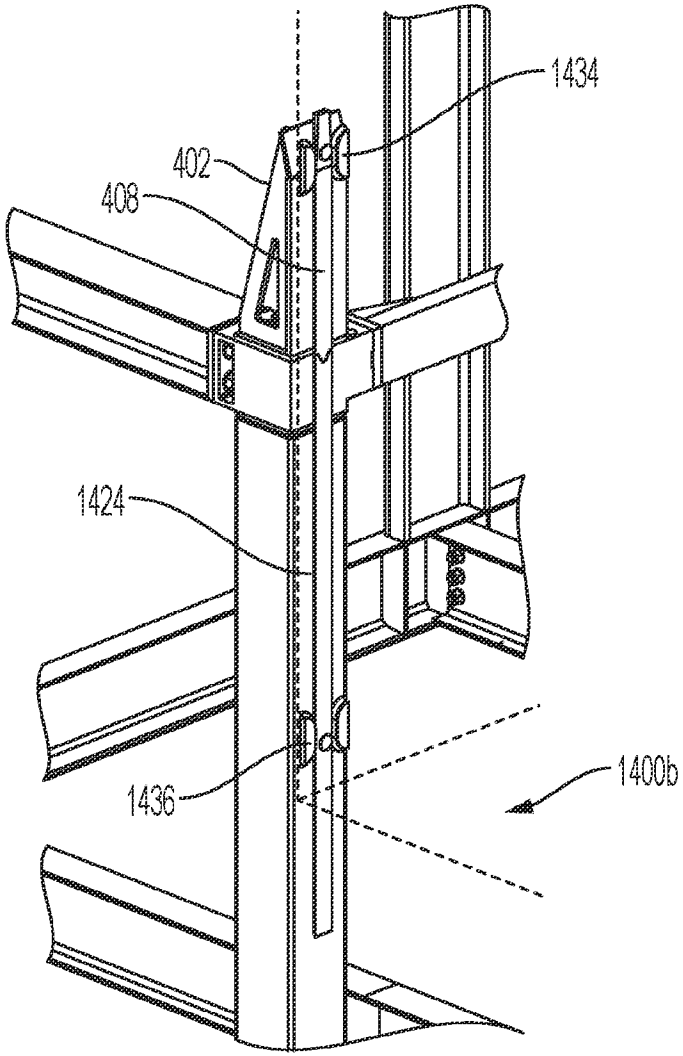

FIGS. 15D and 15E show the engagements of the respective male and female guides between placed module 1400*a* and new module 1400*b* when module 1400*b* has been lowered to the point where the upper back female guide 1434 (FIG. 15D) and upper front female guide 1430 (FIG. 15E) begin to engage the respective male guides 408, 418 on the pilots 402, 412 and the lower female guides 1436, 1432 are fully engaged with the respective male guides 1424, 1426. This is the intermediate zone illustrated in FIG. 3C, above. The vertical separation of the upper and lower female guides can be selected so that this condition occurs when the bottom of the new module 1400*b* is a predefined vertical position over the substrate, such as between about 2100 mm and 2200 m or about 2140 mm.

As will be appreciated, and as discussed above with respect to FIGS. 12A and 12B, the engagement of the type one female guides 1434, 1436 on the second forward support 1410 of new module 1400*b* with the corresponding type one male guides 1424 on the first forward support 1408 of placed module 1400*a* and male guide 1408 of pilot 1402 provides a high degree of alignment where adjacent edges of preinstalled façades on the front of the new module 1400*b* and placed module 1400*a* interact. The engagement of the type two female guides 1430, 1432 on the second rear support 1416 of the new module 1400*b* with the corresponding type two male guides 1426 on the first rear support 1414 of the placed module 1400*a* and 418 on the pilot 412 provides alignment but with a lesser degree of constraint so that relative tolerance mismatches between parts on each module 1410*a*, 1410*b*, and mismatches between engaged parts between the two modules does not cause binding as the new module 1400*b* is lowered.

As the new module 1400*b* is continued to be lowered, the lower female guides 1436, 1432 will pass below height H1 over the substrate and functionally disengage from the respective male guides 1424, 1426 while the upper female guides 1434, 1430 remain engaged with the male guides. As lowering of module 1400*b* continues, the upper female guides 1434, 1430 will pass below height H1 of the substrate and functionally disengage from the respective male guides 1424, 1426. This is the position shown in FIG. 3D, above. In this position, which can be for example 15 mm to 25 mm or about 20 mm above the substrate, the female alignment apertures in the bottom of the new module 1400*b* have been engaged by upward alignment pins on the substrate and the final alignment of the new module 1400*b* is provided by the alignment pins and holes as the new module 1400*b* is lowered the remaining distance to the substrate.

Figure 15G:
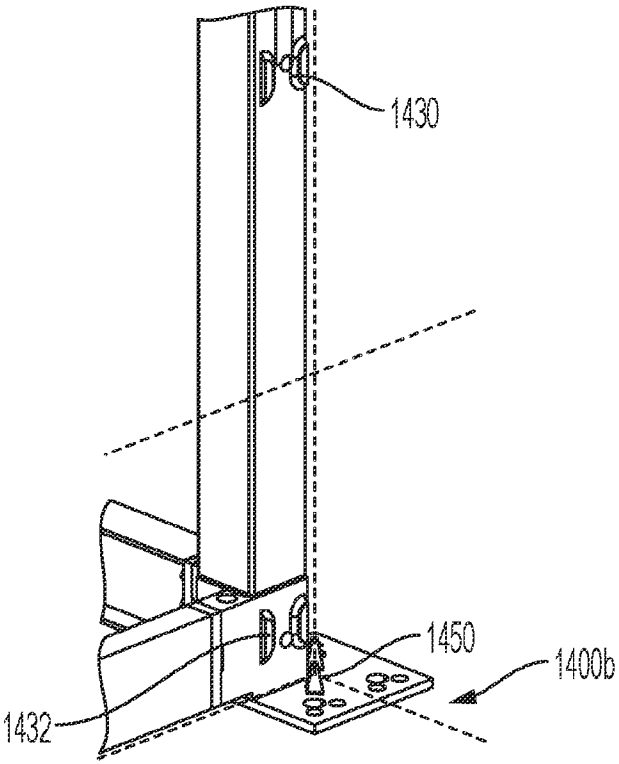
Figure 15H:
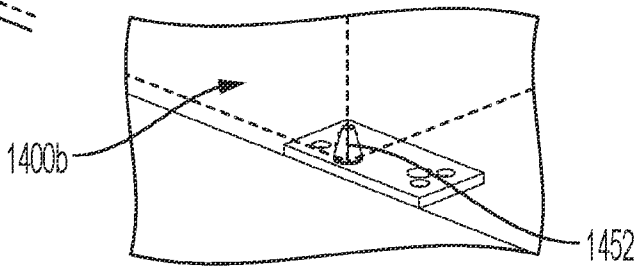
Figure 15F:
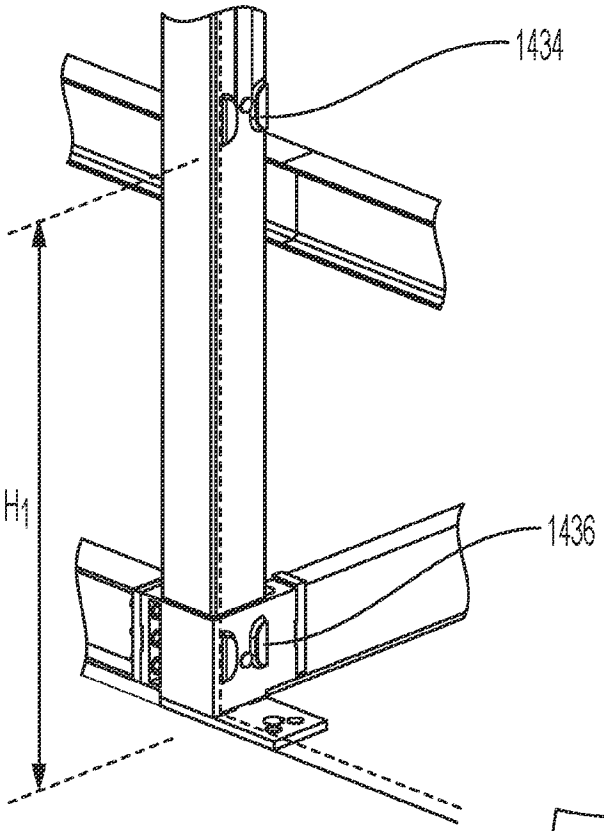

In an embodiment at least two alignment pins are provided and these can be on opposite corners under the module. For example, with reference to FIG. 15A, an alignment pin 1450 is mounted on the substrate in a position to engage an alignment aperture on the bottom of new module 1400*b* under its second rear support 1416. A second alignment pin 1452 is mounted on the substrate to engage an alignment aperture on the bottom of new module 1400*b* at under its first front support 1408. Detailed views of the corners of new module 1400*b* in this position are shown in FIGS. 15F, 15G and 15H.

Figure 16A:
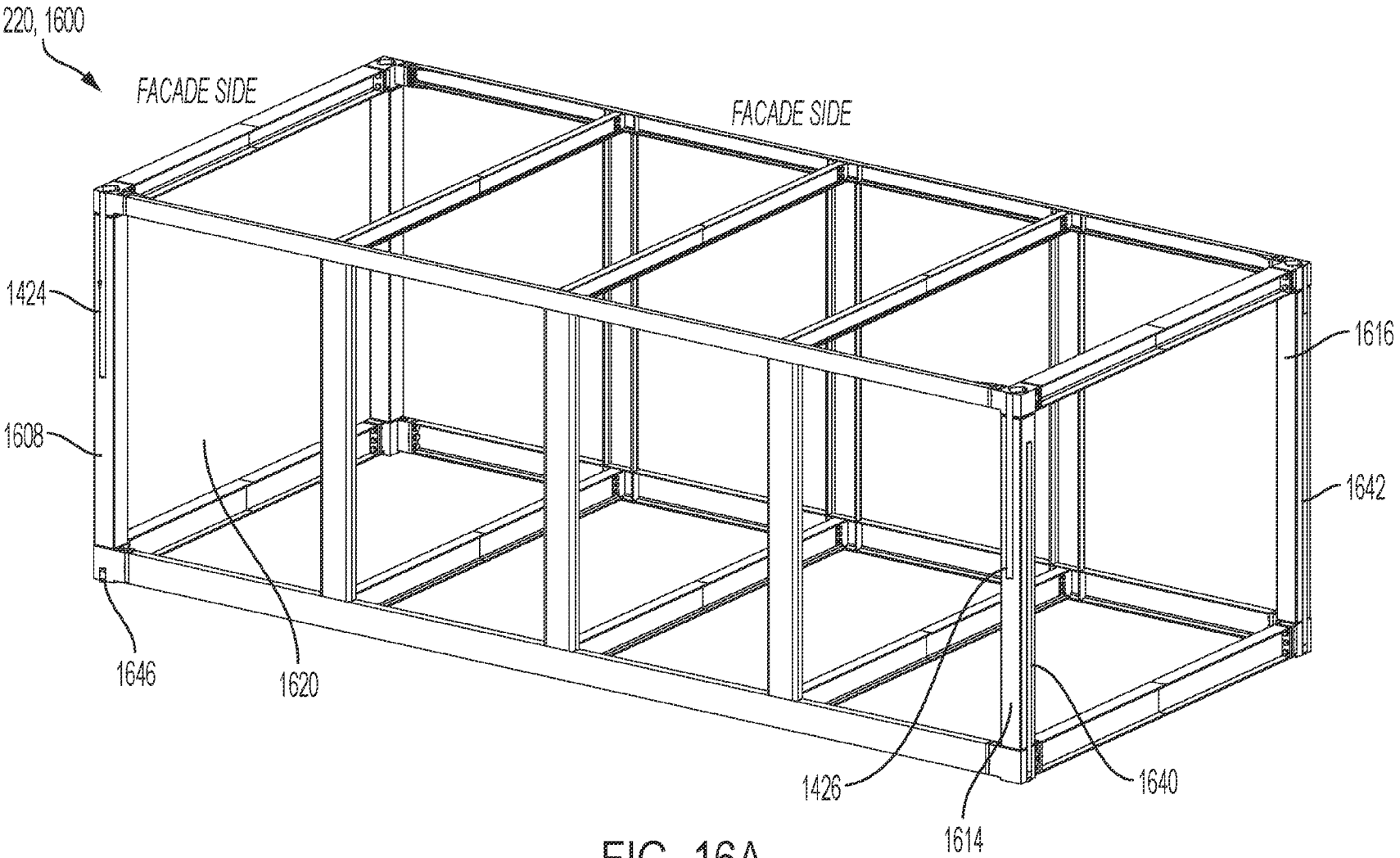
FIGS. 16A-16C show a second row start module with an embodiment of alignment structures mounted thereon.
Figure 16B:
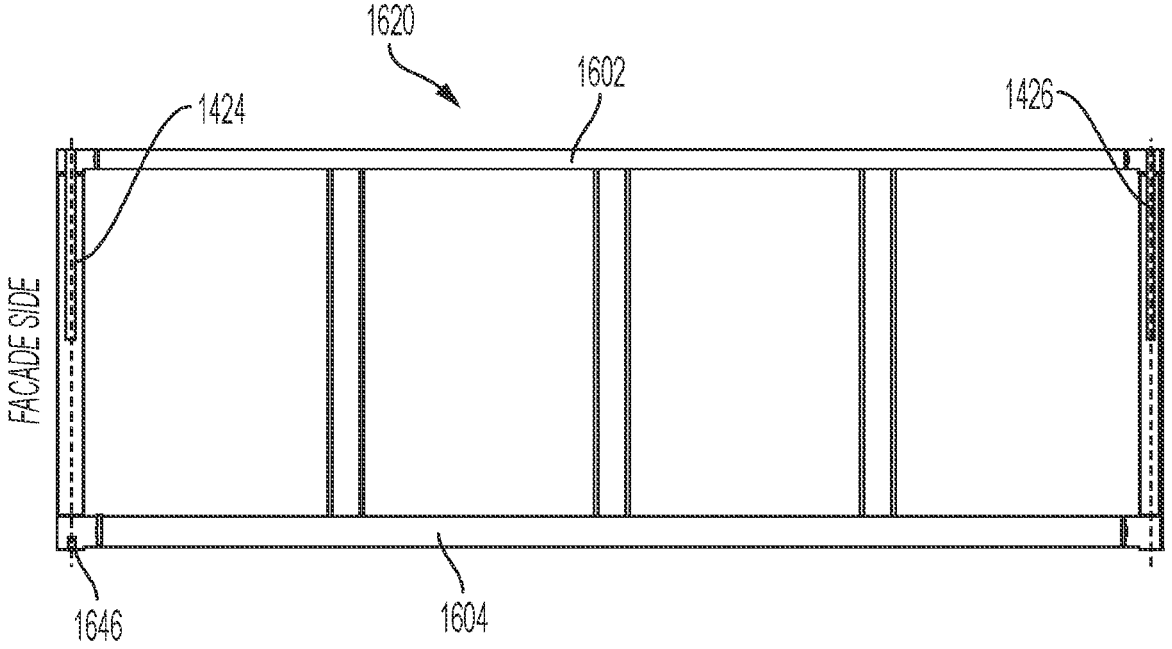
Figure 16C:
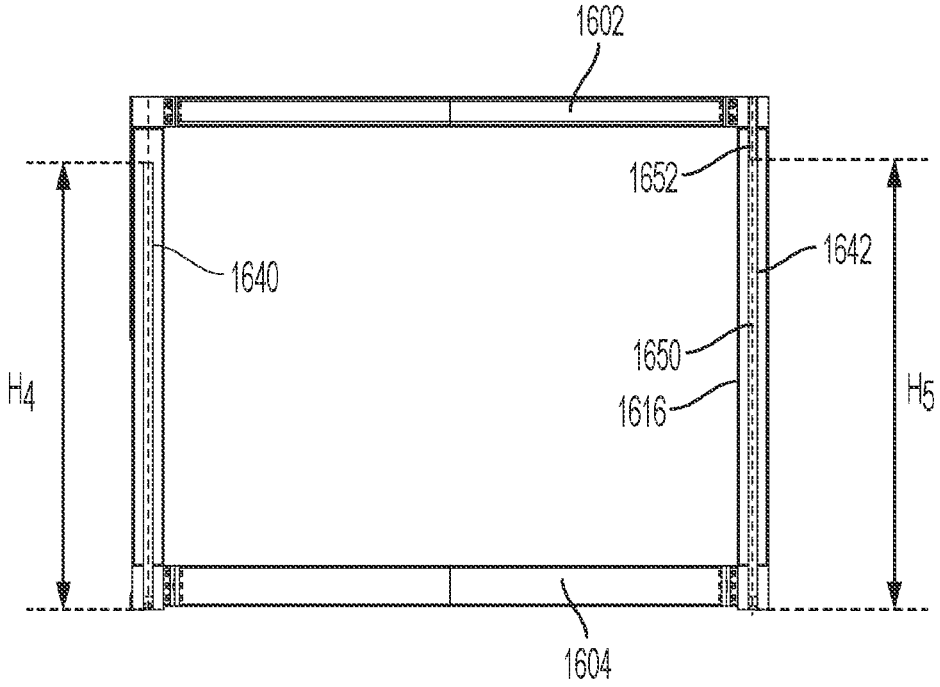

FIGS. 16A-16C show a perspective, rear and first side views of a second row start module 1600, such as shown as module 220 in FIG. 2C. FIG. 16A shows a rear perspective view. Module 1600 has a first side 1620 and a rear side 1618. First side 1620 is shown in FIG. 16B and rear side 1618 in FIG. 16C. As illustrated, the first rear support 1614 has a type two male guide 1640 running from substantially the bottom of the first rear support 1614 on the rear side 1618 to a height H4 above the bottom of the module 1600. A hybrid male guide 1642 runs from substantially the bottom of the second rear support 1616 on the rear side 1618 to the top of the module 1600. Hybrid male guide 1642 has a lower portion 1650 in a first type male guide configuration extending from the bottom of the module to a height H5 and an upper portion 1652 in a third type male guide configuration and extending from height H5 to substantially the top of the module 1600. A male guide block 1646 of the first male guide type is positioned at the bottom of the first forward column 1608 on the first side 1620.

FIGS. 17A-17I show perspective and detail views of a second row start module 220, 1600 in various stages of installation.

Figure 17A:
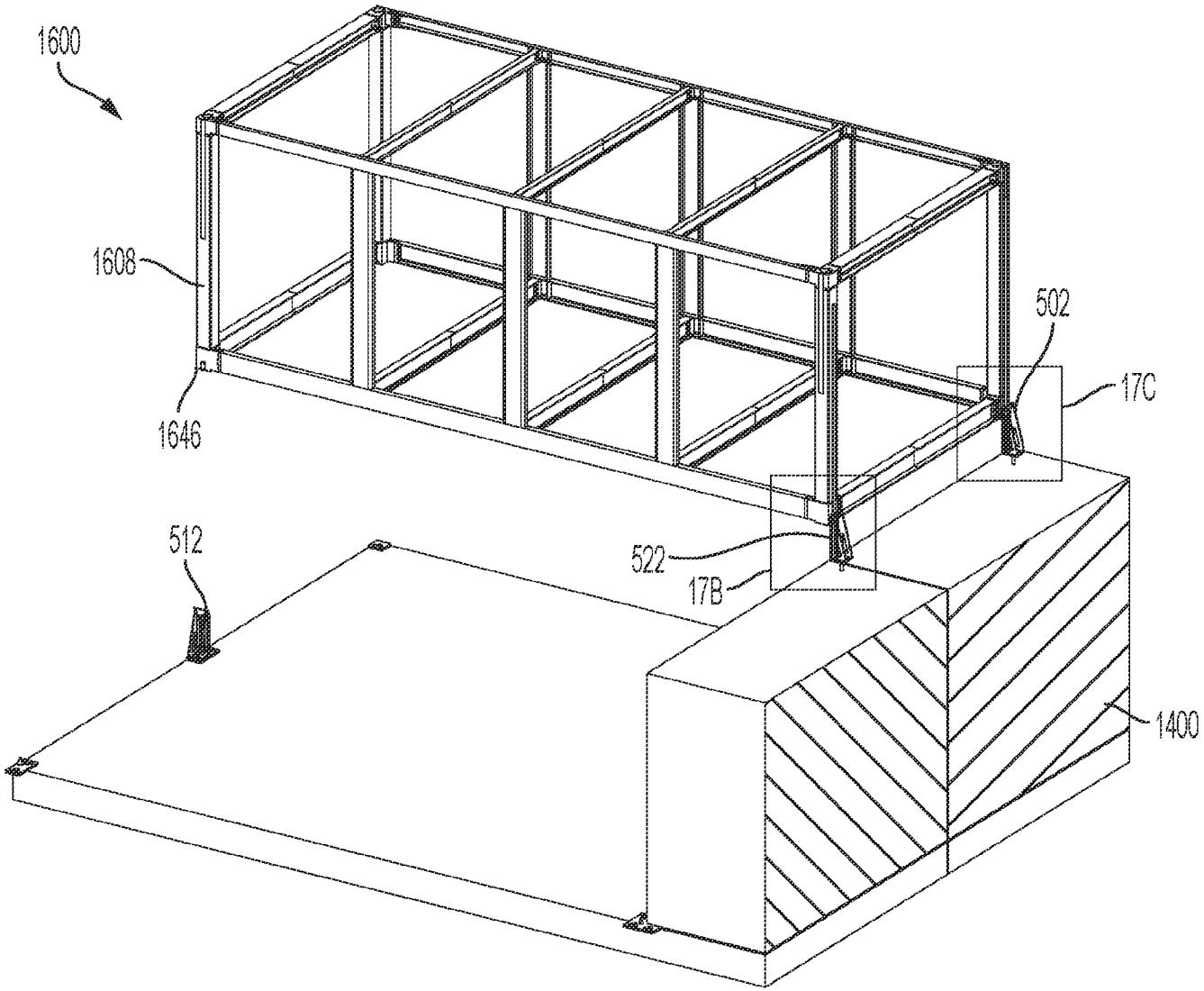
FIGS. 17A-17I show perspective and detail views of second row start module as in FIGS. 16A-16D various stages of installation.
Figure 17C:
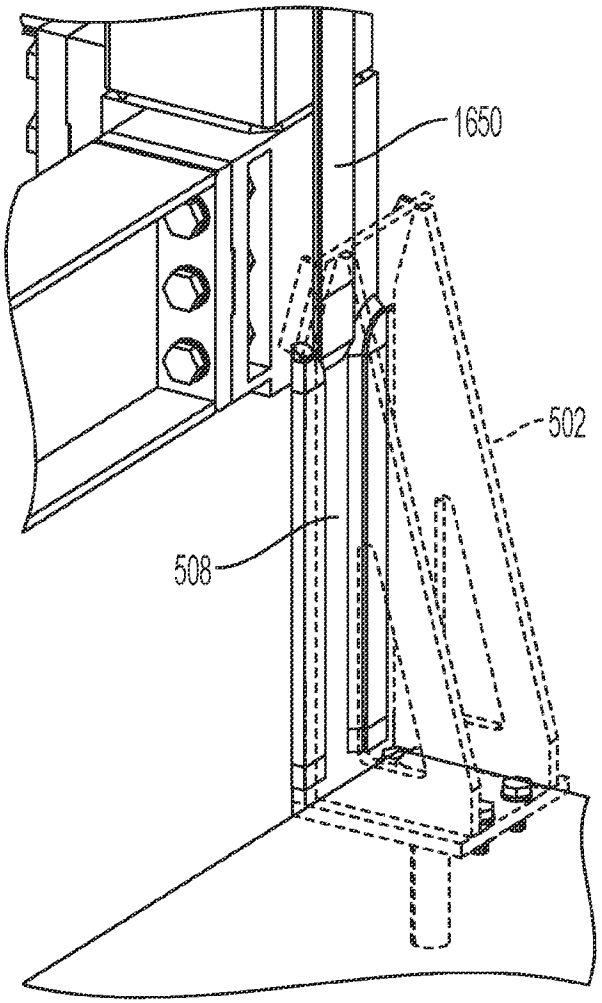
Figure 17B:
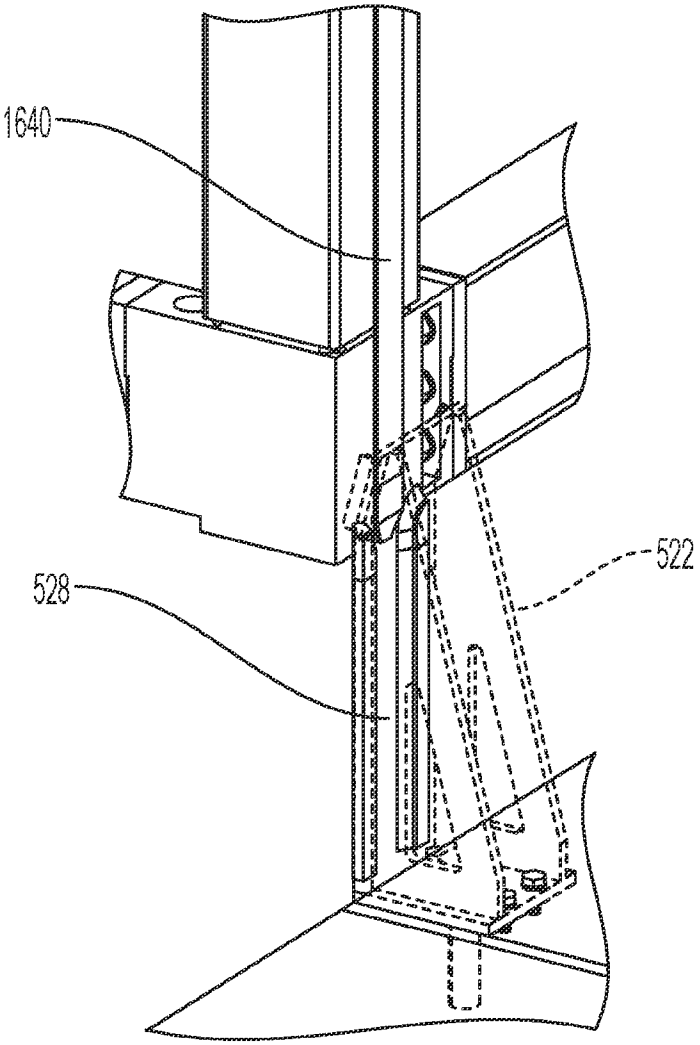
Figure 17D:
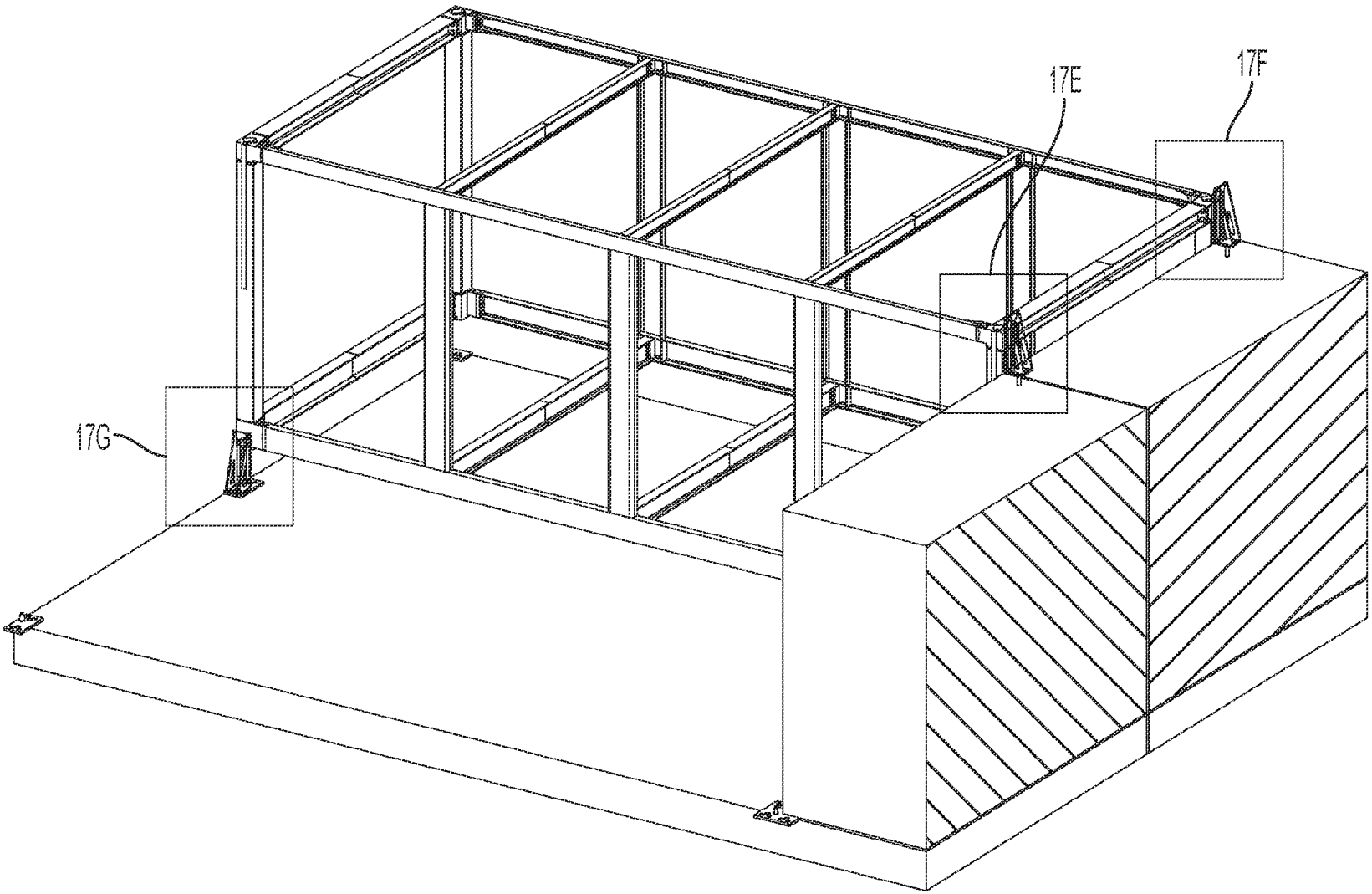
Figure 17G:
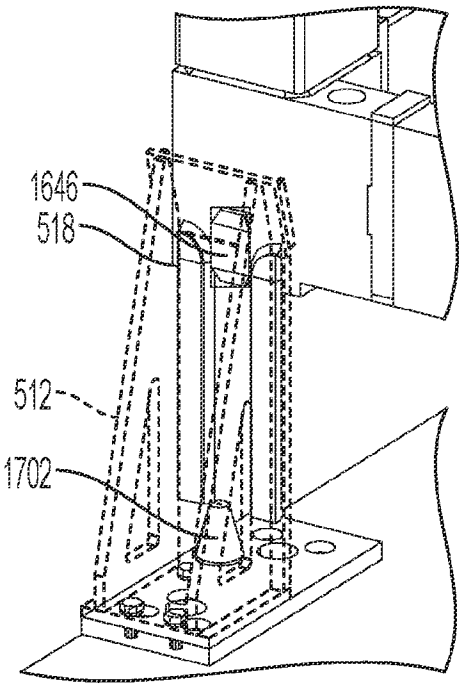
Figure 17F:
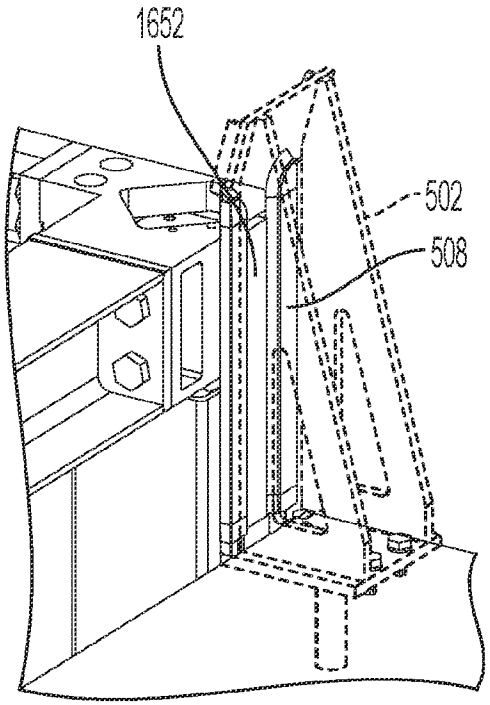
Figure 17E:
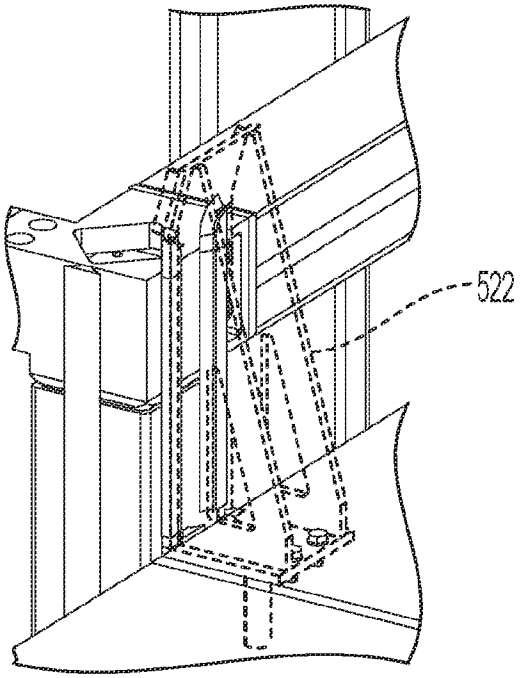
Figure 17I:
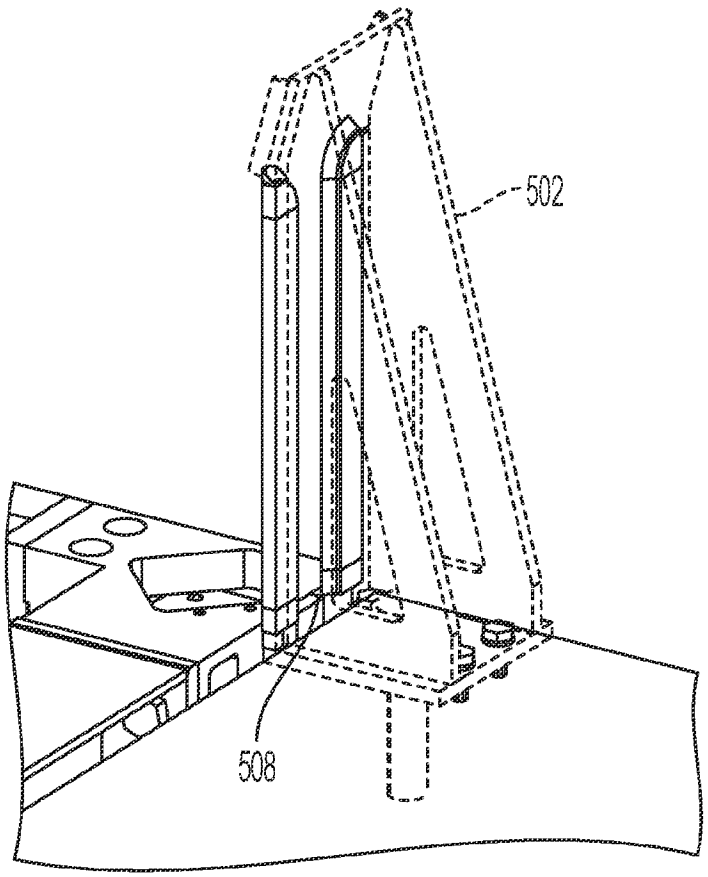
Figure 17H:
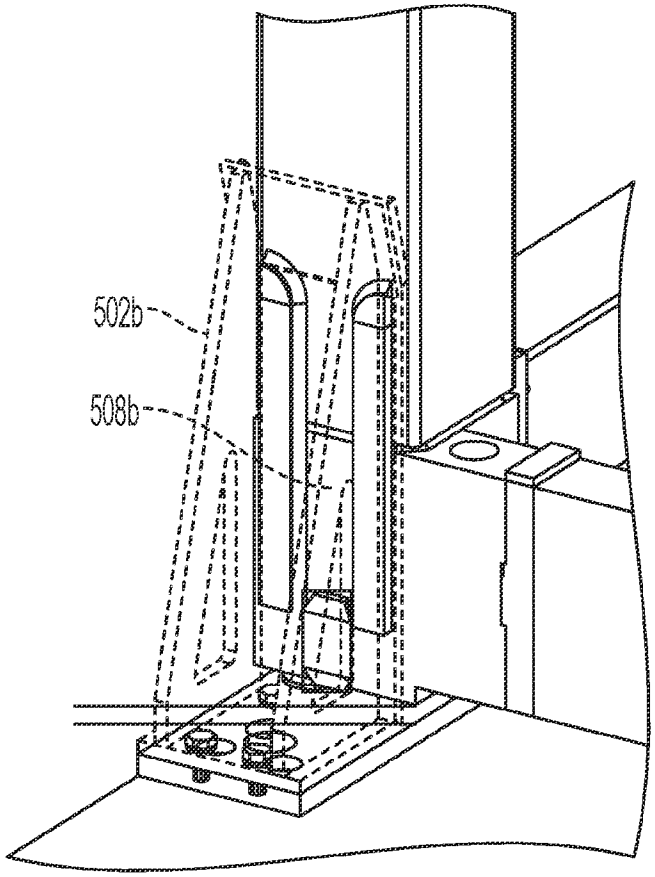

FIG. 17A shows the second row start module 1600 in an initial position over the substrate with the rear side 1618 of module 1600 adjacent the rear side of a placed module, such as a typical row module 1400 as illustrated. A type two female pilot 522 with type two female guide 528 is mounted on top of placed module 1400 in the corner so that it will be engaged by the type two male guide 1640 on the first rear support 1614. A type one female guide 502 is mounted on the top of placed module 1400 in the corner so it will be engaged by the hybrid male guide 1642 on the second rear support 1616. An additional type one female pilot 512 (FIG. 5B) is mounted to the substrate to receive the male guide block 1646 on the first forward support 1608.

As the module 1600 is lowered into an initial engagement position (see FIG. 3B), the male guide 1640 will engage female guide 528 in pilot 522 and the lower portion 1650 of hybrid guide 1642 will engage female guide 508 in pilot 502. The start of this condition is shown in FIG. 17A and in the detail views in FIGS. 17B and 17C of areas 17B and 17B in FIG. 17A. In this location, the position of second rear support 1616, to which outer façade edge can be attached, is tightly constrained by the interaction of the type one male and female guides as illustrated in FIG. 12A and the position of the first rear support 1614 is constrained to a lesser degree by the interaction of the type two male and female guides as illustrated in FIG. 12B.

As module 1600 is lowered further, it will reach a point where the end of male guide 1640 at H4 is below and disengaged from the female guide 528 in pilot 522. At this disengagement point, the guiding by male guide 1640/female guide 528 is replaced by guiding of male guide block 1646 as it first engages female guide 518 in female pilot 512. These conditions are shown in the detail views of FIG. 17E of area 17E and FIG. 17G of area 17G. In addition, at this position the lower portion 1616 of hybrid male guide 1642 will have exited female guide 508 in pilot 502 to be fully replaced by the upper portion 1652. The upper portion 1652 is a type three male guide configuration and so will continue to constrain motion along the lateral axis, such as substantially to the same degree as was done by lower portion 1650, but constrain horizontal motion to a much lesser degree in the normal axis. This situation is shown in FIG. 12D. As a result, the alignment provided by the alignment structures transitions from one where the interaction of male guide 1650 and pilot 502 acts as pivot point for module 1600 with lesser constraint provided by male guide 1640 and pilot 522 (and during which, if present, adjacent façade edges of the new and placed modules are aligned and came largely interlocked) to an alignment scenario where interaction of male guide block 1646 with pilot 512 acts as the pivot point for module 1600 with lesser constraint provided by male guide 1640 and pilot 522, analogous to the arrangement illustrated in FIG. 13G in connection with placement of the first row module 1300.

The position of the new module 1600 over the substrate where this transition between installation zones occurs is dependent on the geometry and placement of the various guide components. In an embodiment, a transition could occur when the bottom of the new module 1600 is between about 400 mm and 500 mm or about 450 mm over the substrate.

As lowering of the new module 1600 continues, the male guide block 1646 and upper portion 1652 of male guide 1640 remain engaged within their female guides on the respective pilots until the module 1600 has been lowered sufficiently for alignment pins that are mounted on the substrate to start to engage corresponding alignment holes on the bottom of module 1600, at which point the male guide block 1646 and male guide 1640 disengage from the respective female guides on the pilots as discussed above. (As seen in FIG. 5A, the lower end of the female track 508 for pilot 502 ends slightly above the bottom of the pilot 502. As a result, even if male guide 1640 extends to substantially the top of the module 1600, male guide 1640 will still disengage slightly before the top of the new module 1600 is even with the top of the placed module 1400.) In the illustrated embodiment, only a single alignment pin 1702 is shown and it is placed on the substrate next to the pilot 512. See, e.g., FIG. 17G.

FIGS. 18A-18D are perspective and side views of a second row end module 230, 1800. FIGS. 19A-19C illustrate the placement of the second row end module 1800 adjacent a placed first module 1300 and placed typical row module 1400 in the second row. (See FIG. 2D)

Figure 18A:
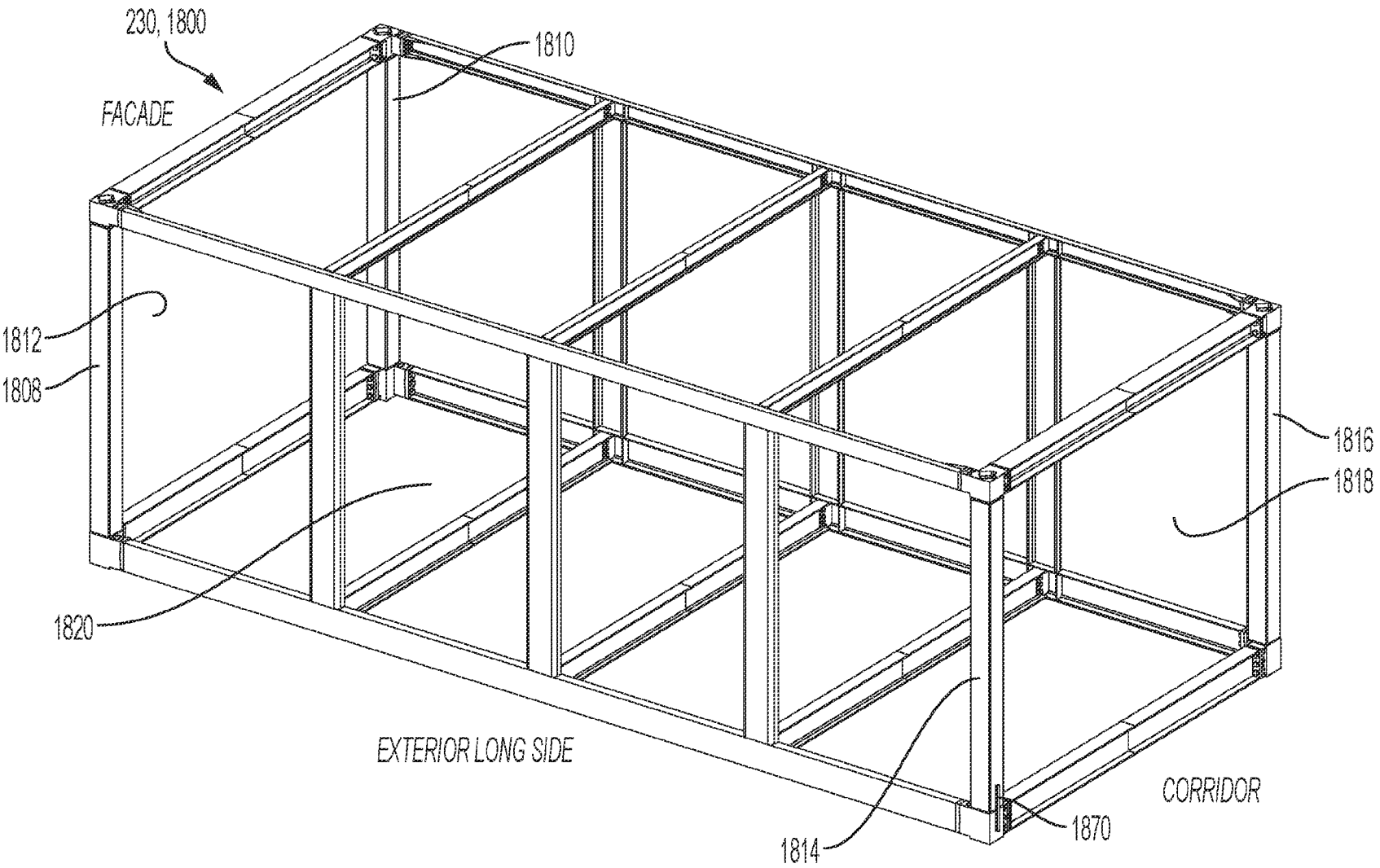
FIGS. 18A-18D show a second row end module with an embodiment of alignment structures mounted thereon.
Figure 18B:
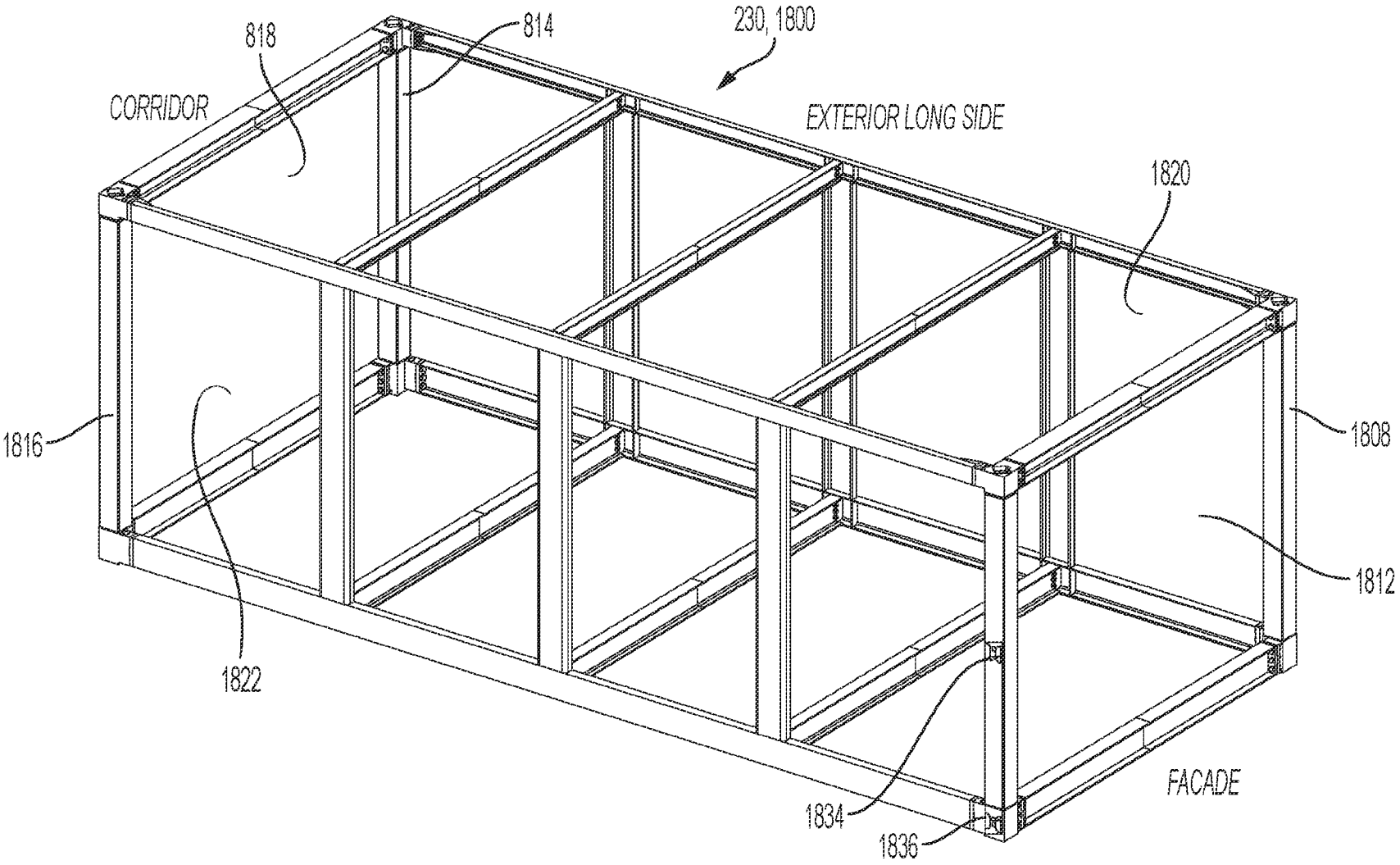
Figure 18C:
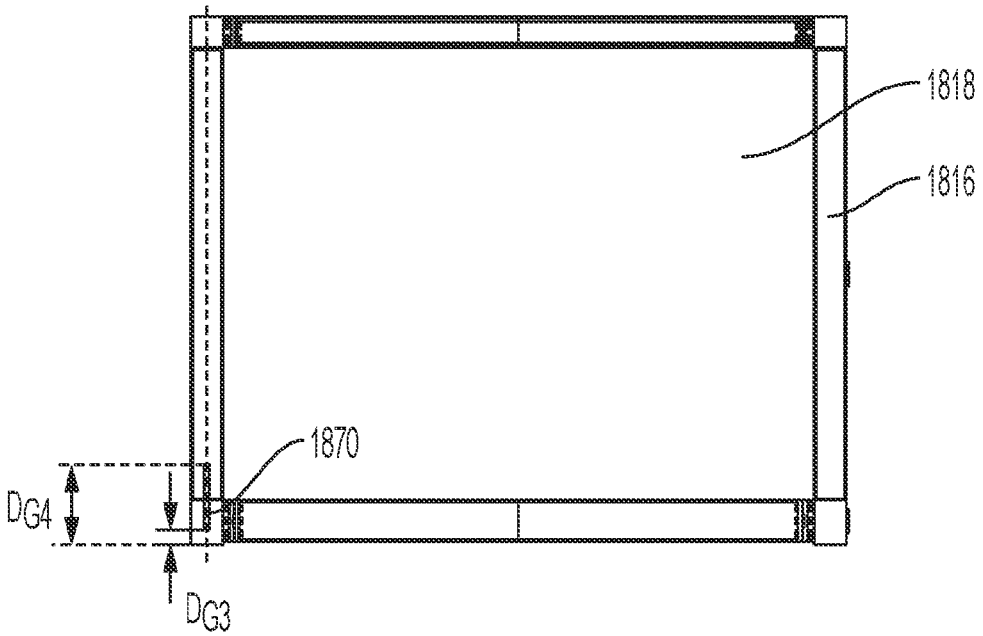

FIGS. 18A and 18*b* show rear and front perspective views of module 1800. Module 1800 has first and second forward vertical supports 1808, 1810 that define a front side 1812 to which a façade can be attached. First and second rear vertical supports 1814, 1816 define a rear side 1818. The first front support 1808 and first rear support 1814 define a first side 1820 which is also an exterior side and to which façade may be attached. Second front support 1810 and second rear support 1816 define a second side 1820. FIG. 18C shows the rear side 1818 and FIG. 18D shows the second side face 1822.

Figure 18D:
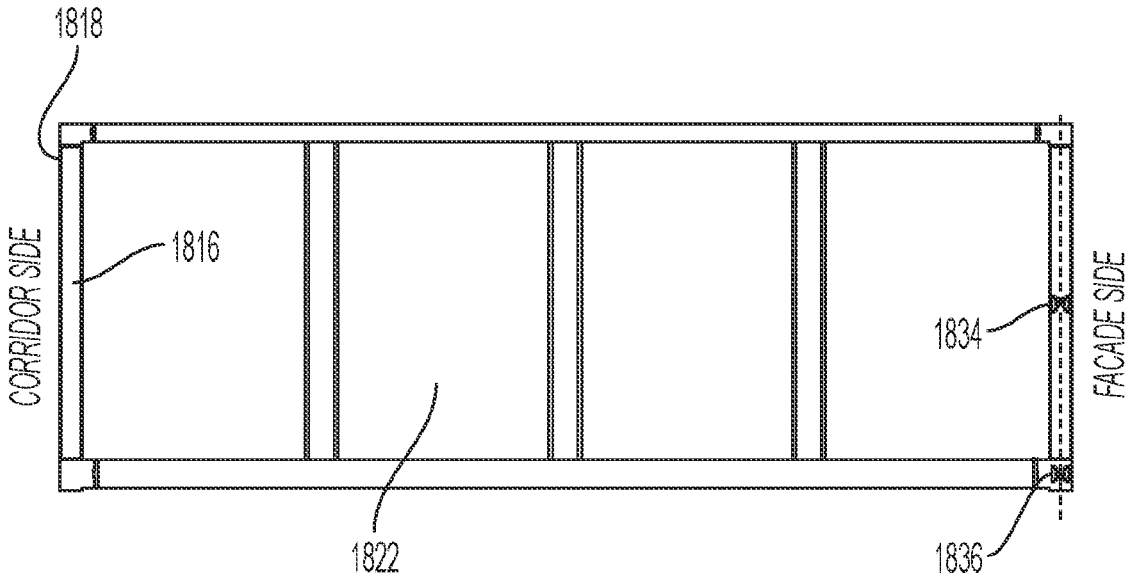
Figure 19A:
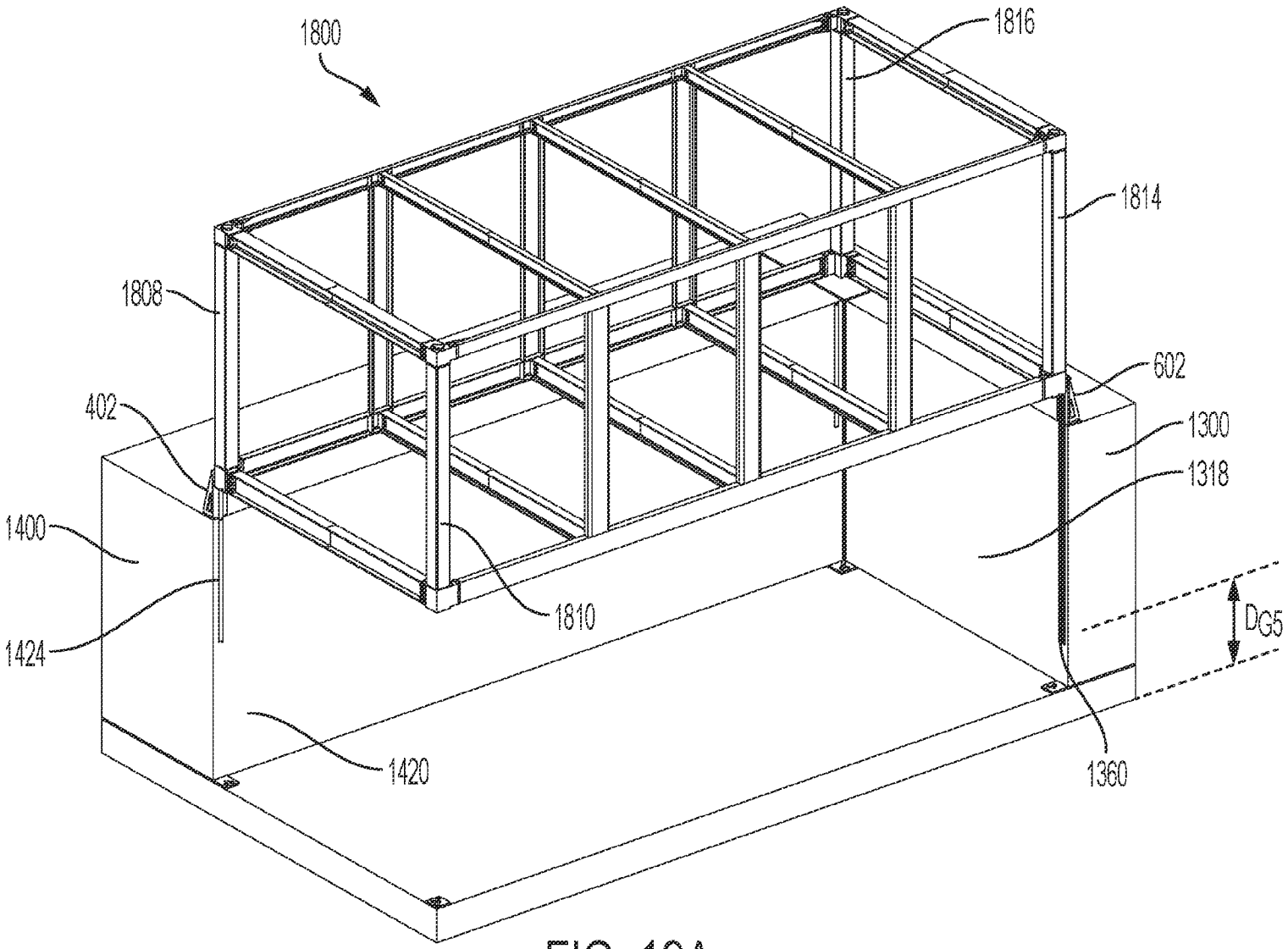
FIGS. 19A-19B show the second row end module as in FIGS. 18A-18D in various stages of installation.
Figure 19B:
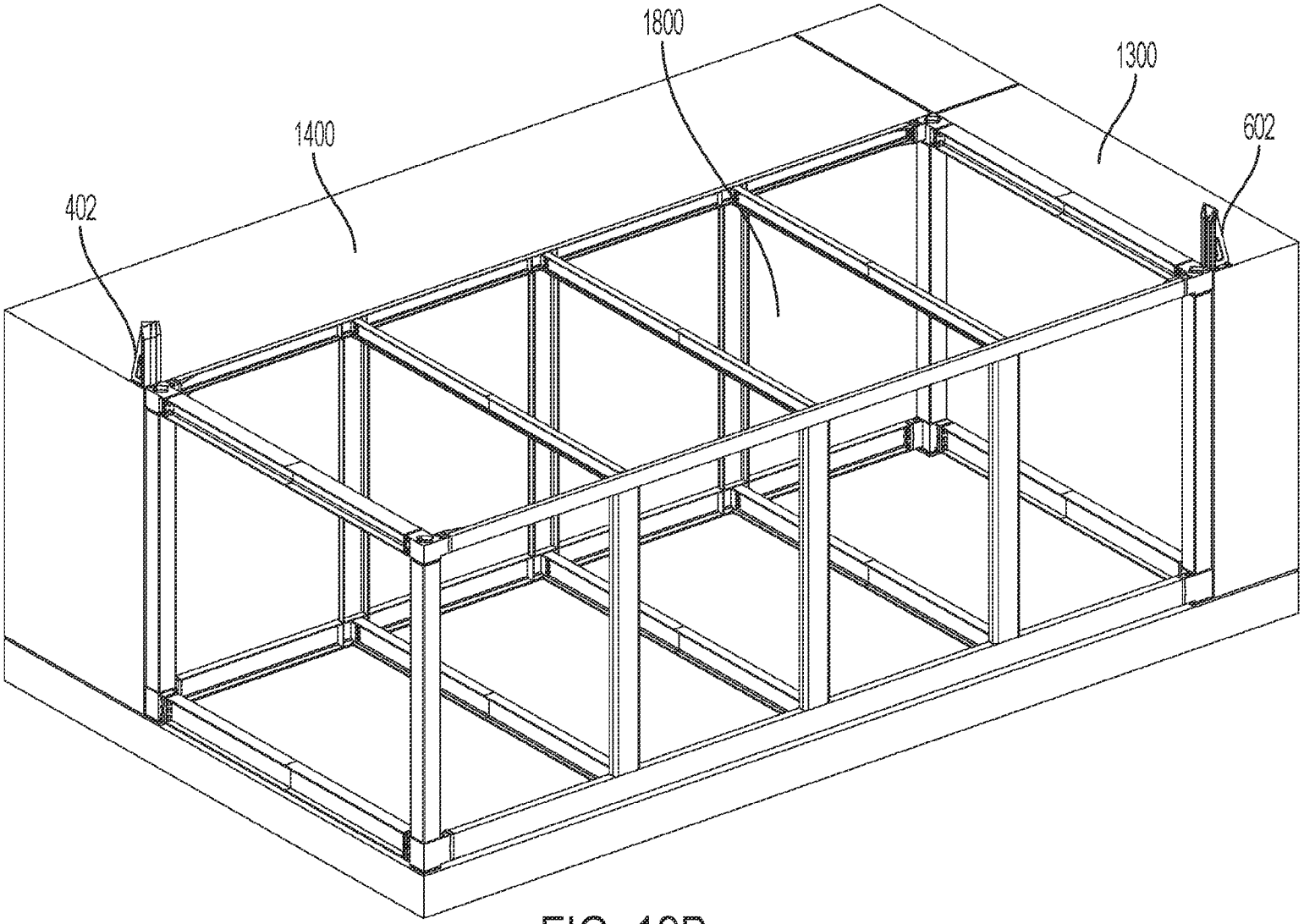

With reference to FIGS. 18B and 18D, the second front support 1810 has upper and lower type two female guides 1834, 1836 mounted on the second side 1422 at the second front support 1810 with the channels opening outwards away from the second side 1822. These female guides 1834, 1836 correspond to the upper and lower female guides 1434, 1436 present on a typical row module 210, 1400 and described above.

A section of type three male guide 1870 is mounted to the first rear support 1814 on the rear side 1818. The male guide 1870 has a lower end at is a height $D_{G3}$ above the bottom of the module 1800 and a top end at a height $D_{G4}$ above the bottom of the module 1800.

FIG. 19A shows second row end module 1800 in an initial install position above and horizontally adjacent an already placed first module 1300 and already placed typical row module 1400. As discussed above with respect to module 1300 and as shown in FIG. 13A, there is a type three female guide 1360 on the second rear support on the back side 1318 of the first module 1300. Female guide 1360 extends from a lower end at a height $D_{G5}$ above the bottom of module 1300 substantially to the top of the module 1300. The first side 1420 of the typical row module 1400 has a type one male guide 1424 on the first side 1420 along the first front support of the module 1400 as discussed above and show above in FIGS. 14A and 14B.

A type three female pilot 602 with a type three female guide 608 (FIG. 6A) is mounted on the top of module 1300 and extends the female guide 1360 upwards above the top of module 1300. A type one male pilot 402 (FIG. 4A) with male guide 408 is mounted on top of module 1400 and extends the male guide 1424 upwards above the top of module 1400.

In the position as illustrated in FIG. 19A and as the module 1800 is initially lowered, the upper and lower type two female guides 1834, 1836 engage and disengage from the male guide 408 of pilot 402 and the male guide 1424 in the same manner as described above with respect to upper and lower female guides 1434, 1436 on a new module 1400*b* interacting with the male guides on a placed module 1400*a* and as illustrated in FIGS. 15A, 15B, 15D, and 15F. The type three male guide 1870 engages the type three female guide 608 in the pilot 602 and then, as the module 1800 is lowered, enters and engages the type three female guide 1360 on the first module 1300. During this time, translation along the horizontal normal and lateral axes is tightly constrained but there could still be some rotation with the engaged female guides 1834 and/or 1836 (depending on position of the module 1800) and male guides 408 and 1424 acting as a hinge point. The interaction of the male guide 1870 with the female guides 608, 1360 limits rotation of the module by constraining motion of male guide 1870 within the female guide along the lateral axis but providing a greater range of motion along the lateral axis to help avoid binding of the guiding system during the descent of the module 1800 that may result from variations in component positions within manufacturing tolerance ranges. This is analogous to that discussed above with respect to placement of the first module 1300 and illustrated in FIG. 13G.

As discussed above with respect to placement of a typical row module 1400, the female guides 1834,1836 will both be disengaged from the male guide 1434 when the module 1800 is lowered to the point that alignment pins are engaged as shown, e.g., in FIG. 15GF. The height $D_{G4}$ of the top of male guide 1870 is selected with respect to the height $D_{G5}$ of the bottom of the female guide 1360 so that male guide 1870 will disengage when the module 1800 is at substantially the position that upper female guide 1834 disengages from male guide 1424. This disengagement position is illustrated in FIG. 19B.

The bottom of male guide 1870 is positioned on the module 1800 such that height $D_{G3}$ above the bottom of module 1800 is higher than height $D_{G2}$ of the top of male guide block 1332 above the bottom of the first module 1300. This ensures that the bottom end of male guide 1870 will be above the top of the male guide block 1332 when the second row end module 1800 is fully placed on the substrate adjacent the first module 1300 so as to avoid these two male guides interfering with each other during module placement.

From the position of FIG. 19B, the module 1800 can be lowered the remaining amount to the substrate with final alignment provided by the alignment pins and their interaction with corresponding alignment holes.

While generally only the framework of the modules disclosed herein, such as module 1300, is illustrated, it should be appreciated that the modules would in practice be provided in a substantially prefabricated form with exterior walls and various interior structures preinstalled. The present methods and systems also allow for façade panels to be pre-installed on one or more sides of a module, including use of façade panels having edge structures which provide for automatic engagement of edges on adjacent façade panels as the respective modules are installed.

In addition while the various vertical supports in the modules disclosed herein, such as supports 1308, 1310, 1314, 1316, are illustrated as being a single column, which could be hollow support structure (HSS), such as steel profiles with a square or rectangular cross-section, a given support could be implemented with two or more separate columns in close proximity, such as two columns in a corner, one adjacent the front side and one adjacent the first side.

Further, in practice the various vertical supports that define the front, rear, first, and second sides, and thereby the vertical edges of the framework of a given module, will be joined to horizontal supports of the framework using corner node structures as illustrated in the figures. For purpose of the present disclosure a given vertical support is considered as extending from the bottom of the module framework to the top of the module framework, including any corner nodes structures which may be used in the assembly. Thus, for example, male guide block 1330 is at the bottom of the first front support 1308 notwithstanding the presence of a corner node structure.

The figures in the various embodiments show paired upper and lower female guides, such as guides 1430 and 1432, as being separate from each other. This configuration is advantageous where the guides are positioned on parts of a vertical support that may be fabricated separately. For example, female guide 1430 is positioned along the main body of vertical support 1416 while female guide 1432 is positioned in a corner node structure at the bottom of the vertical support 416. In an alternative embodiment, a set of paired upper and lower female guides can be implemented as upper and lower female guide portions of an elongated female guide. In this configuration, the upper female guide is the upper portion of the top of the elongated female guide and the lower female guide is the lower portion of the elongated female guide.

While the various embodiments have been discussed for use with prefabricated building modules that have pre-mounted façade panels, the invention can be used with modules to which façade panels are mounted after the module has been placed. Embodiments of the invention may also be useful in connection with the alignment of different structures that are assembled in a similar stacked configuration.

Various aspects, embodiments, and examples of the invention have been disclosed and described herein. Modifications, additions and alterations may be made by one skilled in the art without departing from the spirit and scope of the invention as defined in the appended claims.

The invention claimed is:

1. A prefabricated building module for inclusion in a modular building, the module comprising:

a framework defining a top and a bottom of the module, first front supports and second front supports defining a front side of the module, first rear supports and second rear supports defining a rear side of the module, wherein the first front supports and the first rear supports define a first side of the module and the second front support and the second rear support define a second side of the module, each of the first supports and the second supports having a respective top end and a bottom end;

a forward male guide on the first side of the module and extending along the first front support from a first forward height above the bottom of the module and upwards towards the top of the module;

a rear male guide on the first side of the module and extending along the first rear support from a first rear height above the bottom of the module and extending upwards towards the top of the module;

a forward upper female guide on the second side of the module and positioned along the second front support at a second forward height above the bottom of the module and a forward lower female guide on the second side of the module and positioned along the second front support at a third forward height above the bottom of the module, wherein the second forward height is shorter than the first forward height and the third forward height is shorter than the second forward height;

a rear upper female guide on the second side of the module and positioned along the second rear support at a second rear height above the bottom of the module and a rear lower female guide on the second side of the module and positioned along the second rear support at a third rear height above the bottom of the module, wherein the second rear height is shorter than the first rear height and the third rear height is shorter than the second rear height;

the forward male guide being of a first male guide type, the rear male guide being of a second male guide type, the forward upper female guide and forward lower female guide each being of a first female guide type, the rear upper female guide and rear lower female guide each being of a second female guide type;

the first male guide type and first female guide type being compatible and configured to constrain motion of a respective first male guide of the first male guide type engaged with a respective first female guide of the first female guide type along a lateral axis of the respective first female guide to first lateral range and along a normal axis of the respective first female guide to a first normal range;

the second male guide type and second female guide type being compatible and configured to constrain motion position of a respective second male guide engaged with a respective second female guide of the second female guide type along a lateral axis of the respective second female guide to second lateral range and along a normal axis of the respective second female guide to a second normal range.

2. The module of claim 1, wherein the second lateral range is greater than the first lateral range and the second normal range is substantially equal to the first normal range.

3. The module of claim 1, wherein the second male guide type is different from the first male guide type.

4. The module of claim 1, wherein the first rear height is substantially the same as the first forward height, the second rear height is substantially the same as the second forward height, and the third rear height is substantially the same as the third forward height.

5. The module of claim 1, further comprising:

a forward male guide extension of the first male guide type removably mounted above the first front support in alignment with the forward male guide; and a rear male guide extension of the second male guide type removably mounted above the first rear support in alignment with the rear male guide.

6. The module of claim 1, the first male guide type comprising a first male guide shape having a first trapezoidal cross-section, a respective outer face and respective sides, each respective side of the first male guide type angled inward at a first angle relative to the respective outer face;

the first female guide type comprising a respective channel portion having a respective bottom and respective sides, each respective side of the first female guide type angled inward at substantially the first angle relative to the respective bottom;

the second male guide type comprising a second male guide shape having a second trapezoidal cross-section, a respective outer face and respective sides, each respective side of the second male guide type angled inward at a second angle relative to the respective outer face, the second angle being less than the first angle; and the second female guide type comprising a respective channel portion having a respective bottom and respective sides angled inward at substantially the second angle relative to the respective bottom.

7. The module of claim 6, wherein the first angle is substantially 45 degrees and the second angle is substantially 30 degrees.

8. The module of claim 1, further comprising a façade panel mounted to the front side of the module.

9. The system of claim 1, wherein a respective pair of (i) the forward upper female guide and forward lower female guide or (ii) the rear upper female guide and rear lower female guide is comprised of a respective upper female guide portion at a top of an elongated female guide and a respective lower female guide portion at a bottom of the elongated female guide.

10. A method for assembling a modular building comprising the steps of:

(a) providing a plurality of building modules including a placed module positioned on a substrate and a new module to be positioned on the substrate adjacent to and in alignment with the placed module, each respective module comprising:

a framework defining a top and a bottom of the module, first front supports and second front supports defining a front side of the module, first rear supports and second rear supports defining a rear side of the module, wherein the first front supports and the first rear supports define a first side of the module and the second front support and the second rear support define a second side of the module, each of the first supports and the second supports having a respective top end and a bottom end;

a forward male guide on the first side of the respective module and extending along the first front support from a first forward height above the bottom of the respective module and upwards towards the top of the respective module;

a rear male guide on the first side of the respective module and extending along the first rear support from a first rear height above the bottom of the respective module and extending upwards towards the top of the respective module;

a forward upper female guide on the second side of the respective module and positioned along the second front support at a second forward height above the bottom of the respective module and a forward lower female guide on the second side of the respective module and positioned along the second front support at a third forward height above the bottom of the respective module, wherein the second forward height is shorter than the first forward height and the third forward height is shorter than the second forward height;

a rear upper female guide on the second side of the respective module and positioned along the second front support at a second rear height above the bottom of the respective module and a rear lower female guide on the second side of the respective module and positioned along the second front support at a third rear height above the bottom of the respective module, wherein the second rear height is shorter than the first rear height and the third rear height is shorter than the second rear height;

the forward male guide being of a first male guide type, the rear male guide being of a second male guide type, the forward upper female guide and forward lower female guide each being of a first female guide type, the rear upper female guide and rear lower female guide each being of a second female guide type;

(b) placing the new module in an initial position above the substrate where the bottom of the new module is above the top of the placed module and the first side of the placed module is horizontally offset from the second side of the new module;

(c) lowering the new module from the initial position to a first position above the substrate in which the forward lower female guide of the new module engages the forward male guide of the placed module and the rear lower female guide of the new module engages the rear male guide of the placed module; and (d) lowering the new module from the first position to a second position above the substrate in which the forward upper female guide of the new module engages the forward male guide of the placed module and the rear upper female guide of the new module engages the rear male guide of the placed module;

wherein the first male guide type and first female guide type are compatible and configured so that when a respective first male guide of the first male guide type is engaged with a respective first female guide of the first female guide type, motion of the respective first male guide relative to the respective first female guide is constrained along a lateral axis of the respective first female guide by a first lateral range and along a normal axis of the respective first female guide by a first normal range; and wherein the second male guide type and second female guide type are compatible and configured so that when a respective second male guide of the second male guide type is engaged with a respective second female guide of the second female guide type, motion of the respective second male guide relative to the respective second female guide is constrained along a lateral axis of the respective second female guide by a second lateral range and along a normal axis of the respective second female guide by a second normal range.

11. The method of claim 10, wherein the first rear height is substantially the same as the first forward height, the second rear height is substantially the same as the second forward height, and the third rear height is substantially the same as the third forward height.

12. The method of claim 10, further comprising the step (e) of lowering the new module from the second position to a third position above the substrate where the forward upper female guide of the new module is at a height above the substrate less than the first forward height and the rear upper female guide of the new module is a height above the substrate less than the first rear height, wherein in the third position the forward upper female guide of the new module is disengaged from the forward male guide of the placed module and the rear upper female guide of the new module is disengaged from the rear male guide of the placed module.

13. The method of claim 12, further comprising the steps of:

prior to the step (c) of lowering the new module from the initial position to the first position, mounting an alignment pin to the substrate, the alignment pin positioned on the substrate at an intended horizontal position when the new module is installed of an alignment hole in the bottom of the new module; and after the step (e) of lowering the new module from the second position to the third position, lowering the new module from the third position to a placed position on the substrate, wherein the alignment pin is engaged within the alignment hole while the new module is lowered from the third position to the placed position.

14. The method of claim 10, further comprising the steps of:

prior to the step (b) of placing the new module in the initial position, mounting a forward male guide extension of the first male guide type above the first front support of the placed module in alignment with the forward male guide of the placed module, and mounting a rear male guide extension of the second male guide type above the first rear support of the placed module in alignment with the rear male guide of the front support;

wherein during the step (b) of lowering the new module from the initial position to the first position, the forward male guide extension engages the forward lower female guide of the new module and the rear male guide extension engages the rear lower female guide of the new module.

15. The method of claim 14, further comprising the step of removing the forward male guide and the rear male guide from the placed module after the new module is positioned on the substrate.

16. The method of claim 10, wherein the first male guide type comprises a male guide shape having a first trapezoidal cross-section, a respective outer face and respective sides, each respective side of the first male guide type angled inward at a first angle relative to the respective outer face;

the first female guide type comprises a respective channel portion having a bottom and respective sides, each respective side of the first female guide type angled inward at the substantially first angle relative to the respective bottom;

the second male guide type comprises a male guide shape having a second trapezoidal cross-section, a respective outer face and respective sides, each respective side of the second male guide type angled inward at a second angle relative to the respective outer face, the second angle being less than the first angle; and the second female guide type comprises a respective channel portion having a bottom and respective sides, each respective side of the second female guide type angled inward at substantially the second angle relative to the bottom.

17. The method of claim 16, wherein the first angle is substantially 45 degrees and the second angle is substantially 30 degrees.

18. The method of claim 10, the plurality of modules further comprising an additional module to be positioned on the substrate adjacent to and in alignment with the new module, the method further comprising, after the new module is positioned on the substrate adjacent to and in alignment with the placed module, repeating steps (b), (c) and (d) with the new module being treated as the placed module and the additional module being treated as the new module.

19. The method of claim 10, wherein a respective pair of (i) the forward upper female guide and forward lower female guide or (ii) the rear upper female guide and rear lower female guide is comprised of a respective upper female guide portion at a top of an elongated female guide and a respective lower female guide portion at a bottom of the elongated female guide.

* * * * *